US011754363B1

(12) United States Patent
Hodgson

(10) Patent No.: US 11,754,363 B1
(45) Date of Patent: Sep. 12, 2023

(54) GIMBALLED PRECESSION STABILIZATION SYSTEM

(71) Applicant: Dale Albert Hodgson, Chardon, OH (US)

(72) Inventor: Dale Albert Hodgson, Chardon, OH (US)

( * ) Notice: Subject to any disclaimer, the term of this patent is extended or adjusted under 35 U.S.C. 154(b) by 0 days.

(21) Appl. No.: 17/386,577

(22) Filed: Jul. 28, 2021

Related U.S. Application Data

(60) Provisional application No. 63/057,934, filed on Jul. 29, 2020, provisional application No. 63/140,478, filed on Jan. 22, 2021.

(51) Int. Cl.
*F41A 27/30* (2006.01)
*F41A 27/28* (2006.01)

(52) U.S. Cl.
CPC ..... *F41A 27/30* (2013.01); *F41A 27/28* (2013.01)

(58) Field of Classification Search
CPC ..... F41A 21/36; F41C 27/22
USPC ..... 89/202; 235/407
See application file for complete search history.

(56) References Cited

U.S. PATENT DOCUMENTS

| | | | | |
|---|---|---|---|---|
| 464,806 | A | 12/1891 | Tower | |
| 640,051 | A | 12/1899 | Tower | |
| 1,573,028 | A | 2/1926 | Bates | |
| 2,106,998 | A | 2/1938 | Fieux | |
| 2,356,189 | A | 8/1944 | Tufts | |
| 2,405,052 | A | 7/1946 | Poitras et al. | |
| 2,472,944 | A | 6/1949 | Furer et al. | |
| 2,532,333 | A | 12/1950 | Rhyne | |
| 2,534,225 | A | 12/1950 | Brown | |
| 2,609,606 | A | 9/1952 | Draper et al. | |
| 2,679,192 | A | 5/1954 | Seeley et al. | |
| 2,690,014 | A * | 9/1954 | Bentley | F41G 5/00 89/41.09 |
| 2,845,737 | A | 8/1958 | Hoyer | |
| 2,938,435 | A | 5/1960 | Gille | |
| 2,968,871 | A * | 1/1961 | Hammond, Jr. | G02B 27/644 89/202 |
| 3,034,116 | A | 5/1962 | Shelley | |
| 3,078,728 | A | 2/1963 | Schlesman | |

(Continued)

OTHER PUBLICATIONS

European search report, dated May 27, 2016, in connection with European Patent Application No. 14788495.1, filed Jan. 10, 2014.

(Continued)

*Primary Examiner* — Bret Hayes
(74) *Attorney, Agent, or Firm* — Volpe Koenig

(57) ABSTRACT

The present disclosure incorporates a spinning rotor/mass, a single or multiple gimballed points on one gimballed axis and to the focus the power of precession to "physically" provide resistance against the movements of the device it is attached to. That is why this device is called a Gimballed Precession Stabilization System. A Gimballed Precession Motor(s) of the present disclosure can be placed in a single or in multiple positions on a Firearm to achieve resistance to an angular change. A Gimballed Precession Motor(s) may be used in one or more positions depending on the desired angular constraint. The motor can be self-contained and can be designed to rotate at a high speed and allow the pivoting of the device on its mounting Gimbal Pivot Axis.

21 Claims, 33 Drawing Sheets

(56) References Cited

U.S. PATENT DOCUMENTS

| | | | | |
|---|---|---|---|---|
| 3,144,644 | A * | 8/1964 | Getting | F41G 5/14 235/407 |
| 3,165,972 | A | 1/1965 | Cumbo | |
| 3,362,073 | A | 1/1968 | Hausenblas et al. | |
| 3,396,630 | A | 8/1968 | Hinterthur et al. | |
| 3,424,522 | A | 1/1969 | Call | |
| 3,489,057 | A | 1/1970 | Tonkin | |
| 3,502,062 | A | 3/1970 | Shurts | |
| 3,640,178 | A | 2/1972 | Chatham et al. | |
| 3,664,199 | A | 5/1972 | Lahde | |
| 3,702,079 | A | 11/1972 | Kranz | |
| 3,913,870 | A | 10/1975 | Bolick | |
| 4,240,302 | A | 12/1980 | Karnick | |
| 4,297,905 | A | 11/1981 | Hadekel | |
| 4,307,653 | A | 12/1981 | Goes et al. | |
| 4,476,969 | A | 10/1984 | Dykema | |
| 4,621,266 | A | 11/1986 | Le Gall et al. | |
| 4,974,493 | A | 12/1990 | Yeffman | |
| 5,113,745 | A | 5/1992 | Allen | |
| 5,339,789 | A | 8/1994 | Heitz | |
| 6,227,098 | B1 | 5/2001 | Mason | |
| 6,234,045 | B1 | 5/2001 | Kaiser | |
| 6,941,851 | B2 | 9/2005 | Urvoy | |
| 6,973,847 | B2 | 12/2005 | Adams et al. | |
| 7,870,814 | B2 | 1/2011 | Lounsbury | |
| 8,028,611 | B2 | 10/2011 | Loundsbury | |
| 8,220,448 | B1 | 7/2012 | Moggo | |
| 9,146,068 | B2 | 9/2015 | Hodgson | |
| 10,415,918 | B1 | 9/2019 | Paspaliaris | |
| 2006/0005447 | A1* | 1/2006 | Lenner | F41G 3/06 42/111 |
| 2010/0281726 | A1* | 11/2010 | Lounsbury | F41G 3/12 42/1.06 |
| 2011/0275435 | A1 | 11/2011 | Torre | |
| 2012/0030984 | A1 | 2/2012 | Andersson | |
| 2015/0377579 | A1* | 12/2015 | Hodgson | F41A 21/36 89/41.09 |
| 2020/0200498 | A1 | 6/2020 | Paspaliaris | |

OTHER PUBLICATIONS

International Search Report and Written Opinion, dated Dec. 9, 2014, in connection with PCT/US14/11062, filed Jan. 10, 2014.

International Preliminary Report on Patentability, dated Jul. 14, 2015, in connection with PCT/US14/11062, filed Jan. 10, 2014.

* cited by examiner

Fig. 72
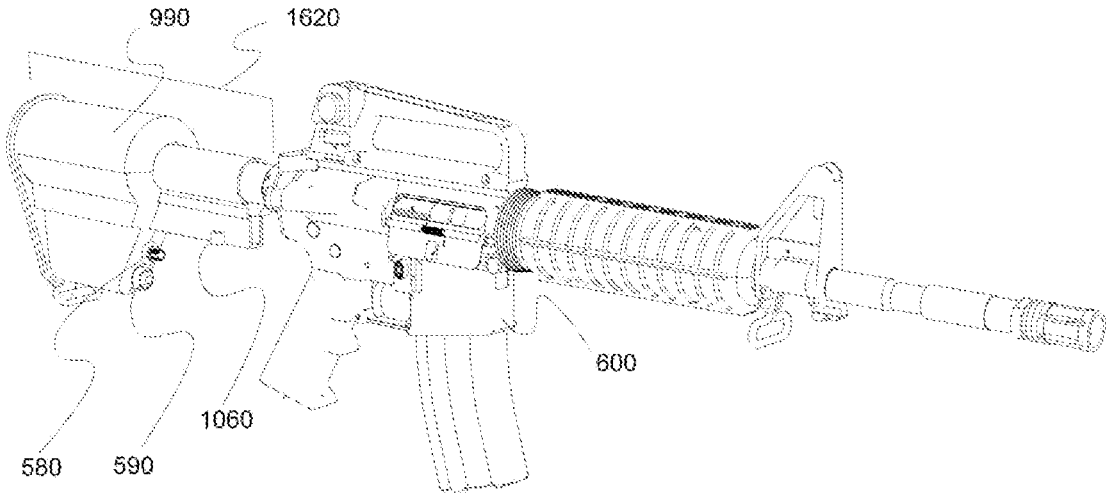
Fig. 73
Fig. 74
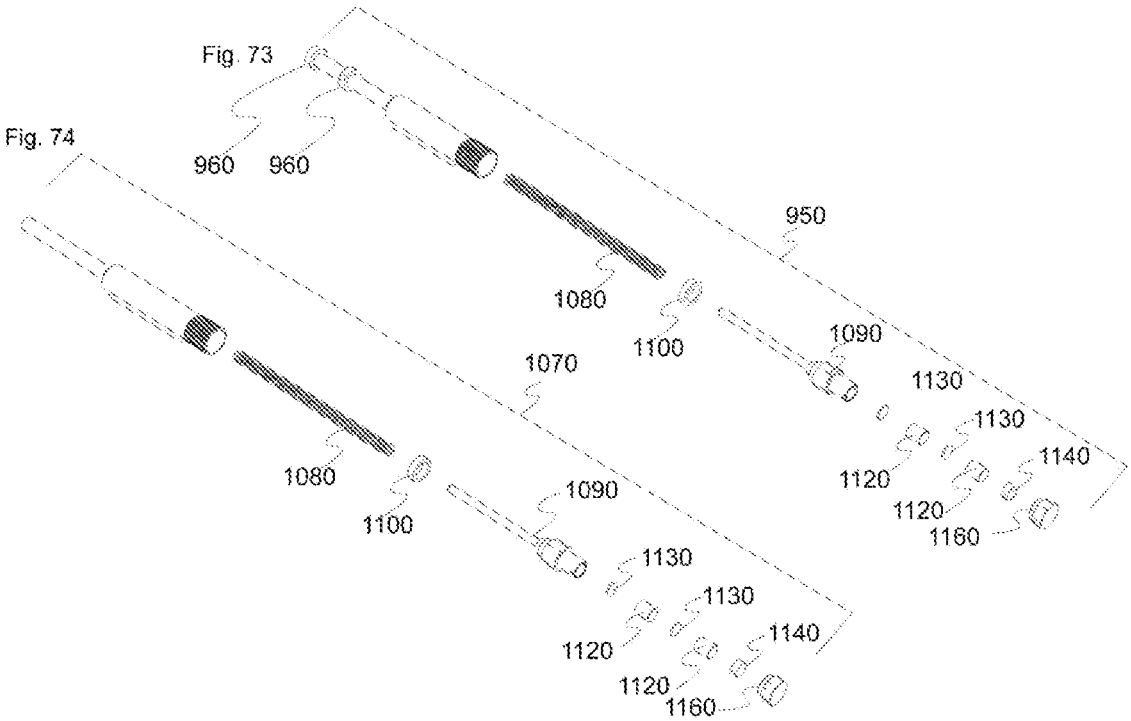

GIMBALLED PRECESSION STABILIZATION SYSTEM

CROSS REFERENCE TO RELATED PATENTS AND APPLICATIONS

This application claims priority to and the benefit of the filing date of U.S. Provisional Patent Application Ser. No. 63/057,934, filed Jul. 29, 2020, and U.S. Provisional Patent Application Ser. No. 63/140,478, filed Jan. 22, 2021, which applications are hereby incorporated by reference.

FIELD

The present application is related to a Gimballed Precession Stabilization System. It finds particular application in conjunction with stabilization of firearms and will be described with particular reference thereto. However, it is to be appreciated that the present exemplary embodiments are also amenable to other like applications.

BACKGROUND

Currently, shooting a Firearm accurately is a difficult process requiring much practice and the marksman's ability to prevent small body movements from shifting the point of aim at the target. Tiny variations in the point of aim at the target have drastic effects on the final point of impact.

For example, assuming everything is perfect, when shooting at a target 300 yards away, with a Firearm measuring 24" and a typical front sight length of 15", a small movement of only 1/16" of the Firearm's front sight in any direction from the "desired point of aim at the target" can change the bullets final impact by as much as 45" in any direction, or a total possible variation in point of impact of a 90" diameter of variation. A 1/16" movement is very negligible, so a variation of more than 90" at the point of impact is very likely.

Trained marksmen use many different tactics to prevent the movement of the muzzle of the Firearm. Some of these tactics include: holding their breath, attempting to brace the Firearm against an external stable surface, minimizing muscular support while using shooting positions which attempt to create structural skeletal support.

Even when using these tactics, a trained marksman will admit that the muzzle and the point of aim at the target never completely stops moving while aiming. At the minimum, the marksman needs to slow the movement of the muzzle while aiming at the target. In many cases, this involves timing the trigger release to coincide with the crossing of the point of aim past the desired target. Even the slowing of the muzzle movement across the desired target will assist in the accuracy of the shot. Accordingly, anything that helps in slowing down the movement of the muzzle while shooting would be a huge help in improving accuracy.

Many different designs of weapon sights, scopes and advanced optics are used to aid in hitting the target, but these devices only help in clarifying and magnifying the visual proof that the muzzle continues to move while aiming at the target.

To assist their accuracy, many marksmen practice with their Firearms from fixed positions which helps eliminate movement and improve their perceived marksmanship skills.

In the real world however, shooting from a fixed position may not always be achievable. In reality the target may be moving. The shooter may have a less than ideal shooting position where rigid surfaces to help stabilize the weapon are unavailable. The marksman may be moving or unsteady. The marksman may have to deal with adrenaline and or muscular fatigue while aiming at the target. Taking the perfect stable shot is difficult.

There is a common misunderstanding of the term "gyroscopic stabilization." Gyroscopes are often misunderstood by the average observer, even with skilled physicists. There is a belief that by simply adding a spinning mass/flywheel to an object, gyroscopic stability is achieved. This is far from true. A spinning mass/flywheel "will not stabilize anything". A flywheel simply stores angular momentum. Nothing Else.

Merriam-Webster defines a flywheel as a heavy wheel for opposing and moderating by its inertia any fluctuation of speed in the machinery with which it revolves also: a similar wheel used for storing kinetic energy (as for motive power). There is no mention of gyroscopic properties.

The average observer grabs a spinning motor with a reasonable amount of mass in their hands and the observer feels what they perceive to be a resistance to angular and position change while moving it in space and changing its orientation. They reasonably assume that what they are feeling is gyroscopic stability, or the devices resistance to angular change. This is an illusion. Instead, what they are feeling in their hands is the spinning motors mass trying to accomplish a principal called precession.

Another common misunderstanding is that by applying a gyroscope to an object, it will have the force to "physically" achieve gyroscopic stabilization of the object. Gyroscopes can hold their relative position of the spinning mass, but are easily overcome by applying a small external force. The vast majority of gyroscopes are tasked with providing only sensor data, not providing physical work to perform stabilization. Most applications rely on sensors to perform tasks based on reading the gyroscope's orientation, and transmitting the information to another device or processor to adjust control surfaces on the vehicle or aircraft to react to the gyroscope's retained orientation.

For example, an airplane transmits this orientation information to a motor or a pump to adjust the airplane's control flaps. A tank stabilizes its barrel by incorporating a gyroscope into its barrel for reading its orientation and with sensors feeding that information back to a series of hydraulic pumps which make adjustments in yaw and pitch of its gun turret to keep it on target. Gyroscopes take many different forms, but in application are only designed to provide a reference to orientation. They do not typically perform "actual work" or provide physical resistance capable of resisting an outside applied force.

SUMMARY

To help the marksman, aspects of the present disclosure introduce Gimballed Precession Stability into the weapon design or as an accessory that can be added to any weapon. By way of example, but not limited to a Firearm, this device may be added to either existing non-stabilized weapons or may be fully incorporated into a newly manufactured Firearm. The device may be incorporated or added to a wide variety of Firearm configurations, both traditional and untraditional. By way of example, but not limited to; the majority of the illustrations and descriptions are focused on a "rifle" type Firearm such as a M4, M16, and AR15 type weapon, however, a wide variety of Firearms benefit from this new device.

A device in accordance with the present disclosure aids in the accurate placement of both the initial shot, subsequent follow-up shots, and both single shot, semi-automatic, and fully automatic firing of the Firearm.

By way of example, but not limited to, a device in accordance with the present disclosure is shown in this disclosure to be used in multiple locations, and in different embodiments on a Firearm such as a rifle.

Aspects of the present disclosure are directed to incorporating a spinning rotor/mass, supporting the spinning mass with single or multiple gimballed points on one gimballed axis, and utilizing the force of precession to "physically" provide resistance against the movements of the device it is attached to—to literally "push back" against an applied external force. This "push back" happens instantaneously, without delay, as a reaction to the externally applied force. That is why this device is called a Gimballed Precession Stabilization System.

A Gimballed Precession Motor(s) which can be placed in a single or in multiple positions on a Firearm to achieve resistance to an angular change. A Gimballed Precession Motor(s) may be used in one or more positions depending on the desired angular constraint. The motor is self-contained and is designed to rotate at a high speed and allow the pivoting of the device on its mounting Gimbal Pivot Axis. This patent covers multiple methods of mounting one or more of these Gimballed Precession Motor(s) onto the Firearm. Its ability to freely pivot while rotating at high speeds creates instant stability or resistance to angular change when the Gimbal Pivot Axis of the Gimballed Precession Motor(s) is both perpendicular to the original rotational axis of the motor and perpendicular to the desired stabilization axis of the motor.

This application of the Gimballed Precession Motor(s) is particularly helpful in aiming a Firearm. The effects of this resistance to angular change can be diminished when not in this precise alignment, but can still influence the stability of the attached device. By using one or more of the Gimballed Precession Motor(s) on different Pivot Axes, the resistance to change is compounded and includes the resulting vectors of influence and resistance to angular change. The positioning of these Gimballed Precession Motor(s) do not need to be aligned, and in fact can be used in different angles, positions, and placements throughout the device needing stabilization. The first several drawings and descriptions of this patent demonstrate in simple ways how a very "counter intuitive" precession works, how a general solution utilizes precession, and how this Gimballed Precession Motor(s) in a few forms harnesses these forces for stabilization unlike prior mere spinning mass type devices (which do not in fact stabilize).

In accordance with one aspect, a gimballed precession stabilization system for an associated weapon comprises a first gimballed precession motor having a first mass rotatable about a first spin axis, the first mass supported by a first gimbal structure configured to permit precession of the first mass about a first gimbal axis, the first gimbal structure configured so that when mounted to the associated weapon, the first gimballed precession motor stabilizes the weapon by generating a first force during precession of the first mass to counteract an external force applied to the associated weapon in a first direction.

The system can include a second gimballed precession motor having a second mass rotatable about a second spin axis, the second mass supported by a second gimbal structure configured to permit precession of the second mass about a second gimbal axis extending at a non-zero angle relative to the first spin axis and the first gimble axis, the second gimbal structure configured so that when mounted to the associated weapon, the second gimballed precession motor stabilizes the weapon by generating a second force during precession of the second mass to counteract an external force applied to the associated weapon in a second direction. The first and second spin axes can be parallel to a line of sight or firing axis of the associated weapon. The first and second gimbal axes can be perpendicular to each other and perpendicular to the first and second spin axes, and the first and second forces generated by the first and second gimballed precession motors act on the associated weapon in perpendicular directions The first and second masses can include annular bodies. The annular bodies can be rotors of the first and second gimballed precession motors. At least one biasing member can be provided for biasing the first mass about the first gimbal axis to a central position. The at least one biasing member can apply a torque to the first mass about the first gimbal axis to resist precession of the first mass. At least one biasing member can be provided for biasing the second mass about the second gimbal axis to a central position. The at least one biasing member can apply a torque to the second mass about the second gimbal axis to resist precession of the second mass. The system can have a central passageway and can be configured for mounting coaxially with a barrel of the associated weapon.

In accordance with another aspect, a weapon comprises a weapon body, a barrel supported by the weapon body, and a gimballed precession stabilization system for stabilizing the weapon. The gimballed precession stabilization system includes a mass rotatable about a spin axis, a motor configured to rotate the mass about the spin axis, a gimbal structure supporting the mass and configured to permit precession of the mass about a gimbal axis. The stabilizer stabilizes the weapon in at least one of a windage or elevation direction by generating a force during precession of the mass to counteract an external force applied to the weapon in at least one of the windage or elevation direction. The gimballed precession stabilization system is integrated into at least one of the weapon body or the barrel of the weapon.

The gimballed precession stabilization system can include a support tube having a central passageway and mounted coaxially with the barrel such that the barrel extends through the central passageway, the rotating mass surrounding at least a portion of the support tube, and the gimbal structure being supported by the support tube such that the rotating mass is internally gimbaled by the gimble structure. The gimbal structure can support the mass for rotation about the spin axis, and the spin axis can be parallel to a line of sight or firing axis of the associated weapon and the gimbal axis is perpendicular to the spin axis. The mass can include an annular body. The mass can be a rotor of an electric motor. The system can further include at least one biasing member for biasing the mass about the gimbal axis to a central position. The at least one biasing member can apply a torque to the mass about the gimbal axis to resist precession. The weapon body can include at least one of a stock or handgrip or rail system, or foregrip or other component.

In accordance with another aspect, a method of stabilizing a weapon comprises providing the weapon with a gimballed precession stabilization system. The gimballed precession stabilization system including: a mass rotatable about a spin axis; a motor configured to rotate the mass about the spin axis; a gimbal structure supporting the mass and configured to permit precession of the mass about a gimbal axis. The method including causing the motor to rotate the mass about the spin axis. The stabilizer stabilizes the weapon in at least one of a windage or elevation direction by generating a force during precession of the mass to counteract an external force applied to the weapon in at least one of the windage or elevation direction.

BRIEF DESCRIPTION OF THE DRAWINGS

(FIG. 3-6).

FIG. 4 is an illustration by way of example but not limited to this preferred embodiment showing; a four-step sequential progression of drawings of the combination of a Gimbal, a spinning Rotor/Mass and a developed Precession Force. The harnessing and manipulation of these three elements are combined to form this invention's patent. Remove any one of these 3 elements, and stabilization will not happen. This is step two of four. (FIG. 3-6).

FIG. 5 is an illustration by way of example but not limited to this preferred embodiment showing; a four-step sequential progression of drawings of the combination of a Gimbal, a spinning Rotor/Mass and a developed Precession Force. The harnessing and manipulation of these three elements are combined to form this invention's patent. Remove any one of these 3 elements, and stabilization will not happen. This is step three of four. (FIG. 3-6).\

FIG. 6 is an illustration by way of example but not limited to this preferred embodiment showing; a four-step sequential progression of drawings of the combination of a Gimbal, a spinning Rotor/Mass and a developed Precession Force. The harnessing and manipulation of these three elements are combined to form this invention's patent. Remove any one of these 3 elements, and stabilization will not happen. This is step four of four. (FIG. 3-6).

FIG. 72 is an illustration by way of example but not limited to this preferred embodiment showing; the Fixed Buttstock Gimballed Precession Motor(s) Stabilizer.

FIG. 73 is an illustration by way of example but not limited to this preferred embodiment showing; an exploded view of the Support Tube-Buffer Tube for the Fixed Buttstock.

FIG. 74 is an illustration by way of example but not limited to this preferred embodiment showing; an exploded view of the Buffer Tube for an Adjustable Buttstock.

DETAILED DESCRIPTION

By way of example, but not limited to these preferred embodiments, the configuration of the wiring in these assemblies may be varied in appearance and for clarity the precise arrangement of wiring has been left out of these drawing, instead focusing on the actual structures.

The terms windage and elevation are used in the traditional manner in this description. Windage generally corresponds to a horizontal direction and elevation generally corresponds to a vertical direction. It will be appreciated, however, that aspects of the present disclosure can be applied to achieve stabilization about virtually any axis. In addition, it will be appreciated that externally applied forces do not need to be parallel to the windage or elevations directions. Rather it is to be understood that any externally applied force having a vector in the windage or elevation direction can be counteracted by a gimballed precession motor that generates a force in a direction counteracting such vector, whether the gimballed precession motor is aligned to produce a force directly along the windage or elevation directions or generates a force having a vector along the windage or elevation directions. A person of skill in the art will recognize that aspects of the present disclosure can be deployed in a wide range of orientations to achieve a desired stabilizing effect, and the illustrated orientations are merely exemplary in nature.

Figure 1:
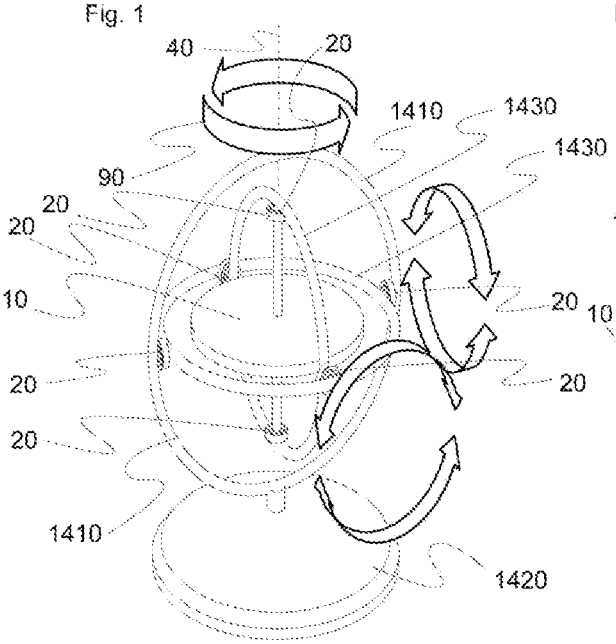
FIG. 1 is an illustration by way of example but not limited to this preferred embodiment showing; a two-step sequential progression of drawings of a traditional gyroscope. This is step one of two (FIG. 1-2). This illustration is the typical understanding of a gyroscope. This example is "not like" what is being achieved by this invention. No physical resistance is created.
Figure 2:
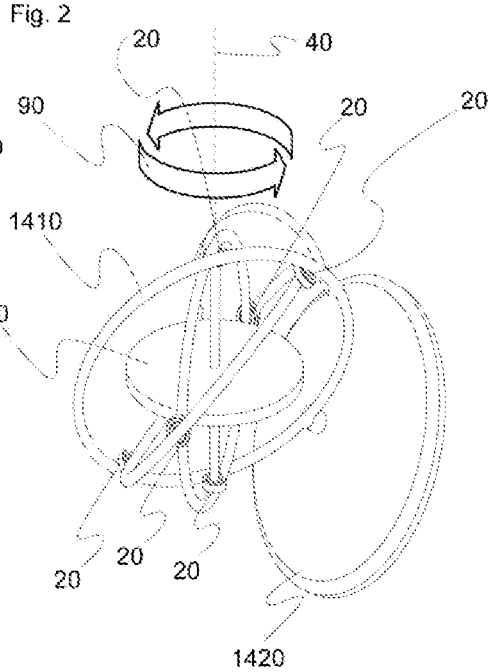
FIG. 2 is an illustration by way of example but not limited to this preferred embodiment showing; a two-step sequential progression of drawings of a traditional gyroscope. This is step two of two (FIG. 1-2). This illustration is the typical understanding of a gyroscope. This example is "not like" what is being achieved by this invention. No physical resistance is created.

FIG. 1 is an illustration by way of example but not limited to this preferred embodiment showing; a two-step sequential progression of drawings of a traditional gyroscope. This is step one of two (FIG. 1-2). This type of gyroscope is typically started by pulling a string wrapped around the Rotor/Mass 10 support shaft. In this illustration, the gyroscope is shown in its original orientation showing the stabilization of the spinning Rotor/Mass 10. The spinning Rotor/Mass(s) 10 is stabilized from changing its axis orientation. Shown in this drawing are the Rotor Rotation Axis 40, and the Rotor Rotation Arrows 90. No matter which way, the traditional gyroscope frame is turned, the spinning Rotor/Mass 10 retains its orientation. The Gimbal Bearing (s)/Bushing(s) 20 allow the Free Rotating Rings 1430 to move in all directions while the spinning Rotor/Mass 10 retains its original orientation from when it started spinning. This gyroscope is shown having the spinning Rotor/Mass 10 oriented in a horizontal and level plane. It will still retain its original orientation while the spinning Rotor/Mass 10 continues to spin. The movement of the Free Rotating Rings 1430 within the Welded Frame 1410 which is attached to the Base 1420 are the only things that move while the gyroscope is manually repositioned in space. This example of a gyroscope can have sensors applied for orientation reading, but does not perform any "real work", and can easily be changed in orientation with the flick of a finger. It is simply a sensor device. This example is "not like" what a device in accordance with the present disclosure. No physical resistance is created.

FIG. 2 is an illustration by way of example but not limited to this preferred embodiment showing; a two-step sequential progression of drawings of a traditional gyroscope. This is step two of two (FIG. 1-2). In this illustration, the gyroscope is shown to have its Free Rotating Rings 1430, its Base 1420, and its Welded Frame 1410 positionally altered. Regardless, the spinning Rotor/Mass(s) 10 is stabilized from changing its axis orientations. Shown in this drawing are the Rotor Rotation Axis 40, and the Rotor Rotation Arrows 90. No matter which way, the traditional gyroscope frame is turned, the Gimbal Bearing(s)/Bushing(s) 20 allow the Free Rotating Rings 1430 to move in all directions while the spinning Rotor/Mass 10 retains its original orientation from when it started spinning. This example of a gyroscope can have sensors applied for orientation reading, but does not perform any "real work", and can easily be changed in orientation with the flick of a finger. It is simply a sensor device. This example is "not like" what is being claimed by this patent. No physical resistance is created.

Figure 3:
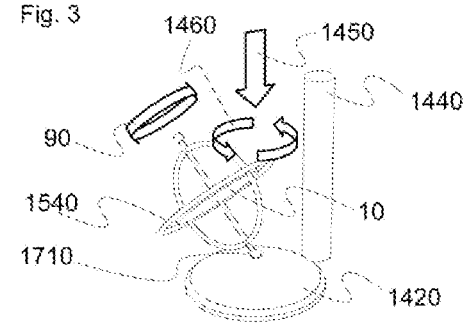
FIG. 3 is an illustration by way of example but not limited to this preferred embodiment showing; a four-step sequential progression of drawings of the combination of a Gimbal, a spinning Rotor/Mass and a developed Precession Force. The harnessing and manipulation of these three elements are combined to form this invention. Remove any one of these 3 elements, and stabilization will not happen. This is step one of four.

FIG. 3 is an illustration by way of example but not limited to this preferred embodiment showing; a four-step sequential progression of drawings of the combination of a Gimbal 1710, a spinning Rotor/Mass 10 and a developed Precession Force 1460. The harnessing and manipulation of these three elements are combined to form this invention. This illustration is step one of four. (FIG. 3-6). Remove any one of these 3 elements, and stabilization will not happen. In this example, a single point Gimbal 1710 is shown (but a dual point Gimbal 1710 known as a Gimbal Pivot Axis 30 is used in the later examples with similar properties). For this demonstration, a gyroscope toy with an Outer Welded Frame 1540 has a free spinning Rotor/Mass 10 enclosed within it. The toy is started to spin by pulling a string wrapped around the Rotor/Mass 10 shaft. Once it has started to spin, it is manually oriented on a 45-degree angle and placed on the Base 1420. An observer would think that the gyroscope would comply with Gravity 1460 and fall, but instead it retains its 45-degree angle, and begins to move around the single point Gimbal 1710 in a counter-clockwise direction, seemingly defying Gravity 1450. This movement around the single point Gimbal is known as "Precession" labeled in the drawing as a Precession Force 1460 and is shown with the arrows. This force can be manipulated for stabilization purposes. Also in this scene a Non-Moving Post 1440 is shown which eventually will block the gyroscopic toys path.

Figure 4:
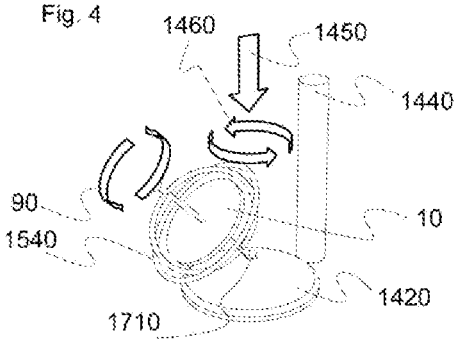

FIG. 4 is an illustration by way of example but not limited to this preferred embodiment showing; a four-step sequential progression of drawings of the combination of a Gimbal 1710, a spinning Rotor/Mass 10 and a developed Precession Force 1460. The harnessing and manipulation of these three elements are combined to form this invention's patent. This illustration is step two of four. (FIG. 3-6). In this scene the Rotor/Mass 10 inside the gyroscope toys Outer Welded Frame 1540 continues to spin in a counter-clockwise direction as indicated by the Rotor Rotation Arrows 90. It also continues to rotate in a counter-clockwise direction as indicated by the Precession Force 1460 direction arrows around the Single Point Gimbal 1710 located on the Base 1420 and shows no sign of stopping. It will continue to seemingly defy Gravity 1450 as long as it is allowed to continue Precession. Also in this scene a Non-Moving Post 1440 is shown which eventually will block the gyroscopic toys path.

Figure 5:
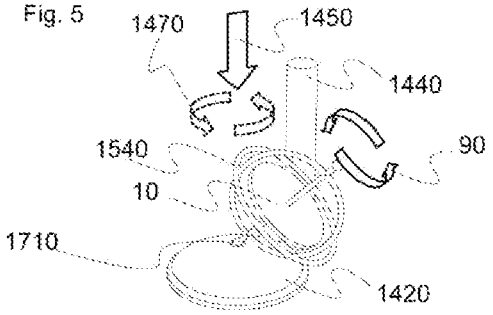

FIG. 5 is an illustration by way of example but not limited to this preferred embodiment showing; a four-step sequential progression of drawings of the combination of a Gimbal 1710, a spinning Rotor/Mass 10 and a developed Precession Force 1460. The harnessing and manipulation of these three elements are combined to form this invention's patent. This illustration is step three of four. (FIG. 3-6). The Rotor/Mass 10 inside the gyroscope toys Outer Welded Frame 1540 continues to spin as shown with the Rotor Rotation Arrows 90 and slowly rotates in a counter-clockwise direction. It also continues to rotate in a counter-clockwise direction as indicated by the Precession Force 1460 direction arrows around the Single Point Gimbal 1710 located on the Base 1420 until it hits the Non-Moving Post 1440. At this moment, the Precession "Stops" 1470 as shown by the arrows. It immediately loses its seemingly Gravity 1450 defying properties and falls to the ground while the spinning Rotor/Mass 10 continues to spin.

Figure 6:
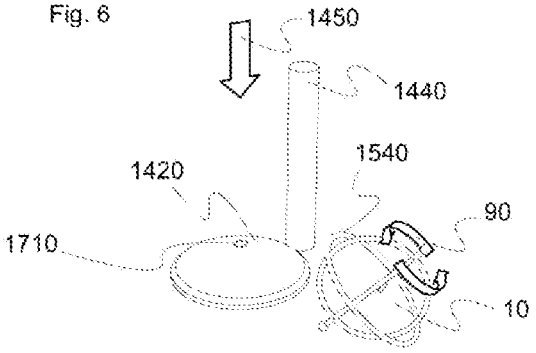

FIG. 6 is an illustration by way of example but not limited to this preferred embodiment showing; a four-step sequential progression of drawings of the combination of a Gimbal 1710, a spinning Rotor/Mass 10 and a developed Precession Force 1460. The harnessing and manipulation of these three elements are combined to form this invention's patent. This illustration is step four of four. (FIG. 3-6). The Rotor/Mass 10 inside the gyroscope toys Outer Welded Frame 1540 continues to spin as fast as it originally did. The Rotor/Mass 10 has not been slowed by the impact with the Non-Moving Post 1440 since the toys Welded Frame 1540 has protected the Rotor/Mass 10 from slowing. However, without the ability to continue the pathway around its Gimbal 1710 the Precession Force 1460 has disappeared and the toy is now on the ground. Without the Precession Force 1460, the spinning Rotor/Mass 10 has lost any ability to stabilize itself and resist the external force of Gravity 1450. Simply stated, this is the reason a simple spinning Rotor/Mass 10 does not stabilize anything. Without a Gimbal(s) 1710 or Gimbal Pivot Axis 30 giving it the ability precess and create a Precession Force 1460, the rotating Rotor/Mass 10 is simply a flywheel and stops having its ability to resist an external force.

Figure 7:
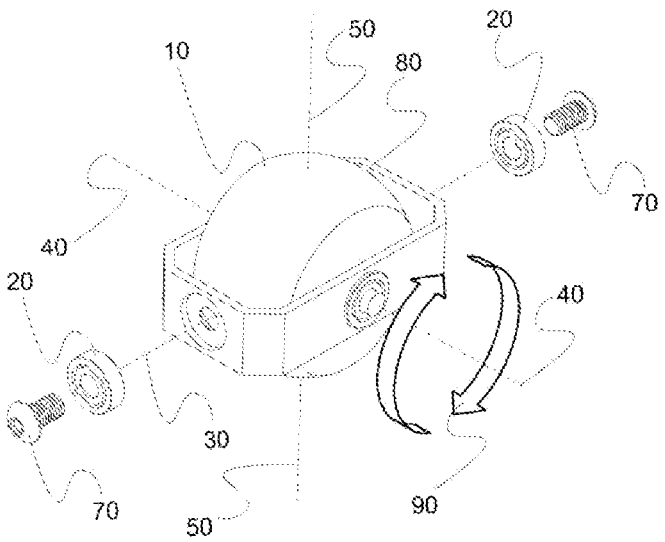
FIG. 7 is an illustration by way of example but not limited to this preferred embodiment showing; a single gimballed spinning Rotor/Mass held in a Frame. This illustration is intended to demonstrate a principle.

FIG. 7 is an illustration by way of example but not limited to this preferred embodiment showing; a single gimballed spinning Rotor/Mass 10 held in a Frame 80, The method of actually powering this device is not discussed in this view. In this example, the spinning Rotor/Mass 10 is positioned inside the Frame 80 and held in place with Gimbal Bearing(s)/Bushing(s) 20 and the entire spinning Rotor/Mass 10 spins on the Rotor Rotation Axis 40. The spinning Rotor/Mass 10 for this example is rotating clockwise as shown by the Rotor Rotation Arrows 90. The Frame 80 makes it possible to attach the Gimbal Bearing(s)/Bushing(s) 20 on the Gimbal Pivot Axis 30 to an outer structure with the Gimbal Screw(s) 70. This will give the spinning Rotor/Mass 10 the ability to pivot on the Gimbal Pivot Axis 30 when the device is disturbed in the Stabilization Axis 50 while the spinning Rotor/Mass 10 is rotating. This outer structure will be the item which is stabilized along the Stabilization Axis 50 as will be shown in the following drawings. This illustration is intended to demonstrate a principle.

Figure 8:
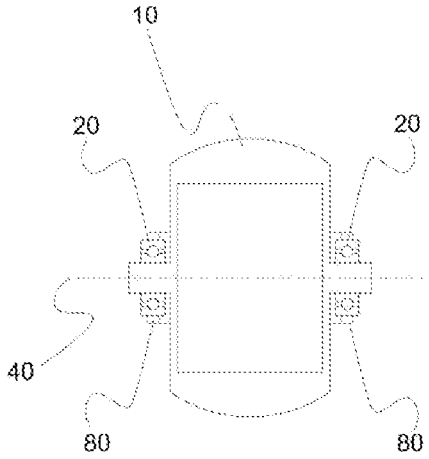
FIG. 8 is an illustration by way of example but not limited to this preferred embodiment showing; a cross-sectional view of the device of FIG. 7 showing the concentration of the mass on the outer edge of the spinning Rotor/Mass. This illustration is intended to demonstrate a principle.

FIG. 8 is an illustration by way of example but not limited to this preferred embodiment showing; a single gimballed spinning Rotor/Mass 10 held in a Frame 80, with an accompanying cross sectional view showing the concentration of the mass of the spinning Rotor/Mass 10 on the outer edge of the spinning Rotor/Mass 10. The Rotor/Mass 10 spins on the Gimbal Bearing(s)/Bushing(s) 20 on the Rotor Rotation Axis 40.

Figure 9:
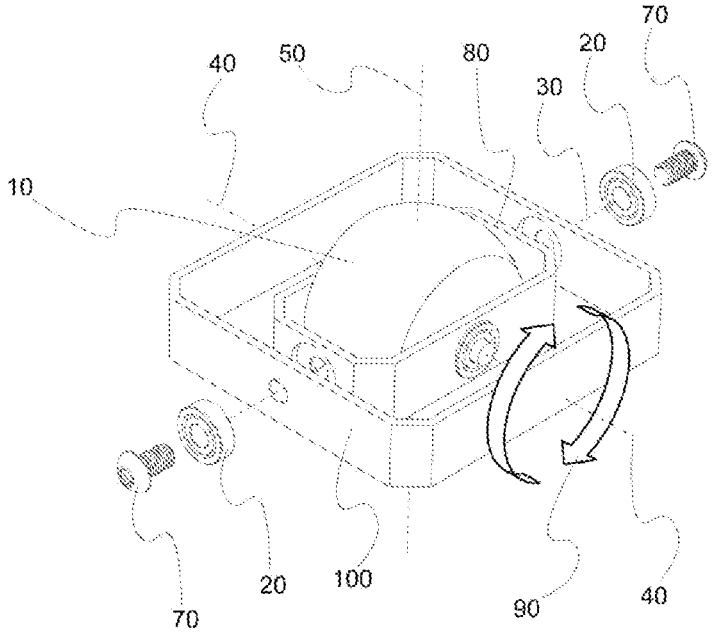
FIG. 9 is an illustration by way of example but not limited to this preferred embodiment showing; a perspective view of an exemplary a gimballed spinning Rotor/Mass shown with an Auxiliary Attachment Frame used to attach the gimballed spinning Rotor/Mass to outer surfaces perpendicular to the Gimbal Pivot Axis. This illustration is intended to demonstrate a principle.

FIG. 9 is an illustration by way of example but not limited to this preferred embodiment showing; a spinning Rotor/Mass 10 rotating on Rotor Rotation Axis 40 shown with an Optional Auxiliary Attachment Frame 100 used to attach the gimballed spinning Rotor/Mass 10 to an outer surface which is not in parallel alignment with the Gimbal Pivot Axis 30. The rotation direction is not important at this time, but will be further defined in the following drawings. In this case the Rotor/Mass 10 and its Frame 80 are mounted directly with its Gimbal Bearing(s)/Bushing(s) 20 and Gimbal Screw(s) 70 to the Optional Auxiliary Attachment Frame 100. By adding the Optional Auxiliary Attachment Frame 100 to the assembly it gives more flexibility in mounting it to a Support Structure 150 (not shown in this view). This frame can be made in any shape. The assembly is designed to stabilize on Stabilization Axis 50. This is the axis that will resist angular change. This illustration is intended to demonstrate a principle.

Figure 10:
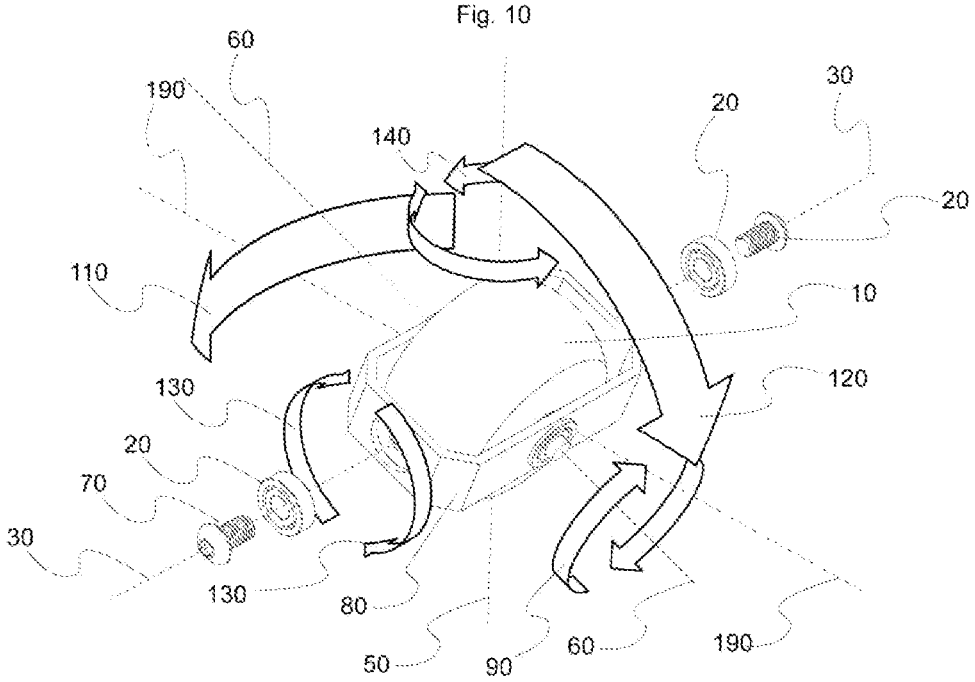
FIG. 10 is an illustration by way of example but not limited to this preferred embodiment showing; a perspective view of an exemplary gimballed spinning Rotor/Mass and its reaction to an Applied External Force, and the subsequent Precession Force developed and harnessed by this device. This illustration is intended to demonstrate a principle.

FIG. 10 is an illustration by way of example but not limited to this preferred embodiment showing; a gimballed spinning Rotor/Mass 10 which is pivoting on the Gimbal Bearing(s)/Bushing(s) 20 which is attached and housed within a Frame 80 with the Gimbal Screw(s) 70, and its reaction to an Applied External Force 110, and the subsequent Precession Response 120 developed and harnessed by this device. This illustration shows this assembly as though it were attached to an external Support Structure 150 (not shown in this view). The illustration shows the associated Gimbal Pivot Axis 30, the Rotor Rotation Axis 40, and the Stabilization Axis 50 along with the associated Gimbal Rotation Arrows 130, the Rotor Rotation Arrows 90, and the Stabilization Rotation Arrows 140. While these arrows are illustrated as pointing in both directions, this only illustrates how the Stabilization Rotation Arrows 140 can be reversed by modifying the direction of the Applied External Force 110. In this case, the Rotor/Mass 10 is spinning in a clockwise direction, although identical results can be achieved by spinning the Rotor/Mass in a counter-clockwise direction. The direction and magnitude of the Precession Response 120 is determined entirely by the direction and magnitude of the Applied External Force 110, not by the direction of the Rotor/Spinning Mass 10 rotation. It also shows the Modified Rotor Axis due to Precession 60 and the Original Rotor Rotation Axis 190. This illustration is intended to demonstrate a principle.

Figure 11:
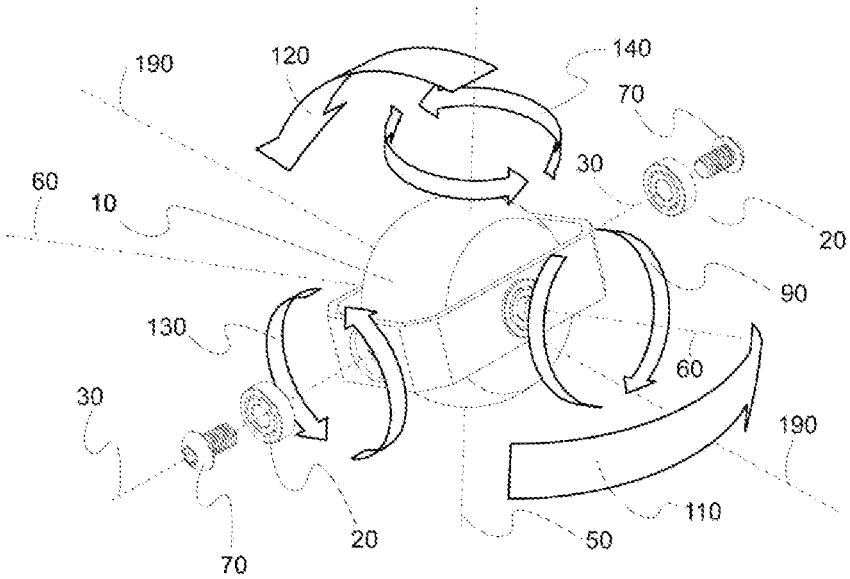
FIG. 11 is an illustration by way of example but not limited to this preferred embodiment showing; a perspective view of an exemplary gimballed spinning Rotor/Mass and its reaction to an Applied External Force "in the opposite direction", and the subsequent Precession Forces "in the opposite direction" developed and harnessed by this device. This illustration is intended to demonstrate a principle.

FIG. 11 is an illustration by way of example but not limited to this preferred embodiment showing; a gimballed spinning Rotor/Mass 10 and its reaction to an Applied External Force 110 "in the opposite direction" and the subsequent Precession Response 120 "in the opposite direction" developed and harnessed by this device. This illustration shows a gimballed spinning Rotor/Mass 10 which is pivoting on the Gimbal Bearing(s)/Bushing(s) 20 which is attached housed within a Frame 80 with the Gimbal Screw(s) 70, and its reaction to an Applied External Force 110, and the subsequent Precession Response 120 developed and harnessed by this device. This illustration shows this assembly as though it were attached to an external Support Structure 150 (not shown in this view). The illustration shows the associated Gimbal Pivot Axis 30, and the Stabilization Axis 50 along with the associated Gimbal Rotation Arrows 130, the Rotor Rotation Arrows 90, and the Stabilization Rotation Arrows 140. It also shows the Modified Rotor Axis due to Precession 60 and the Original Rotor Rotation Axis 190. The direction and magnitude of the Precession Response 120 is determined entirely by the direction and magnitude of the Applied External Force 110, not by the direction of the Rotor/Spinning Mass 10 rotation. This illustration is intended to demonstrate a principle.

Figure 12:
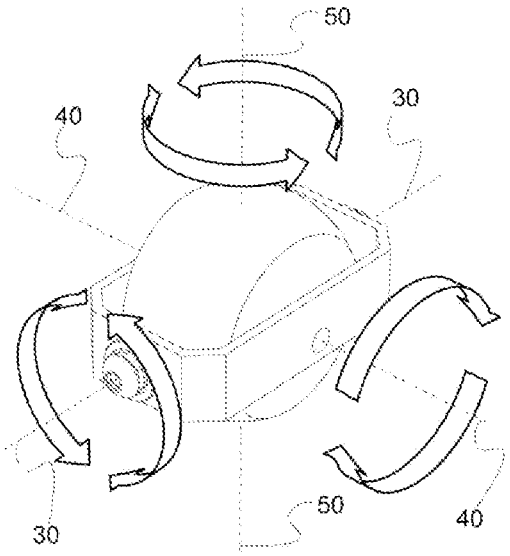
FIG. 12 is an illustration by way of example but not limited to this preferred embodiment showing; a perspective view of an exemplary Gimballed spinning Rotor/Mass and its subsequent resistance to angular change depending on the axis of rotation, the gimbal axis orientation, and the subsequent stabilization axis. This illustration is intended to demonstrate a principle.

FIG. 12 is an illustration by way of example but not limited to this preferred embodiment showing; a set of six different drawings showing the combinations of a Gimbal 1710, a spinning Rotor/Mass 10 and a developed Precession Force 1460 in an sample assembly turned in different orientations. The harnessing and manipulation of these three elements are combined to form this inventions patent. This illustration is drawing one of six. (FIG. 12-17). The illustration also shows the associated Gimbal Pivot Axis 30, the Rotor Rotation Axis 40, and the Stabilization Axis 50. The Stabilization Axis 50 directly opposes External Forces Applied to the same Axis. The direction of the Rotor/Mass 10 rotation is shown as clockwise, although it could as easily be shown as counter-clockwise. This illustration is intended to demonstrate a principle.

Figure 13:
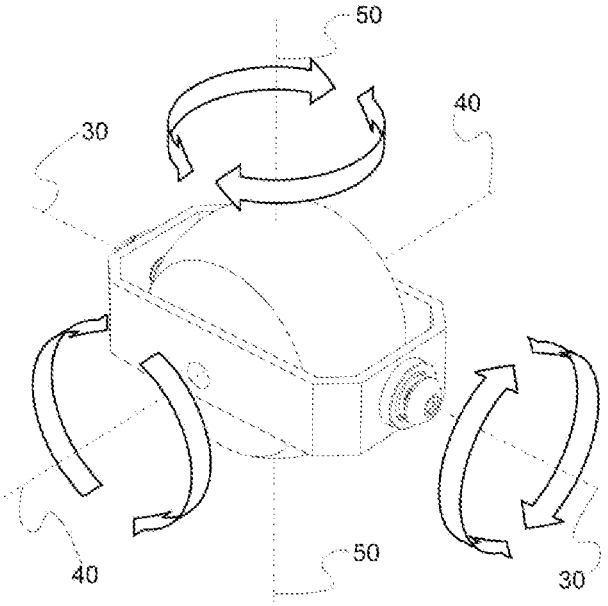
FIG. 13 is an illustration by way of example but not limited to this preferred embodiment showing; a perspective view of an exemplary Gimballed spinning Rotor/Mass and its subsequent resistance to angular change depending on the axis of rotation, the gimbal axis orientation, and the subsequent stabilization axis. This illustration is intended to demonstrate a principle.

FIG. 13 is an illustration by way of example but not limited to this preferred embodiment showing; a set of six different drawings showing the combinations of a Gimbal 1710, a spinning Rotor/Mass 10 and a developed Precession Force 1460 in an sample assembly turned in different orientations. The harnessing and manipulation of these three elements are combined to form this inventions patent. This illustration is drawing two of six. (FIG. 12-17). The illustration also shows the associated Gimbal Pivot Axis 30, the Rotor Rotation Axis 40, and the Stabilization Axis 50. The Stabilization Axis 50 directly opposes External Forces Applied to the same Axis. The direction of the Rotor/Mass 10 rotation is shown as clockwise, although it could as easily be shown as counter-clockwise. This illustration is intended to demonstrate a principle.

Figure 14:
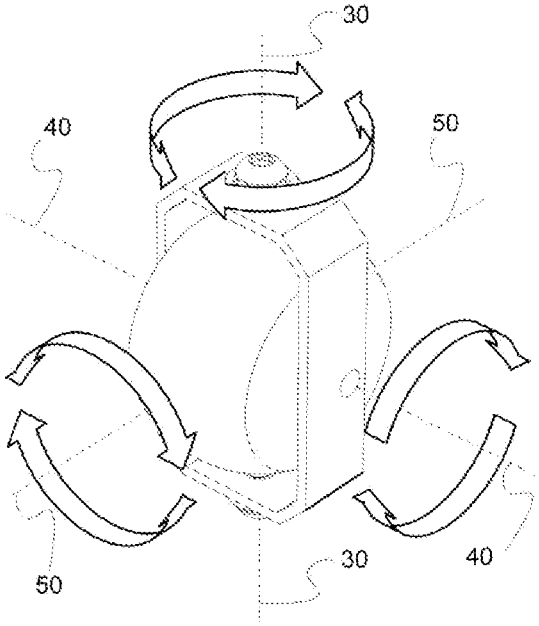
FIG. 14 is an illustration by way of example but not limited to this preferred embodiment showing; a perspective view of an exemplary Gimballed spinning Rotor/Mass and its subsequent resistance to angular change depending on the axis of rotation, the gimbal axis orientation, and the subsequent stabilization axis. This illustration is intended to demonstrate a principle.

FIG. 14 is an illustration by way of example but not limited to this preferred embodiment showing; a set of six different drawings showing the combinations of a Gimbal 1710, a spinning Rotor/Mass 10 and a developed Precession Force 1460 in an sample assembly turned in different orientations. The harnessing and manipulation of these three elements are combined to form this inventions patent. This illustration is drawing three of six. (FIG. 12-17). The illustration also shows the associated Gimbal Pivot Axis 30, the Rotor Rotation Axis 40, and the Stabilization Axis 50. The Stabilization Axis 50 directly opposes External Forces Applied to the same Axis. The direction of the Rotor/Mass 10 rotation is shown as clockwise, although it could as easily be shown as counter-clockwise. This illustration is intended to demonstrate a principle.

Figure 15:
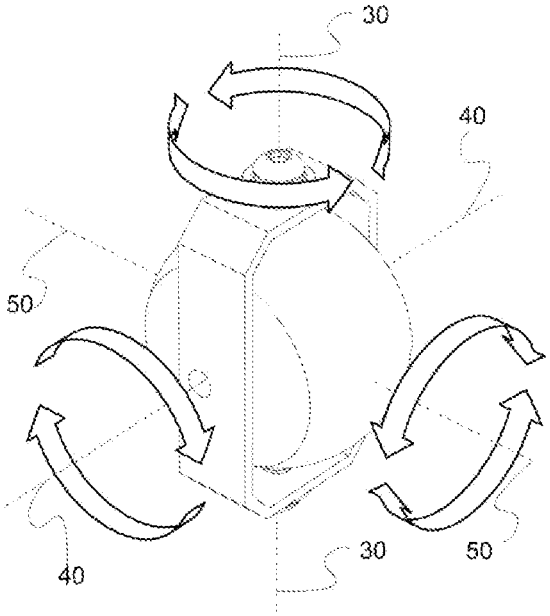
FIG. 15 is an illustration by way of example but not limited to this preferred embodiment showing; a perspective view of an exemplary Gimballed spinning Rotor/Mass and its subsequent resistance to angular change depending on the axis of rotation, the gimbal axis orientation, and the subsequent stabilization axis. This illustration is intended to demonstrate a principle.

FIG. 15 is an illustration by way of example but not limited to this preferred embodiment showing; a set of six different drawings showing the combinations of a Gimbal 1710, a spinning Rotor/Mass 10 and a developed Precession Force 1460 in an sample assembly turned in different orientations. The harnessing and manipulation of these three elements are combined to form this inventions patent. This illustration is drawing four of six. (FIG. 12-17). The illustration also shows the associated Gimbal Pivot Axis 30, the Rotor Rotation Axis 40, and the Stabilization Axis 50. The Stabilization Axis 50 directly opposes External Forces Applied to the same Axis. The direction of the Rotor/Mass 10 rotation is shown as clockwise, although it could as easily be shown as counter-clockwise. This illustration is intended to demonstrate a principle.

Figure 16:
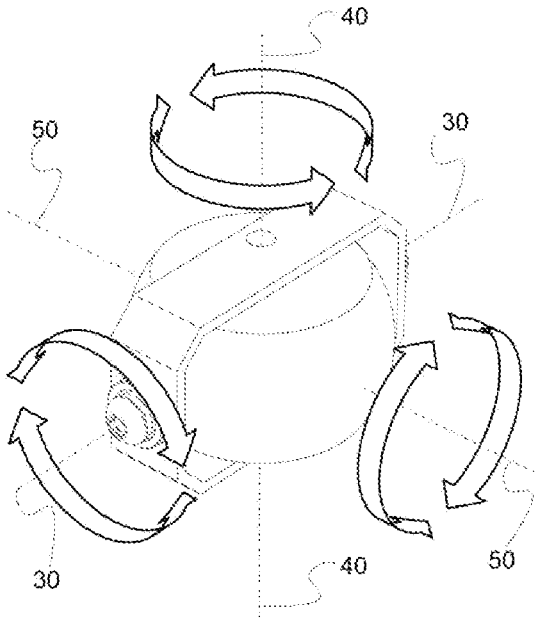
FIG. 16 is an illustration by way of example but not limited to this preferred embodiment showing; a perspective view of an exemplary Gimballed spinning Rotor/Mass and its subsequent resistance to angular change depending on the axis of rotation, the gimbal axis orientation, and the subsequent stabilization axis. This illustration is intended to demonstrate a principle.

FIG. 16 is an illustration by way of example but not limited to this preferred embodiment showing; a set of six different drawings showing the combinations of a Gimbal 1710, a spinning Rotor/Mass 10 and a developed Precession Force 1460 in an sample assembly turned in different orientations. The harnessing and manipulation of these three elements are combined to form this inventions patent. This illustration is drawing five of six. (FIG. 12-17). The illustration also shows the associated Gimbal Pivot Axis 30, the Rotor Rotation Axis 40, and the Stabilization Axis 50. The Stabilization Axis 50 directly opposes External Forces Applied to the same Axis. The direction of the Rotor/Mass 10 rotation is shown as clockwise, although it could as easily be shown as counter-clockwise. This illustration is intended to demonstrate a principle.

Figure 17:
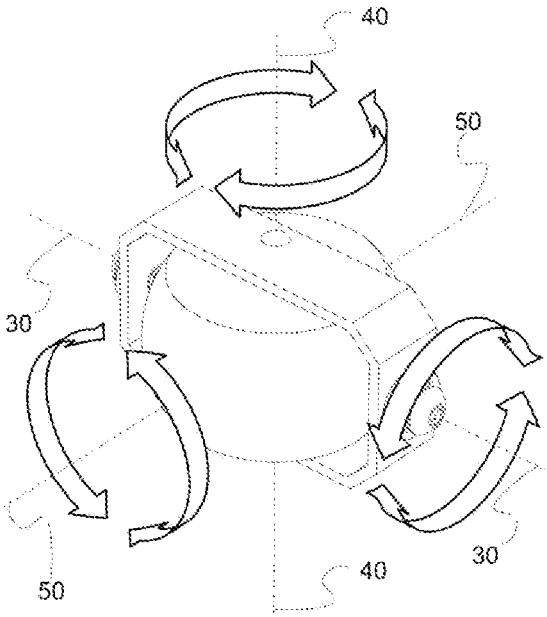
FIG. 17 is an illustration by way of example but not limited to this preferred embodiment showing; a perspective view of an exemplary Gimballed spinning Rotor/Mass and its subsequent resistance to angular change depending on the axis of rotation, the gimbal axis orientation, and the subsequent stabilization axis. This illustration is intended to demonstrate a principle.

FIG. 17 is an illustration by way of example but not limited to this preferred embodiment showing; a set of six different drawings showing the combinations of a Gimbal 1710, a spinning Rotor/Mass 10 and a developed Precession Force 1460 in an sample assembly turned in different orientations. The harnessing and manipulation of these three elements are combined to form this inventions patent. This illustration is drawing six of six. (FIG. 12-17). The illustration also shows the associated Gimbal Pivot Axis 30, the Rotor Rotation Axis 40, and the Stabilization Axis 50. The Stabilization Axis 50 directly opposes External Forces Applied to the same Axis. The direction of the Rotor/Mass 10 rotation is shown as clockwise, although it could as easily be shown as counter-clockwise. This illustration is intended to demonstrate a principle.

Figure 18:
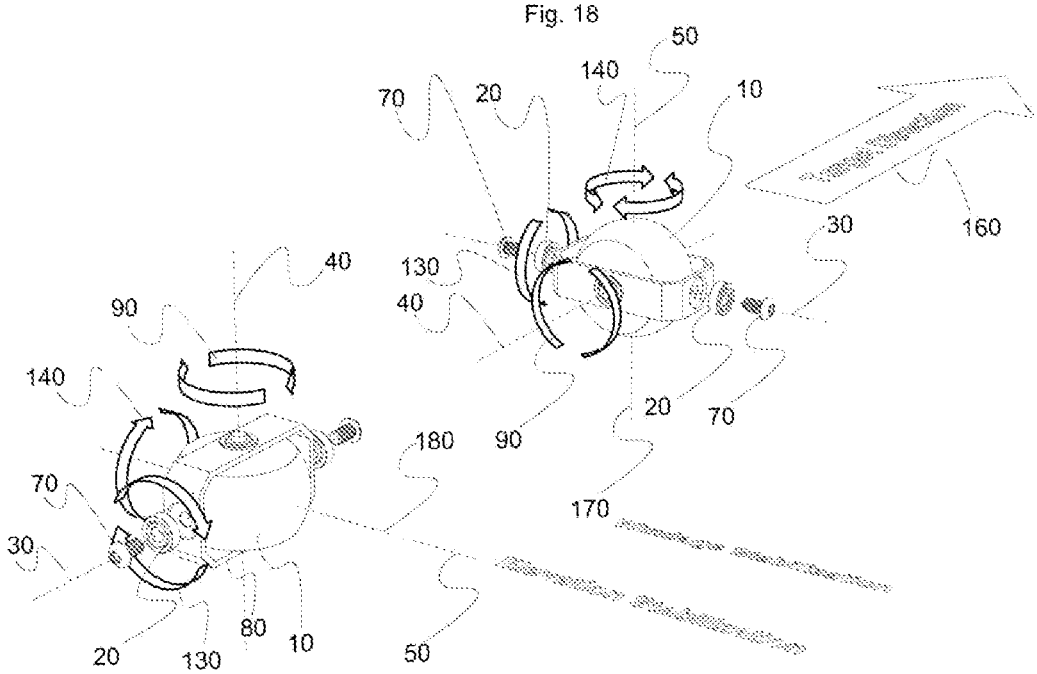
FIG. 18 is an illustration by way of example but not limited to this preferred embodiment showing; multiple gimballed spinning Rotor/Mass combinations, and how they can be used together to achieve multi axis stabilization. This illustration shows a partially exploded view of an assembly. This illustration is intended to demonstrate a principle.

FIG. 18 is an illustration by way of example but not limited to this preferred embodiment showing; multiple gimballed spinning Rotor/Mass 10 combinations, and how they can be used together to achieve multi axis stabilization. This illustration shows a partially exploded view of an assembly, showing the Gimbal Bearing(s)/Bushing(s) 20, and the Gimbal Screw(s) 70 securing the Rotor/Mass 10 to the Frame 80. The illustration shows the associated Gimbal Pivot Axis 30, the Rotor Rotation Axis 40, and the Stabilization Axis 50 along with the associated Gimbal Rotation Arrows 130, the Rotor Rotation Arrows 90, and the Stabilization Rotation Arrows 140. By aligning the different assemblies as shown, both Elevation Stabilization 180 and Windage Stabilization 170 are achieved as the Firearm 600 is pointed in the Target Direction 160. This illustration is intended to demonstrate a principle.

Figure 19:
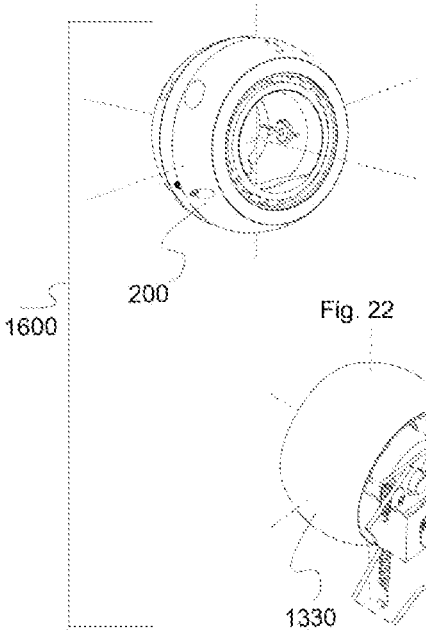
FIG. 19 is an illustration by way of example but not limited to five preferred embodiments of this invention, as well as possible applications of the invention listed in the rest of this patent. These motors are defined as Gimballed Precession Motor Stabilizer(s). This is the category. The first configuration is known as the Internally Gimballed Integrated Precession Motor(s). Details of this configuration are discussed in FIG. 24-30.

FIG. 19 is an illustration by way of example but not limited to five preferred embodiments of this invention, as well as possible applications of the invention listed in the rest of this patent. These motors are defined as Gimballed Precession Motor Stabilizer(s) 1600. This is the category.

The first configuration is known as the Internally Gimballed Integrated Precession Motor(s) 200. Details of this configuration are discussed in FIG. 24-30. Although specific versions of these Gimballed Precession Motor(s) are shown with different application drawings, they are mostly interchangeable in the applications.

Figure 20:
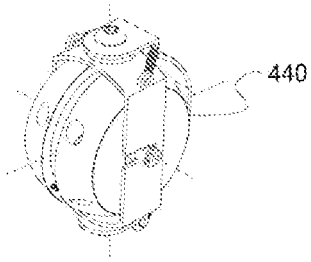
FIG. 20 is an illustration by way of example but not limited to these preferred embodiments showing; the second configuration is known as the Externally Gimballed Integrated Precession Motor(s). Details of this configuration are discussed in FIG. 31-36.

FIG. 20 is an illustration by way of example but not limited to these preferred embodiments showing; the second configuration is known as the Externally Gimballed Integrated Precession Motor(s) 440. Details of this configuration are discussed in FIG. 31-36. Although specific versions of these Gimballed Precession Motor(s) are shown with different application drawings, they are mostly interchangeable in the applications.

Figure 21:
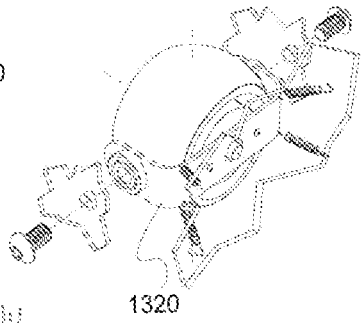
FIG. 21 is an illustration by way of example but not limited to these preferred embodiments showing; the third configuration is known as the Externally Gimballed Non-Integrated Precession Motor(s). Details of this configuration are discussed in FIG. 37-40.

FIG. 21 is an illustration by way of example but not limited to these preferred embodiments showing; the third configuration is known as the Externally Gimballed Non-Integrated Precession Motor(s) 1320. Details of this configuration are discussed in FIG. 37-40. Although specific versions of these Gimballed Precession Motor(s) are shown with different application drawings, they are mostly interchangeable in the applications.

Figure 22:
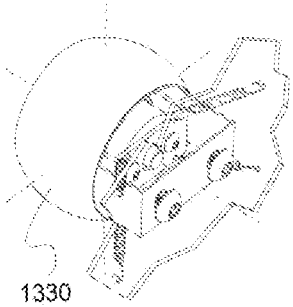
FIG. 22 is an illustration by way of example but not limited to these preferred embodiments showing; the fourth configuration known as the Internally Gimballed Non-Integrated Precession Motor(s). Details of this configuration are discussed in FIG. 41-44.

FIG. 22 is an illustration by way of example but not limited to these preferred embodiments showing; the fourth configuration is known as the Internally Gimballed Non-Integrated Precession Motor(s) 1330. Details of this configuration are discussed in FIG. 41-44. Although specific versions of these Gimballed Precession Motor(s) are shown with different application drawings, they are mostly interchangeable in the applications.

Figure 23:
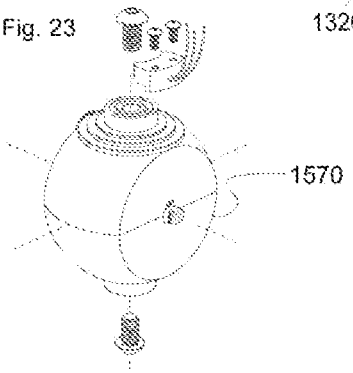
FIG. 23 is an illustration by way of example but not limited to these preferred embodiments showing; the fifth configuration is known as the 360-degree Gimballed Precession Motor(s). Details of this configuration are discussed in FIG. 45-48.

FIG. 23 is an illustration by way of example but not limited to these preferred embodiments showing; the fifth configuration is known as the 360-degree Gimballed Precession Motor(s) 1570. Details of this configuration are discussed in FIG. 45-48. Although specific versions of these Gimballed Precession Motor(s) are shown with different application drawings, they are mostly interchangeable in the applications.

Figure 24:
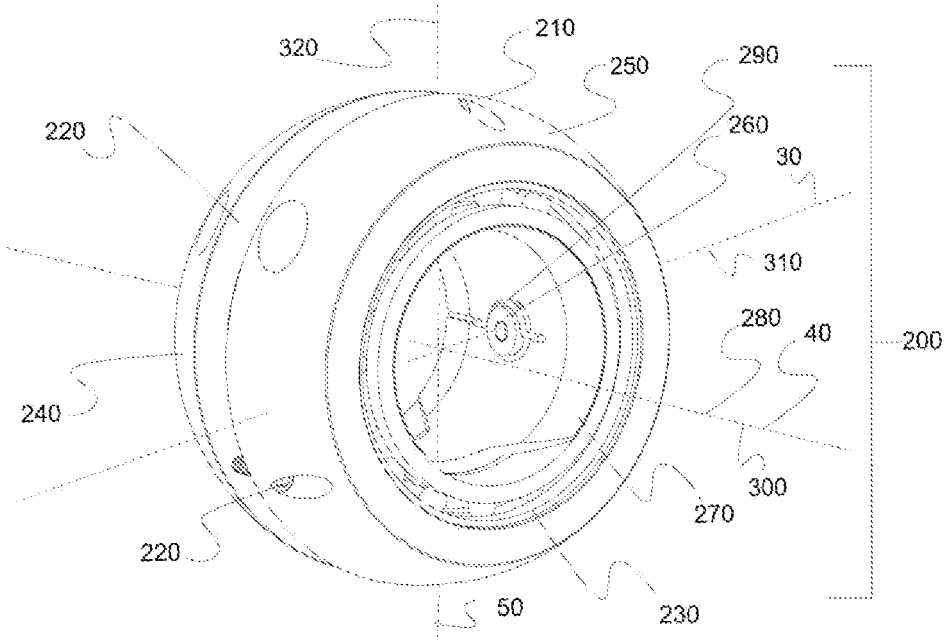
FIG. 24 is an illustration by way of example but not limited to this preferred embodiment showing; a motor in the Gimballed Precession Motor(s) category. This is the Internally Gimballed Integrated Precession Motor(s) Assembly.

FIG. 24 is an illustration by way of example but not limited to this preferred embodiment showing; a motor in the Gimballed Precession Motor(s) 1600 category. This is the Internally Gimballed Integrated Precession Motor(s) 200 Assembly. This assembly is designed to operate at a high rotational speed on a Gimbal Pivot Axis 30, and use that developed force to create a stabilizer. This is based on easily manufacturing two large sections of mass to form a motor and create the resulting force while rotating, which is used to produce and control the Precession Force 1460 on a Gimbal Pivot Axis 30. In order to utilize this, there is a balance between the diameter of the assembly, the spinning Rotor/Mass 10 of the assembly, and the revolution speed of the assembly. You can interchange any of these elements to achieve the maximum Precession Force 1460, but it is a balancing act between weight, revolutions per minute, size and possible placement on a device, by way of example, but not limited to a Firearm 600. This motor is assembled in two halves; Rotor Half 240 and Rotor Half B 250, and mounted directly onto a Pivot Tube 270. The assembly is held together by way of example, but not limited to the usage of Screw(s) 220. This motor incorporates Vent Holes 210 which are designed to keep the internal elements and external parts cool during the spinning Rotor/Mass 10 rotation. The Vent Holes 210 are designed with opposing angles machined into Rotor Half A 240 and Rotor Half B 250 to allow the intake of cool air and the expulsion of heated air during the Internally Gimballed Integrated Precession Motor(s) 200 rotation. This assembly is then mounted on a Support Tube 1260 (not shown in this view). In this view, the electrical wires entering the motor are not shown for clarity. The Internally Gimballed Integrated Precession Motor(s) 200 has two internal Micro Bearing(s)/Bushing(s) 260 also known as the Gimbal Bearing(s)/Bushing(s) 20 which are designed to let the motor freely pivot on the Gimbal Pivot Axis 30. Also shown in the illustration are designations for the Roll Axis 300, the Pitch Axis 310, and the Yaw Axis 320. The Roll Axis 300 is also the Rotor Rotation Axis 40 and the Center Line of Assembly 280 of the Internally Gimballed Integrated Precession Motor(s) 200. The Pitch Axis 310 is the same axis as the Gimbal Pivot Axis 30 and that of the centerline of the Micro Bearing(s)/Bushing(s) 260. The Internally Gimballed Integrated Precession Motor(s) 200 is designed to have Precession on the Pitch Axis 310. When attempts are made to change the orientation of the Yaw Axis 320, precession occurs on the Pitch Axis 310, resisting the movement on the Yaw Axis 320. The Yaw Axis 320 is the axis which is stabilized by the Internally Gimballed Integrated Precession Motor(s) 200. A single Internally Gimballed Integrated Precession Motor(s) 200 can be used, or multiple assemblies can be utilized in different positions and orientations and with different relative axis orientations.

Figure 25:
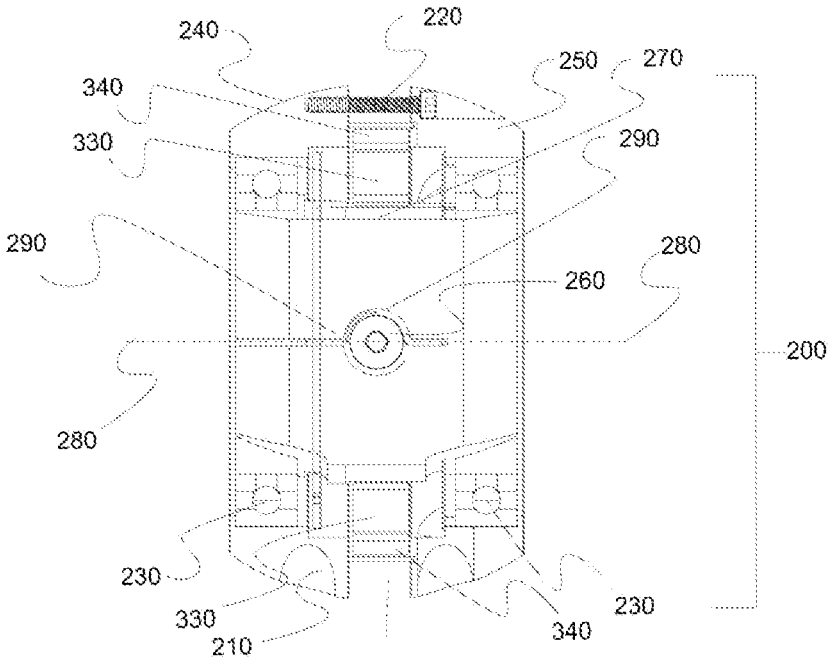
FIG. 25 is an illustration by way of example but not limited to this preferred embodiment showing; a cutaway view of the assembled Internally Gimballed Integrated Precession Motor(s).

FIG. 25 is an illustration by way of example but not limited to this preferred embodiment showing; a cutaway view of the assembled Internally Gimballed Integrated Precession Motor(s) 200. This view shows Rotor Half A 240, Rotor Half B 250, Magnet(s) 340, Screw(s) 220, the Micro Bearing(s)/Bushing(s) 260, Pivot Tube Spring(s) 290, and the Bearings 230 are assembled onto the Pivot Tube 270 along the Centerline of the Assembly 280. Pivot Tube 270 is the core of this assembly. Rotor Half A 240 is where the Magnets 340 are bonded. Also shown in this view are the Micro Bearing(s)/Bushing(s) 260 which forms the center of the Gimbal Pivot Axis 30. At the core of this motor is a Stator 330 and a Stator Circuit Board 350 which greatly simplifies the wiring connections to the Stator 330. In this view, the magnet wire windings and the wiring connections are not shown for clarity. In this view, all of the parts and their relative positions are called out including the Gimbal Screw(s) 70 which attach to the Micro Bearing(s)/Bushing(s) 260 and form the connection between the Pivot Tube 270 and the Support Tube 1260 (not shown in this view).

Figure 26:
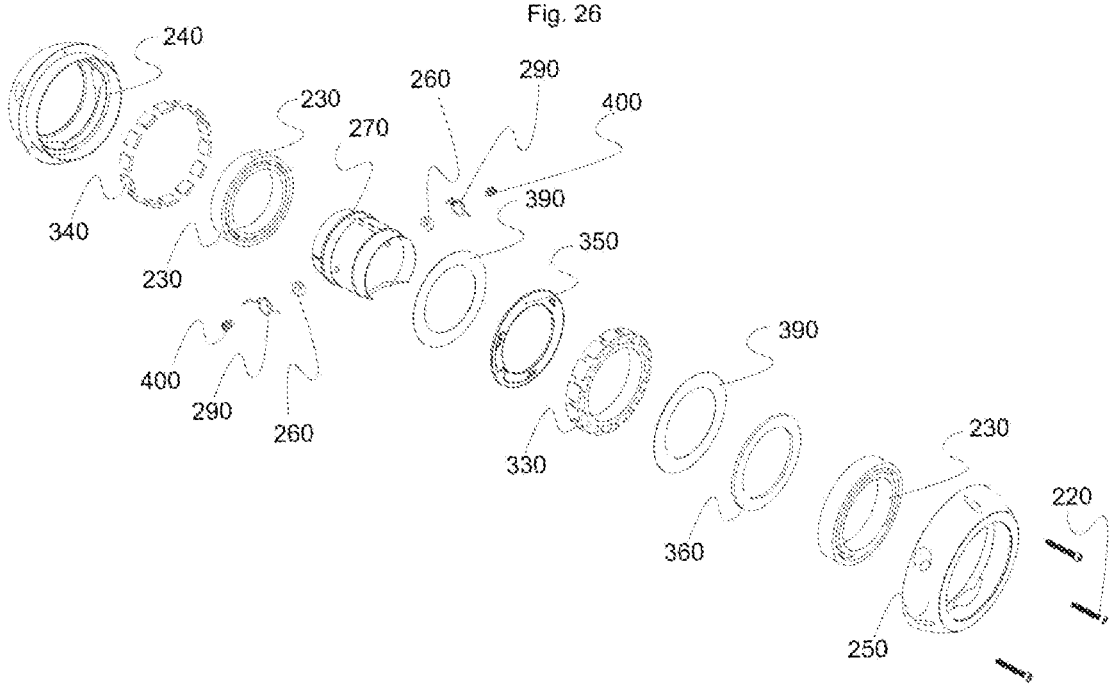
FIG. 26 is an illustration by way of example but not limited to this preferred embodiment showing; an exploded drawing of an Internally Gimballed Integrated Precession Motor(s).

FIG. 26 is an illustration by way of example but not limited to this preferred embodiment showing; an exploded drawing of an Internally Gimballed Integrated Precession Motor(s) 200. There are several ways to assemble this self-contained motor, but in this preferred embodiment it shows Rotor Half A 240 and Rotor Half B 250 screwed together to form an enclosed assembly. Rotor Half A 240 has a series of Magnets 340 attached to its internal surface. In this preferred embodiment, there are 14 individual Magnets 340, but there could be a wide variety of different numbers of Magnets 340 and a wide variety of the Stator 330 slots and winding configurations to correspond to the specific desired performance characteristics of the Internally Gimballed Integrated Precession Motor(s) 200. These Magnets 340 can be rare earth Magnets 340 such as neodymium iron boron (NdFeB), samarium cobalt (SmCo), alnico, and ceramic or ferrite magnets. This Internally Gimballed Integrated Precession Motor(s) 200 can also be powered by induction coils instead of using rare earth Magnets 340. This assembly utilizes a Stator 330 which is formed of multiple layers of silicon steel. The Stator 330 in this preferred embodiment is by way of example but not limited to a 15 spoke Stator 330 design which corresponds with the 14 individual Magnets 340. For clarity, the wire winding pattern of the Stator 330 and the electrical connections of the Internally Gimballed Integrated Precession Motor(s) 200 are not shown. In this preferred embodiment the illustration shows; the Bearings 230, the Dielectric Insulating Gaskets 390, the Washers 360, the Pivot Tube Spring(s) 290, the Stator Circuit Board 350. the Micro Bearing(s)/Bushing(s) 260, the Set Screw(s) 400, the Screw(s) 220, and the internal Pivot Tube 270 which is the core of the entire assembly. This assembly is mounted onto the Support Tube 1260 which is not shown in this view. The Stator Circuit Board 350 is a space saving printed circuit which allows complicated wire connections to be easily and quickly attached to it. The Bearings 230 in this application can be metal bearings, ceramic bearings, hybrid, deep groove ball bearings, angular bearings, thrust bearings, spherical roller bearings, cylindrical roller bearings, tapered roller bearings, needle roller bearings, plastic bearings, glass bearings, air bearings, fluid bearings, air foil bearings, or magnetic bearings, or any other types of bearings yet to be developed The Stator Circuit Board 350 is positioned between the wiring of the Stator 330 and the external connection to the external Motor Control Circuit Board 730 which is positioned outside the Internally Gimballed Integrated Precession Motor(s) 200 and is not shown in this view. This preferred embodiment of this Internally Gimballed Integrated Precession Motor(s) 200 is by way of example, but not limited to; as shown as a three phase motor with rare earth Magnets 340.

Figure 27:
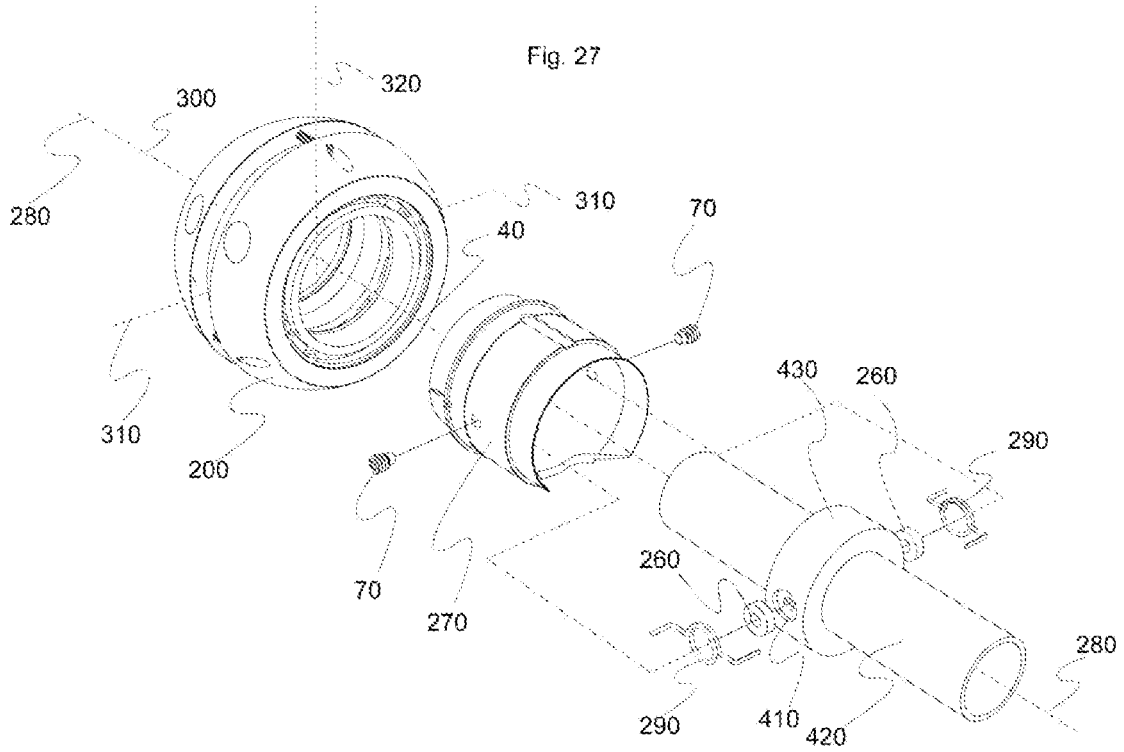
FIG. 27 is an illustration by way of example but not limited to this preferred embodiment showing; an exploded view of an Internally Gimballed Integrated Precession Motor(s) in relationship to a Generic Support Tube which it is to be assembled onto.

FIG. 27 is an illustration by way of example but not limited to this preferred embodiment showing; an exploded view of an Internally Gimballed Integrated Precession Motor(s) 200 in relationship to a Generic Support Tube 420 which it is to be assembled onto. The assembly will be done along the Center Line of Assembly 280. In this drawing the Generic Support Tube 420 has a single Raised Section(s) of the Support Tube 430 with two Micro Bearing(s)/Bushing(s) Pockets 410 machined into it to support two Micro Bearing (s)/Bushing(s) 260 for mounting a single Internally Gimballed Integrated Precession Motor(s) 200. The Gimbal Screw(s) 70 secures the Pivot Tube 270 to the Generic Support Tube 420. The Raised Section(s) of the Support Tube 430 are smaller in diameter than the inside diameter of the Internally Gimballed Integrated Precession Motor(s) 200 and the inside diameter of the Pivot Tube 270 of the Internally Gimballed Integrated Precession Motor(s) 200. It is this difference in diameter between the Generic Support Tube 420 outside diameter and the inside diameter of the Pivot Tube 270 that gives the ability to pass connection wires into the Internally Gimballed Integrated Precession Motor(s) 200 and for the Internally Gimballed Integrated Precession Motor(s) 200 to freely pivot on the Gimbal Pivot Axes 30. The Generic Support Tube 420 can be made hollow or solid depending on the placement application. The Generic Support Tube 420 can have a single or multiple Internally Gimballed Integrated Precession Motor(s) 200 mountings depending on the number of Raised Section(s) of the Support Tube 430. By way of example but not limited to this preferred embodiment of the Raised Section(s) of the Support Tube 430, the machining detail can be simply circular or made more complex with the machining of grooves or channels or different shapes creating more clearance for either the connection wires of the Internally Gimballed Integrated Precession Motor(s) 200 on the different Gimbal Pivot Axis 30. Also shown in the illustration is a designation for the Roll Axis 300, the Yaw Axis 320 and the Pitch Axis 310. The Roll Axis 300 is also the Rotor Rotation Axis 40 and the Center Line of Assembly 280 of the Internally Gimballed Integrated Precession Motor(s) 200. In this illustration the Pitch Axis 310 is shown sharing the same axis as that of the Micro Bearing(s)/Bushing(s) 260 and the Gimbal Pivot Axis 30 which the Internally Gimballed Integrated Precession Motor(s) 200 is designed to allow controlled Precession on when a force is applied to and resisted on the Yaw Axis 320. While for demonstration in this view, a single Internally Gimballed Integrated Precession Motor(s) 200 is mounted on a single Generic Support Tube 420 multiples of the Internally Gimballed Integrated Precession Motor(s) 200 may be mounted on a Generic Support Tube 420 and placed in different orientations and directions whether parallel or not, to create different performance features. In other words, the Internally Gimballed Integrated Precession Motor(s) 200 or its Generic Support Tube 420 does not need to necessarily be used in multiples or be parallel or have any specific placement requirements with each other to function. This motor is allowed to pivot on its Gimbal Pivot Axis 30 significantly, but is not able to pivot a full 360 degrees due to the necessary support structure which performs a mounting function and also permits external wiring to come inside the assembly and power the motor. This Internally Gimballed Integrated Precession Motor(s) 200 has an internal Pivot Tube Spring(s) 290 to allow the motor to freely pivot on the Gimbal Pivot Axis 30 while softening the ending of precession when the motor can no longer pivot. This is not a real concern though, since the function of this Internally Gimballed Integrated Precession Motor(s) 200 is to fine tune the aiming of a Firearm 600 based on a limited number of degrees of function, and the Pivot Tube Spring(s) 290 smooths this function.

Figure 28:
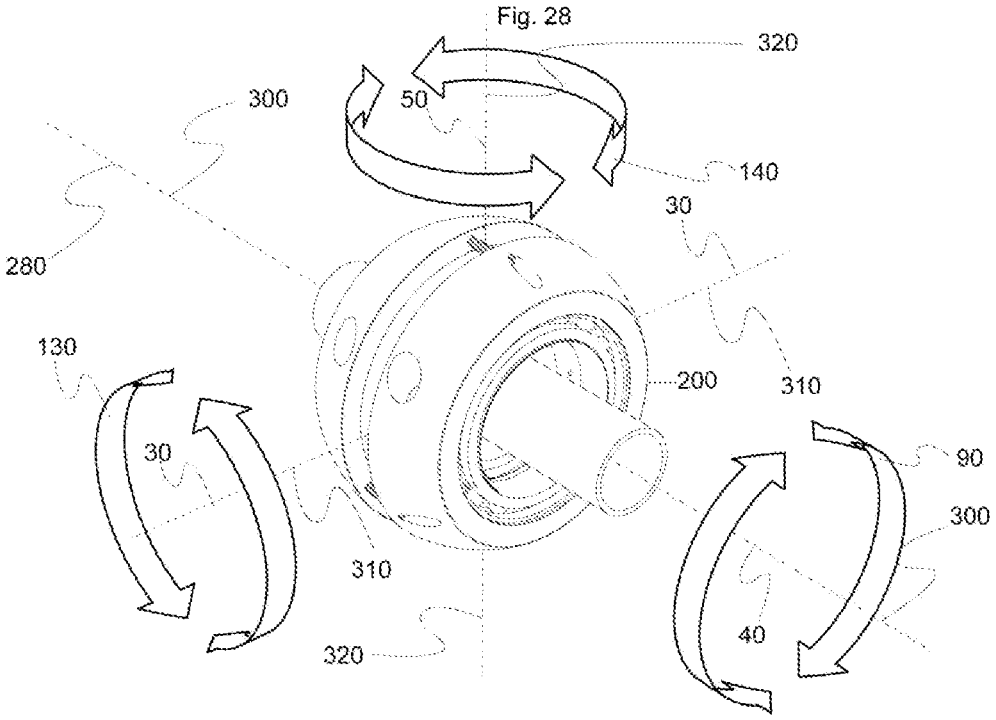
FIG. 28 is an illustration by way of example but not limited to this preferred embodiment showing; a single Internally Gimballed Integrated Precession Motor(s) after it has been assembled directly onto the Generic Support Tube. This illustration also shows the associated Pitch Axis, the Roll Axis, and the Yaw Axis of the assembly.

FIG. 28 is an illustration by way of example but not limited to this preferred embodiment showing; a single Internally Gimballed Integrated Precession Motor(s) 200 after it has been assembled directly onto the Generic Support Tube 420. This illustration also shows the associated Pitch Axis 310, the Roll Axis 300, and the Yaw Axis 320 of the assembly. The illustration also shows the associated Gimbal Pivot Axis 30, the Rotor Rotation Axis 40, the Stabilization Axis 50, and the Center Line of Assembly 280. It also shows the associated Gimbal Rotation Arrows 130, the Rotor Rotation Arrows 90, and the Stabilization Rotation Axis Arrows 140.

Figure 29:
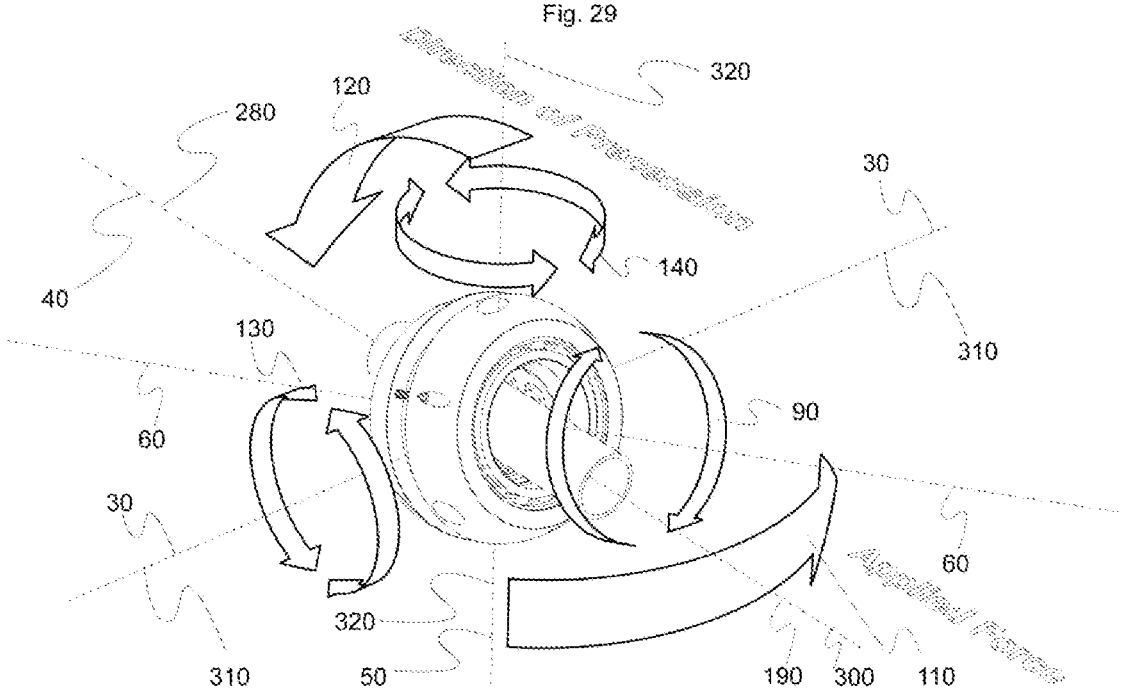
FIG. 29 is an illustration by way of example but not limited to this preferred embodiment showing; a single Internally Gimballed Integrated Precession Motor(s) 200 after it has been assembled directly onto the Generic Support Tube and the direction of the spinning Rotor/Mass rotation as well as the Gimbal Pivot Axis and the resulting Precession when an Applied External Force is applied. This shows what happens when the orientation of the Generic Support Tube is changed.

FIG. 29 is an illustration by way of example but not limited to this preferred embodiment showing; a single Internally Gimballed Integrated Precession Motor(s) 200 after it has been assembled directly onto the Generic Support Tube 420 around the Center Line of Assembly 280. This illustration shows the designed rotation of the Internally Gimballed Integrated Precession Motor(s) 200 as being clockwise while being energized. It can be run in either direction, but for this example, it is assumed as rotating in a clockwise direction. Depending on the wiring connections of the Internally Gimballed Integrated Precession Motor(s) 200, it will rotate in either of clockwise or counter-clockwise directions around the Rotor Rotation Axis 40 with similar results. In this illustration the natural axis of rotation of the Internally Gimballed Integrated Precession Motor(s) 200 shares the same rotational axis as the Center Line of Assembly 280, the Original Rotor Rotation Axis 190 and the Roll Axis 300. When an Applied External Force 110 in the direction of the arrow along the Yaw Axis 320 and the Stabilization Axis 50 is applied it causes an immediate Precession Response 120 in the direction of the arrow along the Pitch Axis 310 and Gimbal Axis 30, causing an immediate resistance to orientation change in the Yaw Axis 320 and Stabilization Axis 50. The Rotor Rotation Arrows 90 show the Internally Gimballed Integrated Precession Motor(s) 200 position after the Precession Response 120. This immediate Precession Response 120 is proportional to the Applied External Force 110 applied to the Yaw Axis 320 and Stabilization Axis 50. Due to this Applied External Force 110 the Internally Gimballed Integrated Precession Motor(s) 200 has a Precession Response 120 as shown by the Gimbal Rotation Arrows 130 to its Modified Rotor Axis due to Precession 60. If there is no Applied External Force 110 to the Yaw Axis 320 and Stabilization Axis 50 of the Internally Gimballed Integrated Precession Motor(s) 200, there is no Precession Response 120. This Precession Response 120 is the key to this stabilization device as shown in the resistance and push back along the Stabilization Rotation Arrows 140.

Figure 30:
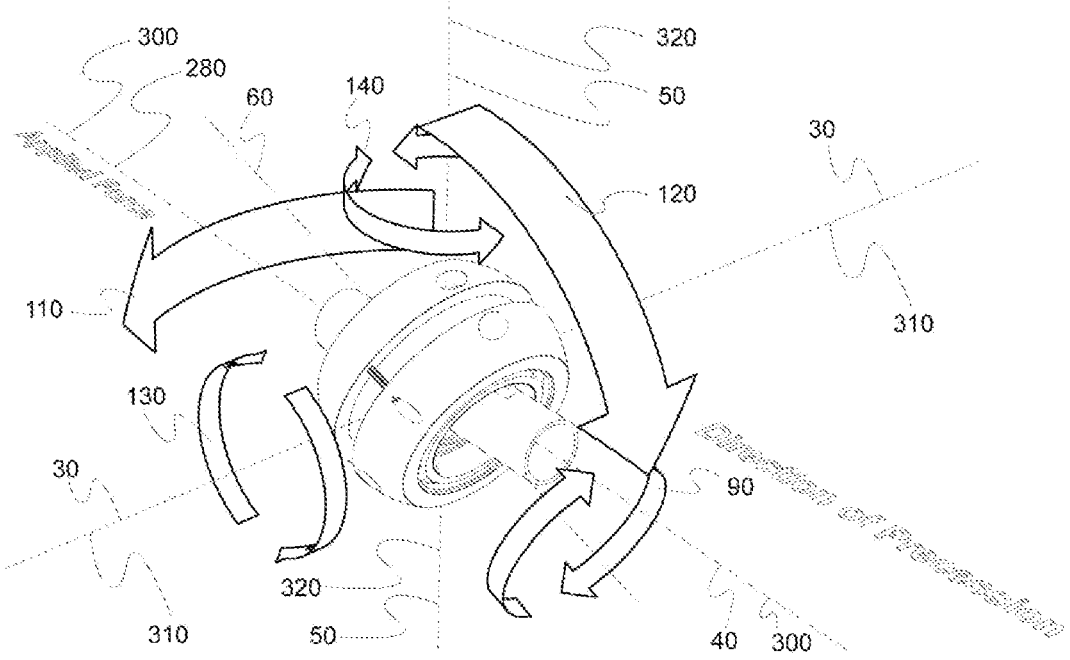
FIG. 30 is an illustration by way of example but not limited to this preferred embodiment showing; the same illustration as FIG. 29 including the clockwise rotation of the Internally Gimballed Integrated Precession Motor(s). The only difference in this drawing is that the Applied External Force comes from the opposite direction and the subsequent reversing of the Precession Force.

FIG. 30 is an illustration by way of example but not limited to this preferred embodiment showing; the same illustration as FIG. 29 including the clockwise rotation of the Internally Gimballed Integrated Precession Motor(s) 200. The only difference in this drawing is that the Applied External Force 110 comes from the opposite direction around the Yaw Axis 320 and Stabilization Axis 50 When the Applied External Force 110 is reversed in direction the Gimbal Rotation Arrows 130 are reversed. The Precession Response 120 arrows are reversed, while the direction of the Rotor Rotation Arrows 90 are not reversed. All of this creates a reversal in the Stabilization Rotation Arrows 140 direction, providing an immediate resistance directly and proportionally against the Applied External Force 110. If there is no Applied External Force 110 to the Yaw Axis 320 and Stabilization Axis 50 of the Internally Gimballed Integrated Precession Motor(s) 200, there is no Precession. This Precession Response 120 is the key to this stabilization device as shown in the resistance and push back along the Stabilization Rotation Arrows 140.

Figure 31:
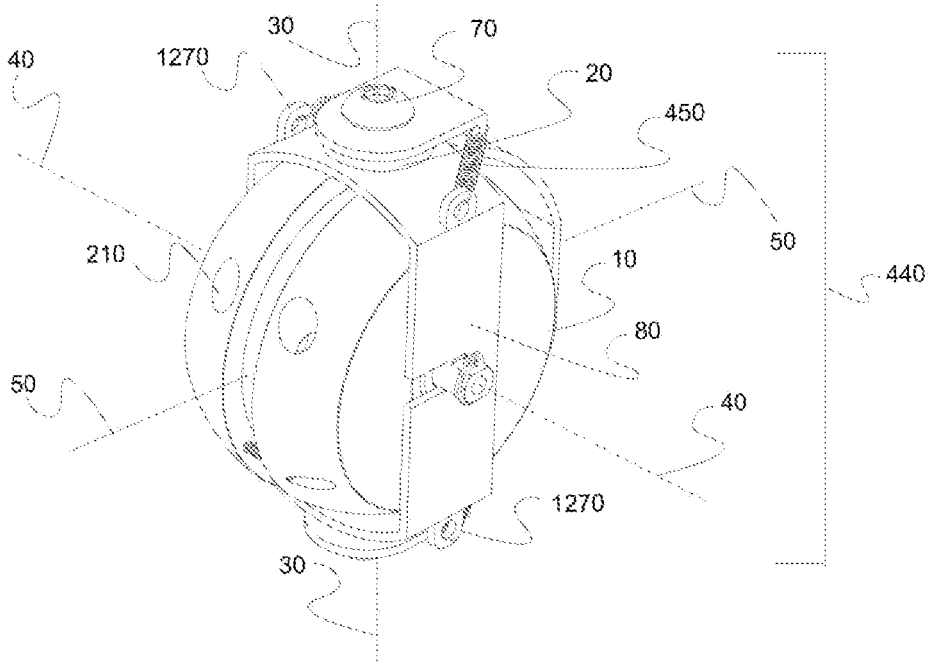
FIG. 31 is an illustration by way of example but not limited to this preferred embodiment showing; another in the Gimballed Precession Motor(s) category. This is an Externally Gimballed Integrated Precession Motor(s) and is designed to take advantage of the above illustrated Precession principles.

FIG. 31 is an illustration by way of example but not limited to this preferred embodiment showing; another in the Gimballed Precession Motor(s) 1600 category. This is an Externally Gimballed Integrated Precession Motor(s) 440 and is designed to take advantage of the above illustrated Precession principles. One or more of these motors may be incorporated into the different variations of the Gimballed Precession Motor Stabilizer(s) 1600. The Rotor/Mass(s) 10 is allowed to pivot on its Gimbal Pivot Axis 30 and it's Gimbal Bearing(s) 20 held in position by the Gimbal Screw(s) 70 but is not able to pivot a full 360 degrees due to the necessary support structure which performs a mounting function and also permits external wiring to come inside the assembly and power the motor. This Externally Gimballed Integrated Precession Motor(s) 440 is of a similar construction as the Internally Gimballed Integrated Precession Motor(s) 200 and also has Vent Hole(s) 210 to cool the unit. The main difference is that this motor has external Spring(s) 450 which mount to the Frame Hooks for Spring(s) 1270 on the Frame 80 to allow the motor to freely pivot on the Gimbal Pivot Axis 30 and soften the ending of precession when the motor can no longer pivot. This is not a real concern though, since the function of this Externally Gimballed Integrated Precession Motor(s) 440 is to fine tune the aiming of a Firearm 600 based on a limited number of degrees of function, and the external Spring(s) 450 smooths this function. This drawing shows the Rotor Rotation Axis 40 as well as the Stabilization Axis 50 and the Gimbal Axis 30.

Figure 32:
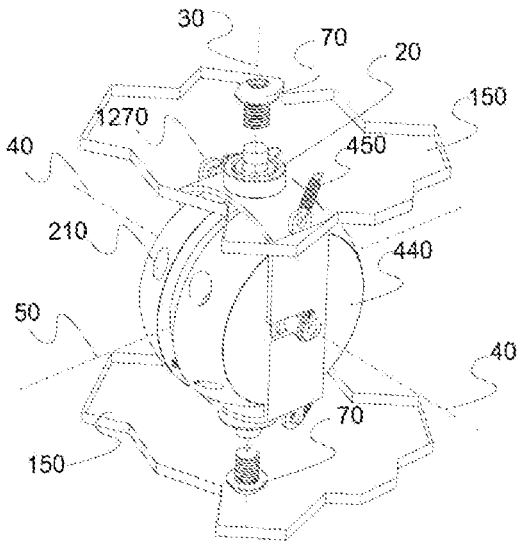
FIG. 32 is an illustration by way of example but not limited to this preferred embodiment showing; an Externally Gimballed Integrated Precession Motor(s) and a way to attach it to the Support Structure.

FIG. 32 is an illustration by way of example but not limited to this preferred embodiment showing; an Externally Gimballed Integrated Precession Motor(s) 440 and a way to attach it to the Support Structure 150. When the Externally Gimballed Integrated Precession Motor(s) 440 is attached to the Supporting Structure 150 and the Gimbal Pivot Axis 30 is perpendicular. To the Supporting Structure 150, no Optional Auxiliary Attachment Frame 100 is needed. In this case, it can be attached to the Support Structure 150 using the Gimbal Screw(s) 70 going directly into the Gimbal Bearing(s)/Bushing(s) 20. Auxiliary Frame Hooks for Spring(s) 1270 are incorporated into the Frame 80 and either the Support Structure 150, or the Optional Auxiliary Attachment Frame 100 (shown in FIG. 33) along with Spring(s) 450, and are used to attach to the Externally Gimballed Integrated Precession Motor(s) 440 pivot on the Gimbal Pivot Axis 30. These Spring(s) 1270 are used to soften the impact when the Externally Gimballed Integrated Precession Motor(s) 440 hits the end of its rotation range on the Gimbal Pivot Axis 30. These Springs(s) 450 also return the Externally Gimballed Integrated Precession Motor(s) 440 to its center position when reactions to an Applied External Force 110 have ceased. This drawing shows the Rotor Rotation Axis 40 as well as the Stabilization Axis 50 and the Gimbal Axis 30.

Figure 33:
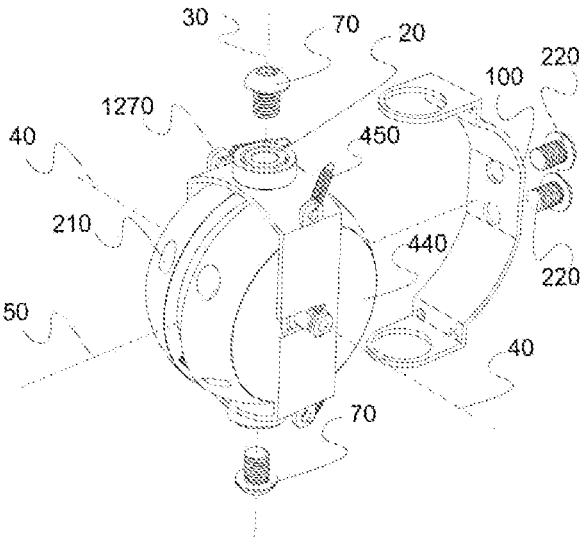
FIG. 33 is an illustration by way of example but not limited to this preferred embodiment showing; the Externally Gimballed Integrated Precession Motor(s)" with a different Optional Auxiliary attachment Frame to allow placement in positions which are aligned with its Gimbal Pivot Axis or to allow placement with another enclosure face which is non-parallel with the Gimbal Pivot Axis by using a secondary frame.

FIG. 33 is an illustration by way of example but not limited to this preferred embodiment showing; an Externally Gimballed Integrated Precession Motor(s) 440 and its attachment to the Optional Auxiliary Attachment Frame 100. If there is not a way of attaching the device to a surface which is perpendicular to the Gimbal Axis 30, this is a possible method of attachment. This frame attaches to the Gimbal/Bearing(s) 20 using Gimbal Screw(s) 70 allowing the Externally Gimballed Integrated Precession Motor(s) 440 to freely pivot. The Optional Auxiliary Attachment Frame 100 is also attached to the motor with Spring(s) 450 which are also attached to the Frame Hooks for Spring(s) 1270. These springs allow the Externally Gimballed Integrated Precession Motor(s) 440 to return to center when the External Applied Force 110 is removed.

Figure 34:
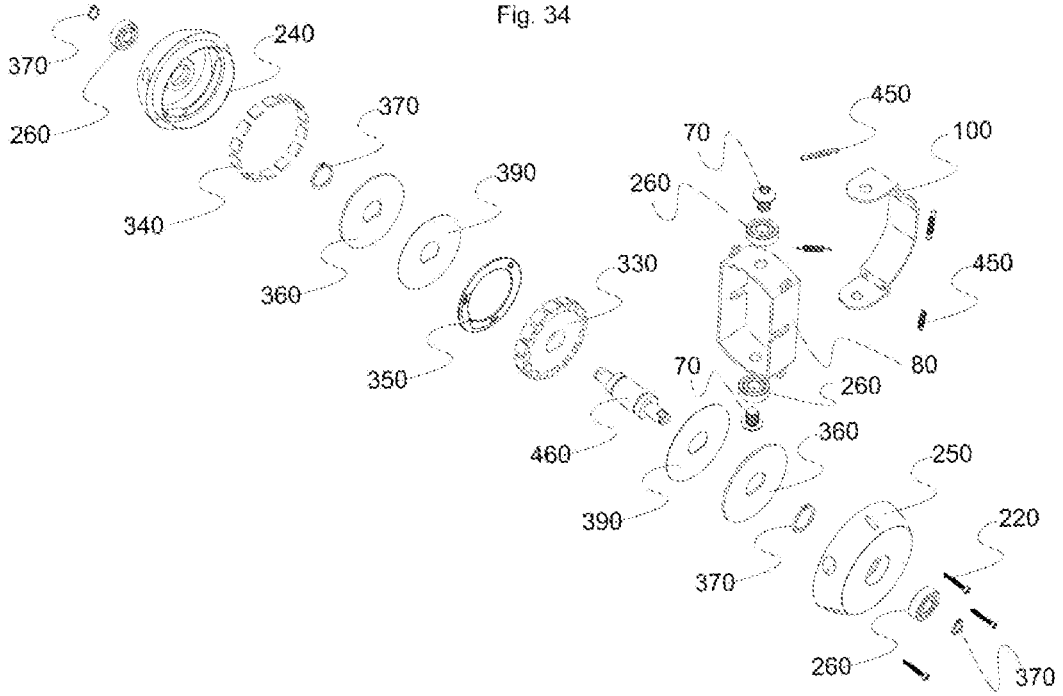
FIG. 34 is an illustration by way of example but not limited to this preferred embodiment showing; and exploded view of the Externally Gimballed Integrated Precession Motor(s).

FIG. 34 is an illustration by way of example but not limited to this preferred embodiment showing; and exploded view of the Externally Gimballed Integrated Precession Motor(s) 440. In this view are drawings of; Snap Spring(s) 370, Micro Bearing(s)/Bushing(s) 260, a Rotor Half A 240, Magnet(s) 340, Washer(s) 360, Dielectric Insulating Washer(s) 390, a Stator Circuit Board 350, Stator 330, a Hollow Motor Shaft for Connecting Wires from the Outside to the Inside 460, a Rotor Half B 250, Screw(s) 220, Gimbal Screw(s) 70, a Frame 80, Spring(s) 450, and an Optional Auxiliary Attachment Frame 100.

Figure 35:
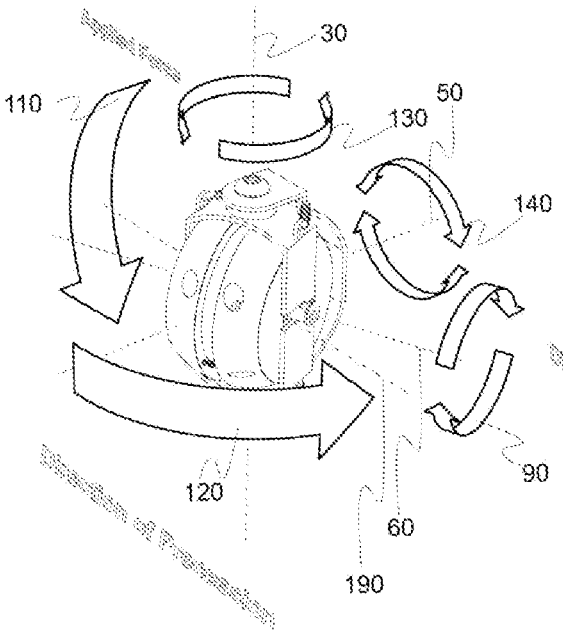
FIG. 35 is an illustration by way of example but not limited to this preferred embodiment showing; an Externally Gimballed Integrated Precession Motor(s) and the Precession Response when an Applied External Force is introduced.

FIG. 35 is an illustration by way of example but not limited to this preferred embodiment showing; an Externally Gimballed Integrated Precession Motor(s) 440 and the Precession Response 120 when an Applied External Force 110 is introduced. This illustration shows this assembly as though it were attached to an Optional Auxiliary Attachment Frame 100. The illustration shows the associated Gimbal Pivot Axis 30 and the Stabilization Axis 50 along with the associated Gimbal Rotation Arrows 130, the Rotor Rotation Arrows 90, and the Stabilization Rotation Arrows 140. It also shows the Modified Rotor Axis due to Precession 60 and the Original Rotor Rotation Axis 190.

Figure 36:
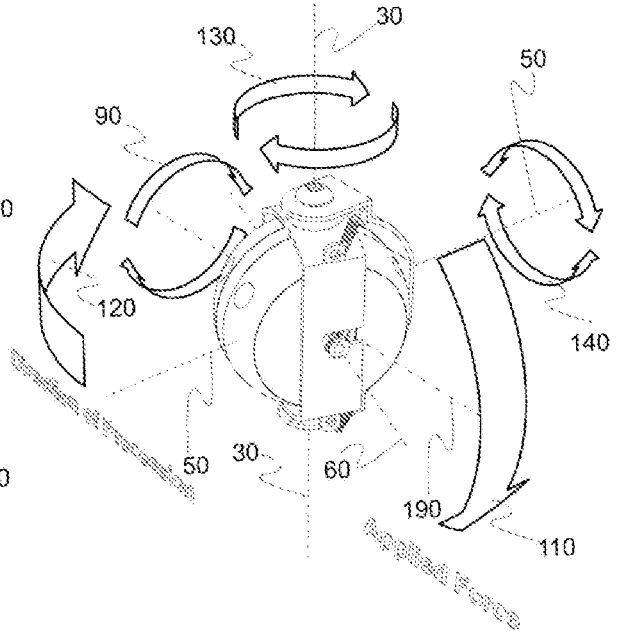
FIG. 36 is an illustration by way of example but not limited to this preferred embodiment showing; an Externally Gimballed Integrated Precession Motor(s) and the Precession Response when the Applied External Force is reversed in direction. Because of this reversal, the direction of the Gimbal Rotation Arrows are reversed.

FIG. 36 is an illustration by way of example but not limited to this preferred embodiment showing; an Externally Gimballed Integrated Precession Motor(s) 440 and the Precession Response 120 when the Applied External Force 110 is reversed in direction. Because of this reversal, the direction of the Gimbal Rotation Arrows 130 are reversed. The Precession Response 120 arrows are reversed. The direction of the Rotor Rotation Arrows 90 are not reversed. All of this creates a reversal in the Stabilization Rotation Arrows 140 direction, providing an immediate resistance directly and proportionally against the Applied External Force 110.

This illustration shows this assembly as though it were attached to an Optional Auxiliary Attachment Frame 100. The illustration shows the associated Gimbal Pivot Axis 30 and the Stabilization Axis 50 along with the associated Gimbal Rotation Arrows 130, the Rotor Rotation Arrows 90, and the Stabilization Rotation Arrows 140. It also shows the Modified Rotor Axis due to Precession 60 and the Original Rotor Rotation Axis 190.

If there is no Applied External Force 110 applied to the Stabilization Axis 50 of the Externally Gimballed Integrated Precession Motor(s) 440, there is no Precession. This Precession Response 120 is the key to this stabilization device as shown in the resistance and push back along the Stabilization Rotation Arrows 140.

Figure 37:
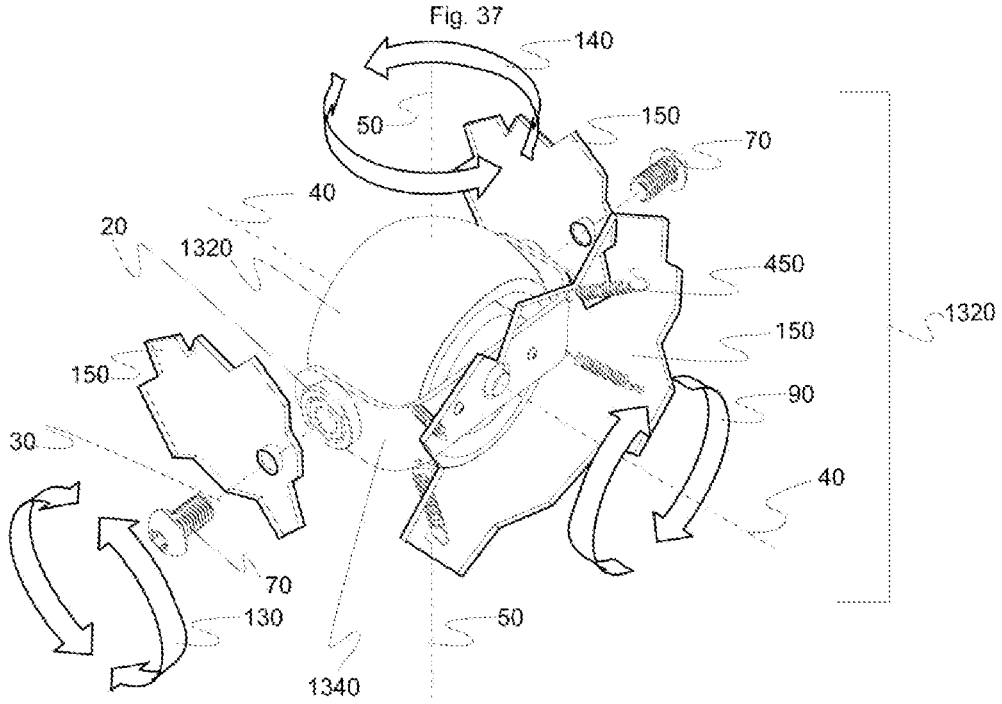
FIG. 37 is an illustration by way of example but not limited to this preferred embodiment showing; another motor in the Gimballed Precession Motor(s) category. This configuration is known as the Externally Gimballed Non-Integrated Precession Motor(s). In this view the Externally Gimballed Non-Integrated Precession Motor(s) is shown being attached to a Support Structure along with the attached Spring(s) with the accompanying Gimbal Bearing(s)/Bushing(s) and is held in place with the Gimbal Screw(s) and is attached to the External Frame.

FIG. 37 is an illustration by way of example but not limited to this preferred embodiment showing; another motor in the Gimballed Precession Motor(s) 1600 category. This configuration is known as the Externally Gimballed Non-Integrated Precession Motor(s) 1320. In this view the Externally Gimballed Non-Integrated Precession Motor(s) 1320 is shown being attached to a Support Structure 150 along with the attached Spring(s) 450 with the accompanying Gimbal Bearing(s)/Bushing(s) 20 and is held in place with the Gimbal Screw(s) 70 and is attached to the External Frame 1340. The illustration also shows the associated Gimbal Pivot Axis 30, the Rotor Rotation Axis 40, and the Stabilization Axis 50 along with the associated Gimbal Rotation Arrows 130, the Rotor Rotation Arrows 90, and the Stabilization Rotation Arrows 140.

Figure 38:
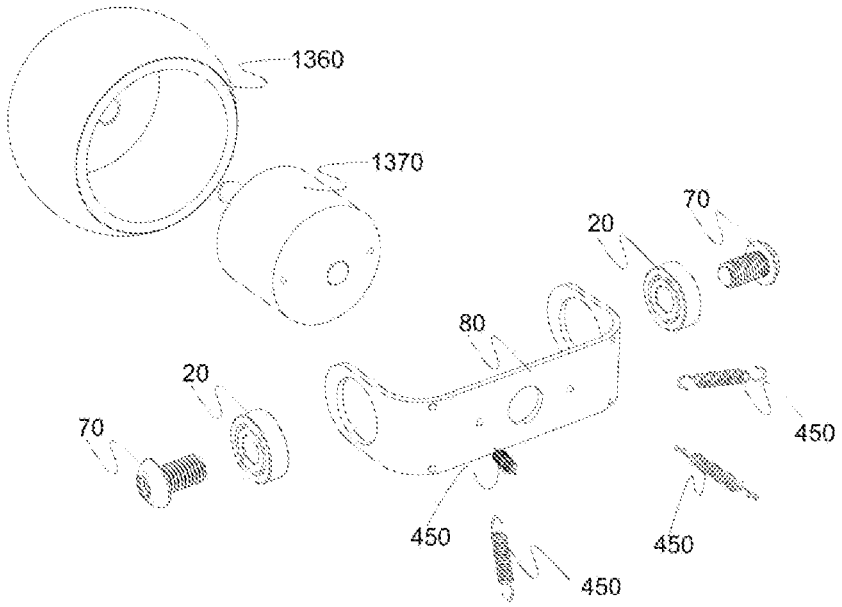
FIG. 38 is an illustration by way of example but not limited to this preferred embodiment showing; an exploded view of the Externally Gimballed Non-Integrated Precession Motor(s). In this view, the Non-Integrated Rotor(s) is shown as it would attach to the Non-Integrated Motor(s).

FIG. 38 is an illustration by way of example but not limited to this preferred embodiment showing; an exploded view of the Externally Gimballed Non-Integrated Precession Motor(s) 1320. In this view, the Non-Integrated Rotor(s) 1360 is shown as it would attach to the Non-Integrated Motor(s) 1370. This motor could be a commercially stock motor to use with this assembly. The Non-Integrated Rotor(s) 1360 may be made of a wide variety of materials by way of example but not limited to; aluminum, steel, brass, beryllium copper, tungsten, or any other material which has significant relative mass. The Frame 80 is designed to connect the Gimbal Bearing(s)/Bushing(s) 20 with the Gimbal Screws 70 to an external Support Structure 150 (not shown in this view). The Spring(s) 450 are designed to attach to the Frame 80 and the external Support Structure 150 and provide a way of centering up the spinning Non-Integrated Rotor(s) 1360 to make it available to pivot in both directions when an Applied External Force 110 is applied.

Figure 39:
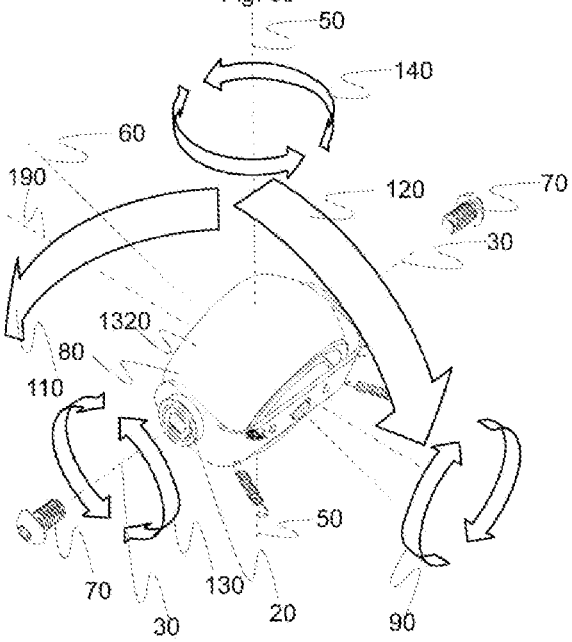
FIG. 39 is an illustration by way of example but not limited to this preferred embodiment showing; a Gimballed Precession Motor(s). This configuration is known as the Externally Gimballed Non-Integrated Precession Motor(s). In this view the Externally Gimballed Non-Integrated Precession Motor(s) is shown as though attached to an external Support Structure.

FIG. 39 is an illustration by way of example but not limited to this preferred embodiment showing; a Gimballed Precession Motor(s) 1590. This configuration is known as the Externally Gimballed Non-Integrated Precession Motor(s) 1320. In this view the Externally Gimballed Non-Integrated Precession Motor(s) 1320 is shown as though attached to an external Support Structure 150 (not shown in this view) with the accompanying Gimbal Bearing(s)/Bushing(s) 20 held in place with the Gimbal Screw(s) 70. The illustration also shows the associated Gimbal Pivot Axis 30, the Rotor Rotation Axis 40, and the Stabilization Axis 50 along with the associated Gimbal Rotation Arrows 130, the Rotor Rotation Arrows 90, and the Stabilization Rotation Arrows 140.

This illustration shows the Precession Response 120 when an Applied External Force 110 is introduced. It also shows the Modified Rotor Axis due to Precession 60 and the Original Rotor Rotation Axis 190.

Figure 40:
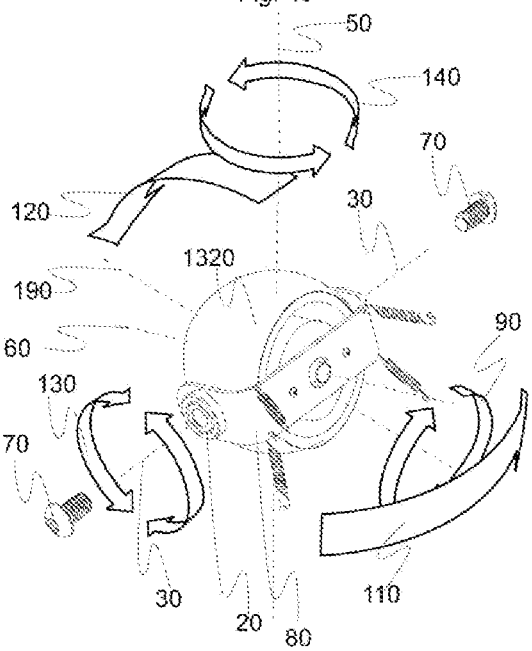
FIG. 40 is an illustration by way of example but not limited to this preferred embodiment showing; a Gimballed Precession Motor(s). This configuration is known as the Externally Gimballed Non-Integrated Precession Motor(s). In this view the Externally Gimballed Non-Integrated Precession Motor(s) is shown as though attached to an external Support Structure.

FIG. 40 is an illustration by way of example but not limited to this preferred embodiment showing; a Gimballed Precession Motor(s) 1590. This configuration is known as the Externally Gimballed Non-Integrated Precession Motor(s) 1320. In this view the Externally Gimballed Non-Integrated Precession Motor(s) 1320 is shown as though attached to an external Support Structure 150 (not shown in this view) with the accompanying Gimbal Bearing(s)/Bushing(s) 20 held in place with the Gimbal Screw(s) 70. The illustration also shows the associated Gimbal Pivot Axis 30, the Rotor Rotation Axis 40, and the Stabilization Axis 50 along with the associated Gimbal Rotation Arrows 130, the Rotor Rotation Arrows 90, and the Stabilization Rotation Arrows 140.

This illustration shows the Precession Response 120 when an Applied External Force 110 is reversed in direction.

It also shows the Modified Rotor Axis due to Precession 60 and the Original Rotor Rotation Axis 190.

Figure 41:
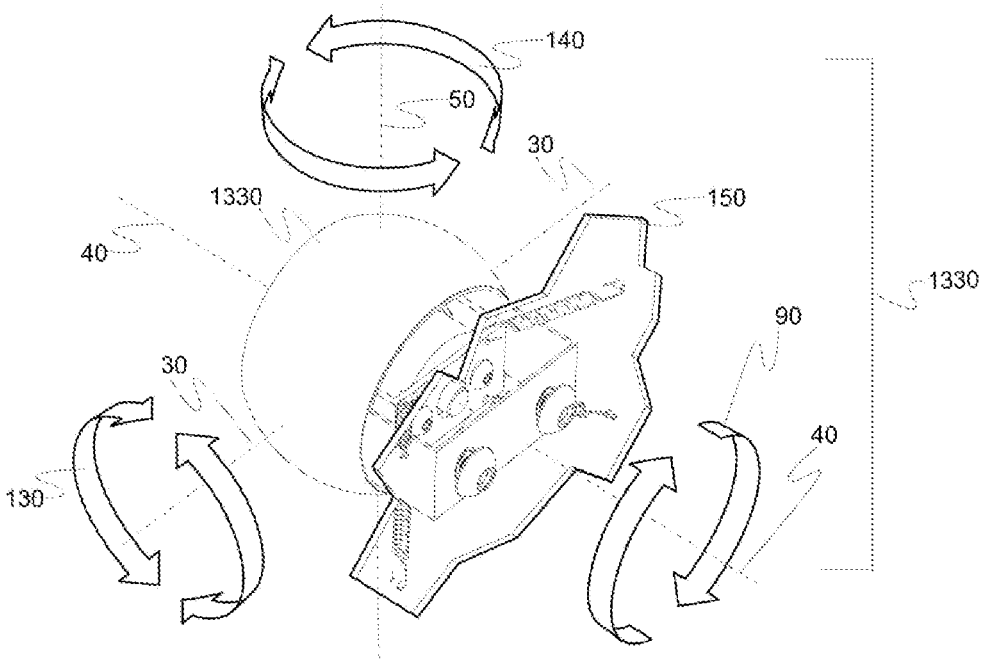
FIG. 41 is an illustration by way of example but not limited to this preferred embodiment showing; a Gimballed Precession Motor(s). This configuration is known as the Internally Gimballed Non-Integrated Precession Motor(s) is designed to take advantage of the above illustrated Precession principles.

FIG. 41 is an illustration by way of example but not limited to this preferred embodiment showing; a Gimballed Precession Motor(s) 1590. This configuration is known as the Internally Gimballed Non-Integrated Precession Motor(s) 1330 is designed to take advantage of the above illustrated Procession principles. One or more of these motors may be incorporated into the different positions for stabilization. This motor is allowed to pivot on its Gimbal Pivot Axis 30. This Internally Gimballed Non-Integrated Precession Motor(s) 1330 is of a similar construction as the Externally Gimballed Non-Integrated Precession Motor 1320, but the internal Frame 80 is attached by the Gimbal Bearing(s)/Bushing(s) 20 and the Gimbal Screw(s) 70 to an internal Secondary Mounting Frame 1380. The Non-Integrated Motor(s) 1370 is attached to the Frame 80 with Screws 220 allowing the two frames to pivot freely on the joint between the frames on the Gimbal Bearing(s)/Bushing(s) 20.

It has Spring(s) 450 to allow the motor to freely pivot on the Gimbal Pivot Axis 30 and soften the ending of precession when the motor can no longer pivot. This is not a real concern though, since the function of this Internally Gimballed Non-Integrated Precession Motor(s) 1330 is to fine tune the aiming of a Firearm 600 based on a limited number of degrees of function, and the external Spring(s) 450 smooths this function. The device is shown to be attached to a Support Structure 150. The illustration shows the associated Gimbal Pivot Axis 30, the Rotor Rotation Axis 40, and the Stabilization Axis 50 along with the associated Gimbal Rotation Arrows 130, the Rotor Rotation Arrows 90, and the Stabilization Rotation Arrows 140.

Figure 42:
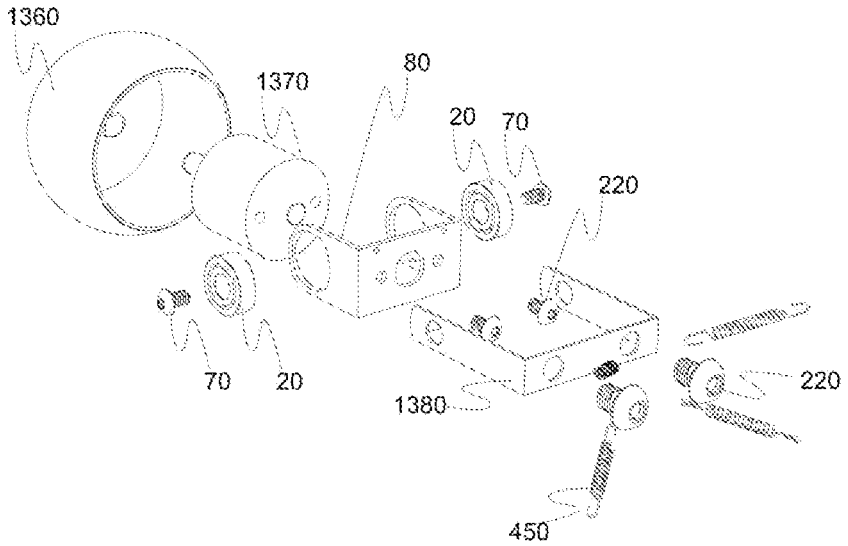
FIG. 42 is an illustration by way of example but not limited to this preferred embodiment showing; an exploded view of the Internally Gimballed Non-Integrated Precession Motor(s).

FIG. 42 is an illustration by way of example but not limited to this preferred embodiment showing; an exploded view of the Internally Gimballed Non-Integrated Precession Motor(s) 1330. One or more of these motors may be incorporated into the different variations of the Gimballed Precession Motor Stabilizer(s) 1600. This Internally Gimballed Non-Integrated Precession Motor(s) 1330 is of a similar construction as the Externally Gimballed Non-Integrated Precession Motor 1320, but the internal Frame 80 is attached by the Gimbal Bearing(s)/Bushing(s) 20 and the Gimbal Screw(s) 70 to an internal Secondary Mounting Frame 1380. The Non-Integrated Motor(s) 1370 is attached to the Frame 80 with Screws 220 allowing the two frames to pivot freely on the joint between the frames on the Gimbal Bearing(s)/Bushing(s) 20. This illustration shows the Non-Integrated Rotor(s) 1360, the Non-Integrated Motor(s) 1370, the Frame 80, the Gimbal Screw(s) 70, the Gimbal/Bearing(s) 20, the Screw(s) 220, the Secondary Mounting Frame 1380 and the 450 Spring(s) and how they are assembled.

Figure 43:
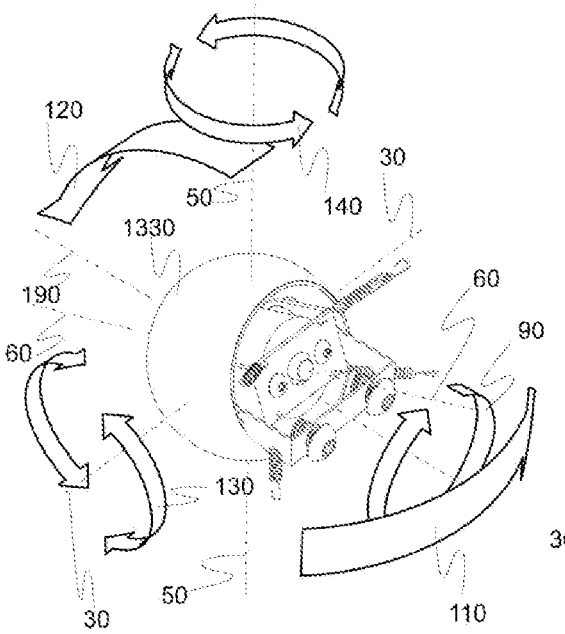
FIG. 43 is an illustration by way of example but not limited to this preferred embodiment showing; is a drawing of the Internally Gimballed Non-Integrated Precession Motor(s) and the direction of the spinning Rotor/Mass rotation as well as the Gimbal Pivot Axis and the resulting Precession when an Applied External Force is applied in one direction.

FIG. 43 is an illustration by way of example but not limited to this preferred embodiment showing; is a drawing of the Internally Gimballed Non-Integrated Precession Motor(s) 1330. The drawing shows the associated Gimbal Pivot Axis 30, the Rotor Rotation Axis 40, and the Stabilization Axis 50 along with the associated Gimbal Rotation Arrows 130, the Rotor Rotation Arrows 90, and the Stabilization Rotation Arrows 140. This illustration shows the Precession Response 120 when an Applied External Force 110 is introduced. It also shows the Modified Rotor Axis due to Precession 60 and the Original Rotor Rotation Axis 190.

Figure 44:
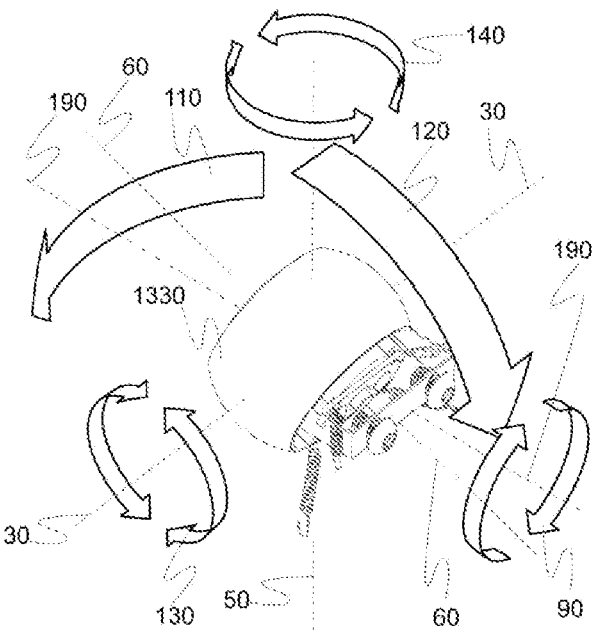
FIG. 44 is an illustration by way of example but not limited to this preferred embodiment showing; is a drawing of the Internally Gimballed Non-Integrated Precession Motor(s). The drawing shows the associated Gimbal Pivot Axis, the Rotor Rotation Axis, and the Stabilization Axis along with the associated Gimbal Rotation Arrows, the Rotor Rotation Arrows, and the Stabilization Rotation Arrows. This illustration shows the Precession Response when an Applied External Force is reversed in direction.

FIG. 44 is an illustration by way of example but not limited to this preferred embodiment showing; is a drawing of the Internally Gimballed Non-Integrated Precession Motor(s) 1330. The drawing shows the associated Gimbal Pivot Axis 30, the Rotor Rotation Axis 40, and the Stabilization Axis 50 along with the associated Gimbal Rotation Arrows 130, the Rotor Rotation Arrows 90, and the Stabilization Rotation Arrows 140. This illustration shows the Precession Response 120 when an Applied External Force 110 is reversed in direction. It also shows the Modified Rotor Axis due to Precession 60 and the Original Rotor Rotation Axis 190.

Figure 45:
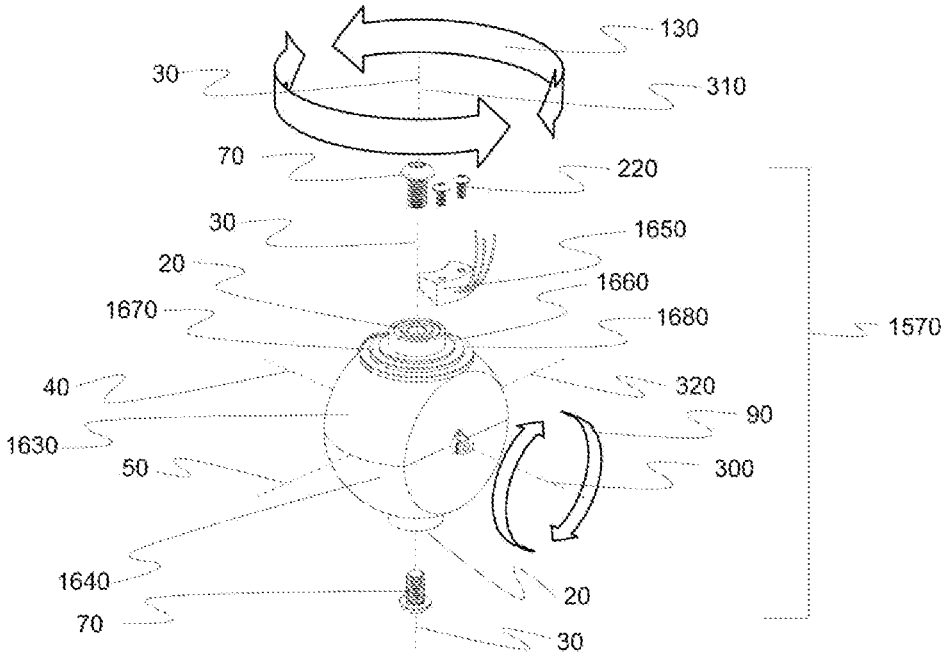
FIG. 45 is an illustration by way of example but not limited to this preferred embodiment showing; another in the Gimballed Precession Motor(s) category. This configuration is known as the 360-degree Gimballed Precession Motor(s) which allows no limitation on the gimbal rotation of the motor allowing 360 degrees of gimbal rotation.

FIG. 45 is an illustration by way of example but not limited to this preferred embodiment showing; another in the Gimballed Precession Motor(s) 1600 category. This configuration is known as the 360-degree Gimballed Precession Motor(s) 1570. In this configuration, the 360-degree Gimballed Precession Motor(s) 1570 has a very similar internal construction to the Externally Gimballed Integrated Precession Motor(s) 440 including the Hollow Motor Shaft for Connecting Wires from the Outside to the Inside 460 of the core. This variation is housed inside a Gimbal Axis Housing Half A 1630 and a Gimbal Axis Housing Half B 1640. On the top of the Gimbal Axis Housing Half A 1630 is a stepped portion which accepts the Commutation Ring A 1660, the Commutation Ring B 1670, and the Commutation Ring C 1680. Each of these rings are electrically isolated to allow the Commutator 1650 to make a separate electrical connection. The Commutator 1650 has Spring(s) 450 (not shown in this view) and Brushes 1690 (not shown in this view) inside to make these electrical connections while the assembly is allowed to have a slow 360-degree precession on the Gimbal Pivot Axis 30 with no end to the Gimbal Rotation Arrows 130. Since the Commutator 1650 permits 360-degree rotation, there is no limit to the Precession Response 120 when an Applied External Force 110 is introduced. The Commutator 1650 is held in place on the outside Support Structure 150 with Screw(s) 220. The Commutation Ring A 1660, Commutation Ring B 1670, and Commutation Ring C 1680 have an electrical connection with the Gimballed Precession Motor(s) 1590 inside the housing and enter the Gimballed Precession Motor(s) 1590 via the Hollow Motor Shaft for Connecting Wires from the Outside to the Inside 460. In this preferred embodiment, the device is allowed to have the internal Rotor/Mass 10 rotate as shown in the rotation arrows 90 while the complete assembly which is held in place with Gimbal Screw(s) 70 and Gimbal Bearing(s)/Bushing(s) 20 to an outside Support Structure 150 (not shown in this view) is allowed to pivot around the Gimbal Pivot Axis 30 and the Pitch Axis 310 as shown with the Gimbal Rotation Arrows 130. The advantage of this embodiment is that there is an unlimited precession range. It is able to continue to have precession for 360 degrees. The illustration shows the associated Gimbal Pivot Axis 30, the Rotor Rotation Axis 40, and the Stabilization Axis 50 along with the associated Roll Axis 300, Yaw Axis 320, and Pitch Axis 310.

Figure 46:
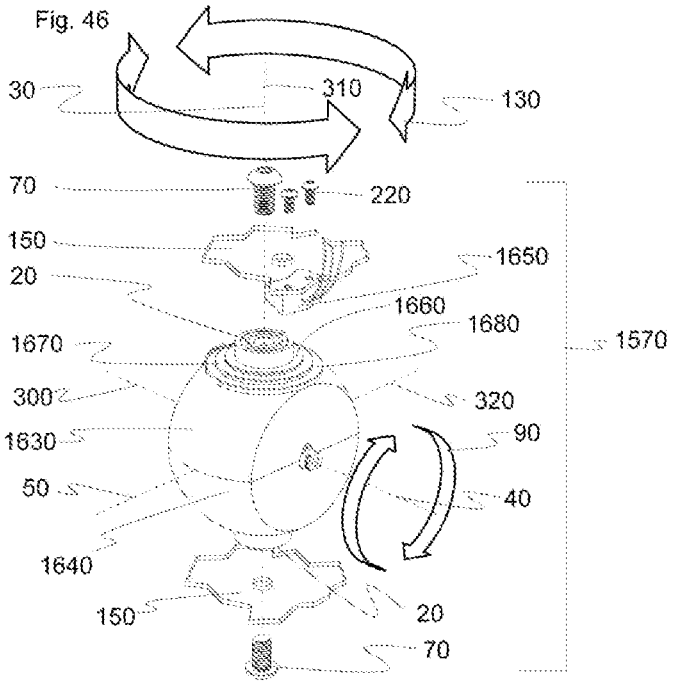
FIG. 46 is an illustration by way of example but not limited to this preferred embodiment showing; a partially exploded view of the 360-degree Gimballed Precession Motor(s). This illustration shows the assembly parts and how it can be attached to an external support structure.

FIG. 46 is an illustration by way of example but not limited to this preferred embodiment showing; a partially exploded view of the 360-degree Gimballed Precession Motor(s) 1570. This illustration shows the assembly parts; Screw(s) 220, Commutator 1650, Spring(s) 450, Commutator Brush(s) 1690, Gimbal/Bearing(s) 20, Commutation Ring A 1660, Commutation Ring B 1670, Commutation Ring B 1680, Gimbal Axis Housing Half A 1630, Gimballed Precession Motor(s) 1590, Gimbal Screw(s) 70, and Gimbal Axis Housing Half B 1640 on Gimbal Pivot Axis 30. This illustration also shows the Support Structure 150 this could be attached to. This illustration shows the Gimbal Pivot Axis 30, the Rotor Rotation Axis 40 and the Stabilization Axis 50, along with the Roll Axis 300, the Pitch Axis 310, and the Yaw Axis 320. The Gimbal Rotation Arrows 130, the Rotor Rotation Arrows 90 are also shown. This illustration also shows how it can attach to a Support Structure 150.

Figure 47:
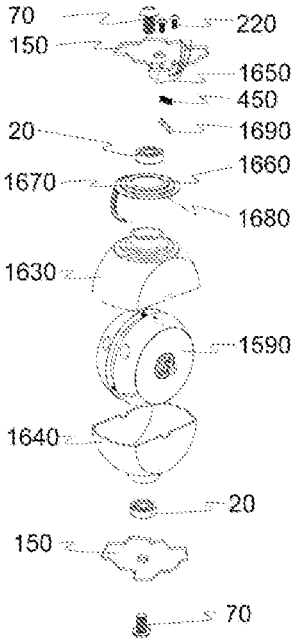
FIG. 47 is an illustration by way of example but not limited to this preferred embodiment showing; a fully exploded view of the 360-degree Gimballed Precession Motor(s).

FIG. 47 is an illustration by way of example but not limited to this preferred embodiment showing; a fully exploded view of the 360-degree Gimballed Precession Motor(s) 1570. This illustration shows the assembly parts; Screw(s) 220, Commutator 1650, Spring(s) 450, Commutator Brush(s) 1690, Gimbal/Bearing(s) 20, Commutation Ring A 1660, Commutation Ring B 1670, Commutation Ring B 1680, Gimbal Axis Housing Half A 1630, Gimballed Precession Motor(s) 1590, Gimbal Screw(s) 70, and the Gimbal Axis Housing Half B 1640 on the Gimbal Pivot Axis 30. This illustration also shows the Support Structure 150 which it could be attached to. This illustration shows the Gimbal Pivot Axis 30, the Rotor Rotation Axis 40 and the Stabilization Axis 50 along with the Roll Axis 300, the Pitch Axis 310, and the Yaw Axis 320. The Gimbal Rotation Arrows 130 and the Rotor Rotation Arrows 90 are also shown.

Figure 48:
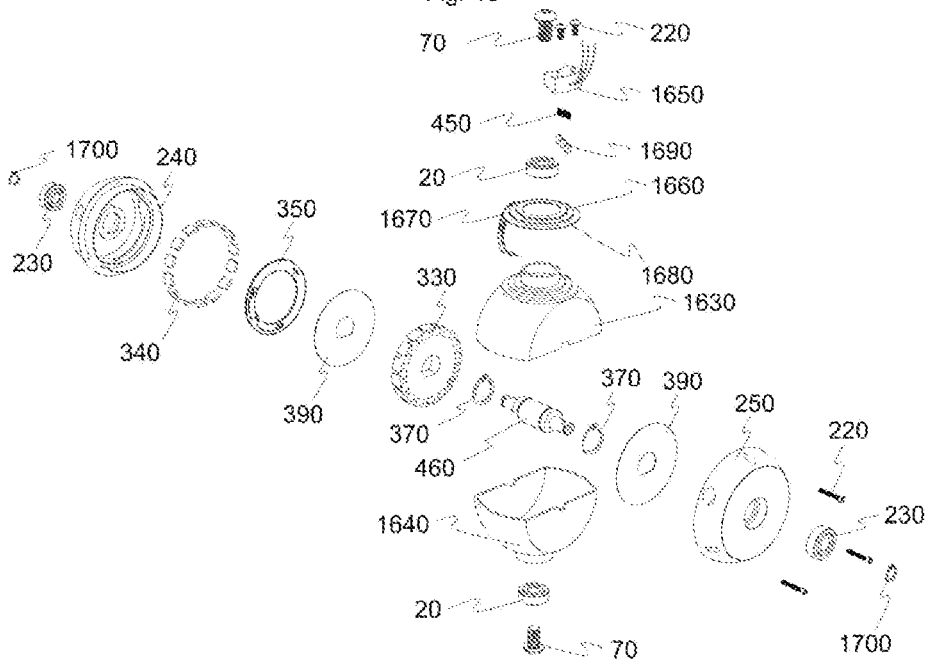
FIG. 48 is an illustration by way of example but not limited to this preferred embodiment showing; a fully exploded view of the 360-degree Gimballed Precession Motor(s).

FIG. 48 is an illustration by way of example but not limited to this preferred embodiment showing; a fully exploded view of the 360-degree Gimballed Precession Motor(s) 1570. This illustration shows the assembly parts; the Screw(s) 220, the Commutator 1650, the Spring(s) 450, the Commutator Brush(s) 1690, the Gimbal/Bearing(s) 20, the Commutation Ring A 1660, the Commutation Ring B 1670, the Commutation Ring B 1680, the Gimbal Axis Housing Half A 1630, the Gimballed Precession Motor(s) 1590, the Gimbal Screw(s) 70, and the Gimbal Axis Housing Half B 1640 on the Gimbal Pivot Axis 30. This illustration also shows the Hollow Motor Shaft for Connecting Wires from the Outside to the Inside 460, the Small Snap Ring(s) 1700, the Rotor Half A 240, the Magnet(s) 340, the Stator Circuit Board 350, the Dielectric Insulating Washer(s) 390, the Snap Spring(s) 370, the Stator 330, the Rotor Half B 250, and the Bearing(s) 230.

Figure 49:
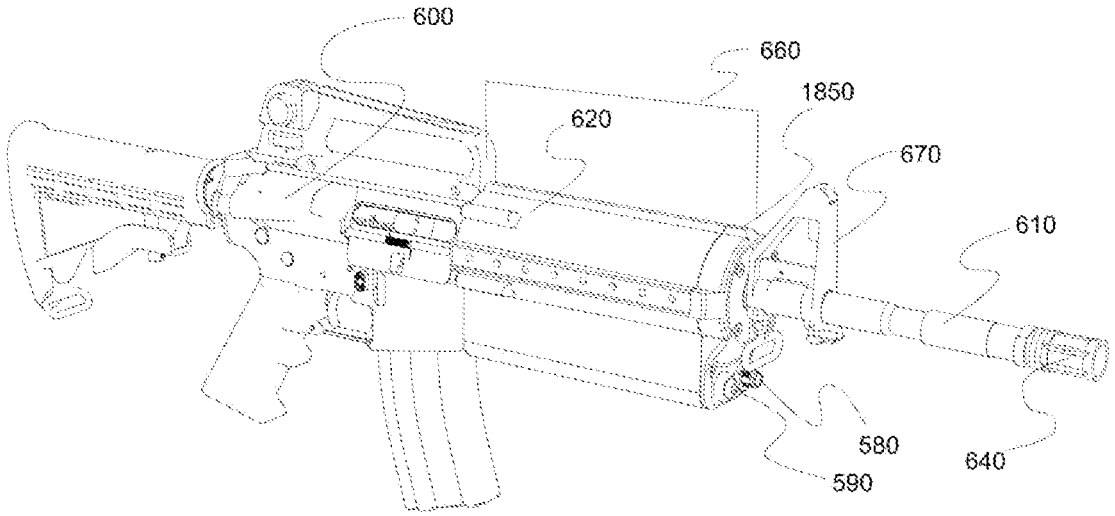
FIG. 49 is an illustration by way of example but not limited to this preferred embodiment showing; a Shortened Handguard Stabilizer Assembly.

FIG. 49 is an illustration by way of example but not limited to this preferred embodiment showing; a Shortened Handguard Stabilizer Assembly 660. In this example, one or more Internally Gimballed Integrated Precession Motor(s) 200 are put into the Handguard A Assembly 620 of a Firearm 600 such as but not limited to an AR-15, M16, or M4 type. This illustration shows the Shortened Handguard Stabilizer Assembly 660 which is made of the Handguard A Assembly 620 and the Handguard End Cap 1850 without the Handguard B Assembly 630 (not shown in this drawing). Also included in this view is the Barrel 610 which the assembly slides over. This view also shows the Flash Suppressor 640 and the Activation Button/Remote Activation Connector 590, the Charging Port 580, and the Front Sight and Gas Block Assembly 670.

Figure 50:
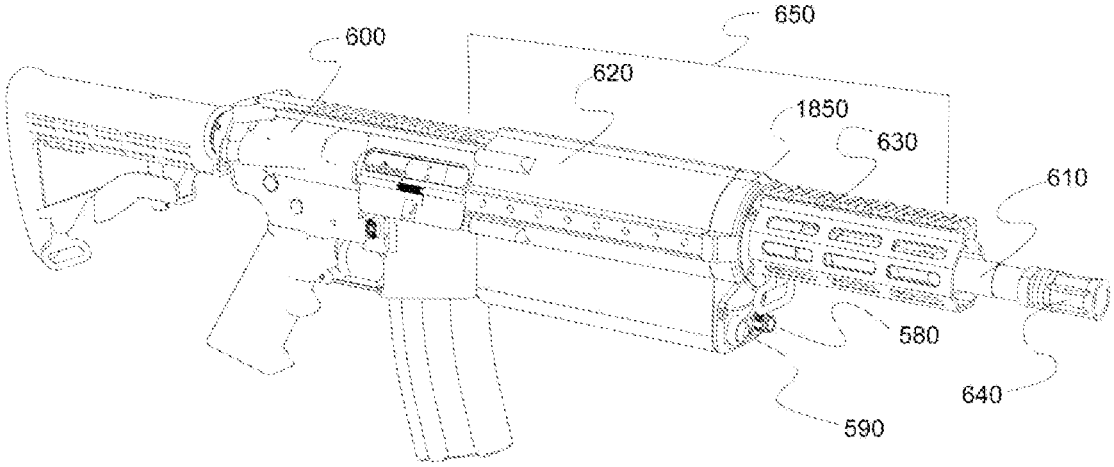
FIG. 50 is an illustration by way of example but not limited to this preferred embodiment showing; a Firearm with either a single or multiple Internally Gimballed Integrated Precession Motor(s) incorporated into a Full Handguard Stabilizer Assembly.

FIG. 50 is an illustration by way of example but not limited to this preferred embodiment showing; a Firearm 600 with either a single or multiple Internally Gimballed Integrated Precession Motor(s) 200 incorporated into a Full Handguard Stabilizer Assembly 650. In this drawing both Handguard A Assembly 620 and Handguard End Cap 1850 and Handguard B Assembly 630 are combined to form the Full Handguard Stabilizer Assembly 650. Also shown in this drawing is the Charging Port 580, the Activation Button/Remote Activation Connector 590, the Barrel 610, and the Flash Suppressor 640.

Figure 51:
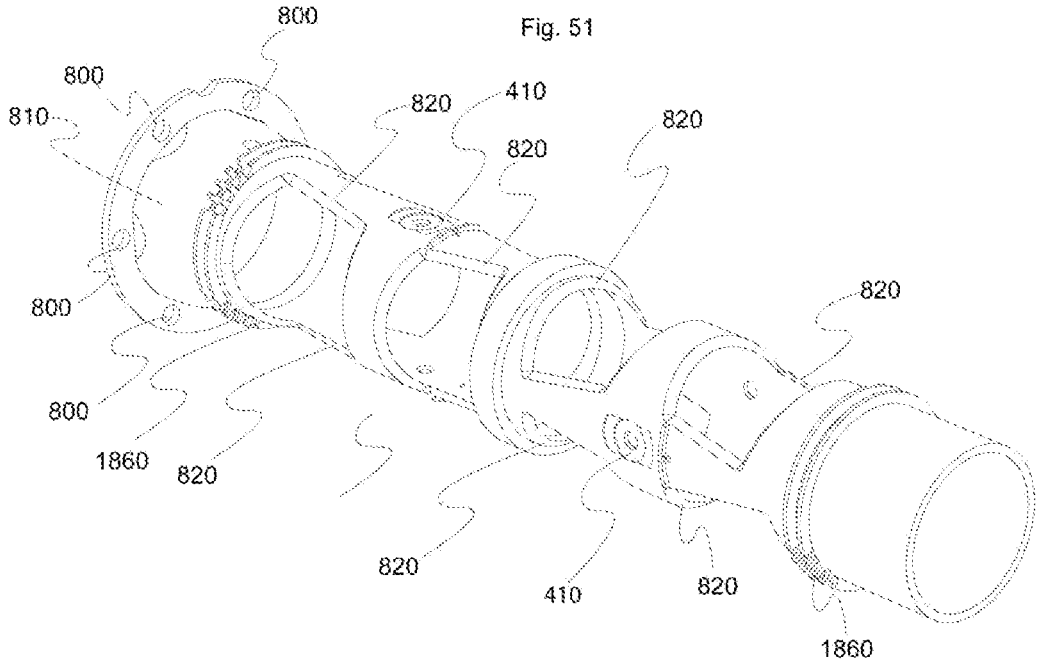
FIG. 51 is an illustration by way of example but not limited to this preferred embodiment showing; a Handguard Support Tube. The Handguard Support Tube(s) is shown having positions for one or more of the Internally Gimballed Integrated Precession Motor(s).

FIG. 51 is an illustration by way of example but not limited to this preferred embodiment showing; a Handguard Support Tube 810. The Handguard Support Tube(s) 810 is shown having positions for one or more of the Internally Gimballed Integrated Precession Motor(s) 200. In this particular embodiment the Handguard Support Tube 810 is shown with two positions for the Internally Gimballed Integrated Precession Motor(s) 200. The Handguard Support Tube 810 is shown with four Micro Bearing(s)/Bushing(s) Pockets 410 needed to mount two Internally Gimballed Integrated Precession Motor(s) 200. Also included in this part are multiple Cutouts to Allow Maximum Motor Pivot 820. These cutouts when aligned with the thinned areas of a standard NATO Contour M4 Barrel 610 (not shown in this view) to create additional degrees of pivot of the Internally Gimballed Integrated Precession Motor(s) 200. When not used with a standard NATO Contour Barrel 610, these cutouts still allow additional degrees of pivot of the Internally Gimballed Integrated Precession Motor(s) 200. This part is mounted to the Barrel Nut 720 using the Mounting Holes for Attaching the Barrel Nut(s) 800. Multiple Grooves for Wire Management 1860 are incorporated into the Handguard Support Tube 810.

Figure 52:
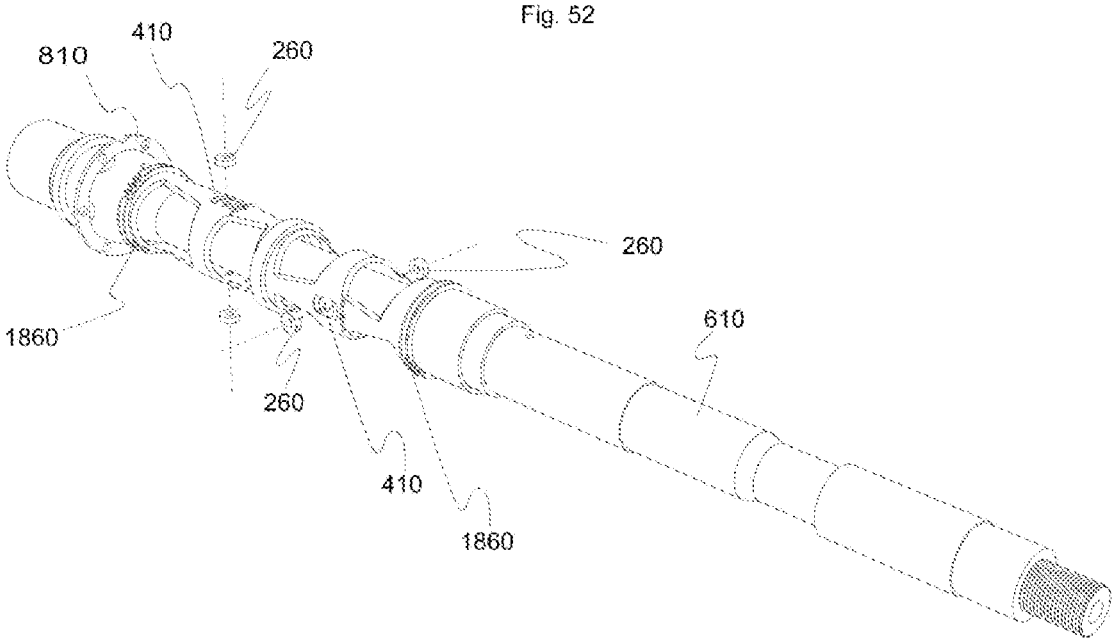
FIG. 52 is an illustration by way of example but not limited to this preferred embodiment showing; the Handguard Support Tube, and how it mounts onto a mil cut type NATO Contour Barrel. This illustration shows how the Handguard Support Tube creates a support structure to attach Micro Bearing(s)/Bushing(s) into the formed Micro Bearing(s)/Bushing(s) Pocket(s).

FIG. 52 is an illustration by way of example but not limited to this preferred embodiment showing; the Handguard Support Tube 810, and how it mounts onto a mil cut type NATO Contour Barrel 610. This illustration shows how the Handguard Support Tube 810 creates a support structure to attach Micro Bearing(s)/Bushing(s) 260 into the formed Micro Bearing(s)/Bushing(s) Pocket(s) 410. This construction creates open areas around the Barrel 610 to allow the Internally Gimballed Integrated Precession Motor(s) 200 room to freely pivot. Multiple Grooves for Wire Management 1860 are incorporated into the Handguard Support Tube 810.

Figure 53:
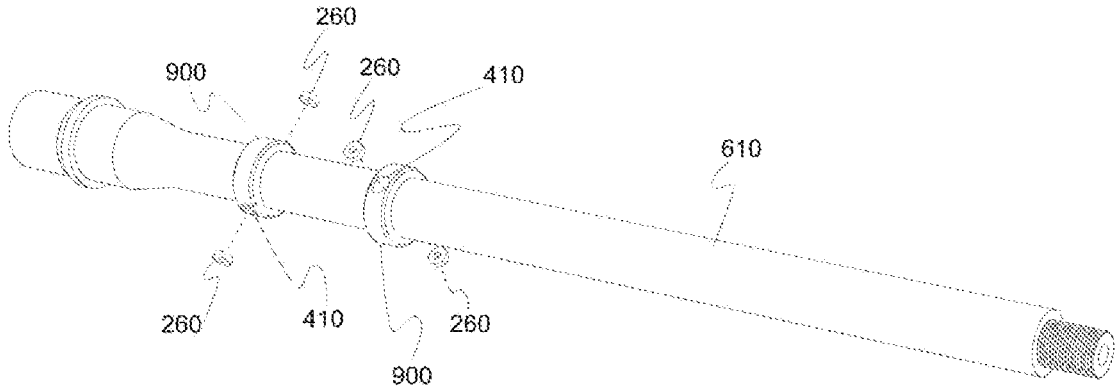
FIG. 53 is an illustration by way of example but not limited to this preferred embodiment showing; an alternative approach that creates open areas around the Barrel to allow the Internally Gimballed Integrated Precession Motor(s) room to freely pivot by adding raised portions around the barrel.

FIG. 53 is an illustration by way of example but not limited to this preferred embodiment showing; an alternative approach that creates open areas around the Barrel 610 to allow the Internally Gimballed Integrated Precession Motor(s) 200 room to freely pivot. In this embodiment, the Barrel 610 is machined with one or more Raised Portions of the Barrel 900 are created with integral Micro Bearing(s)/Bushing(s) Pockets 410 formed in allowing for the placement of Micro Bearing(s)/Bushing(s) 260.

Figure 54:
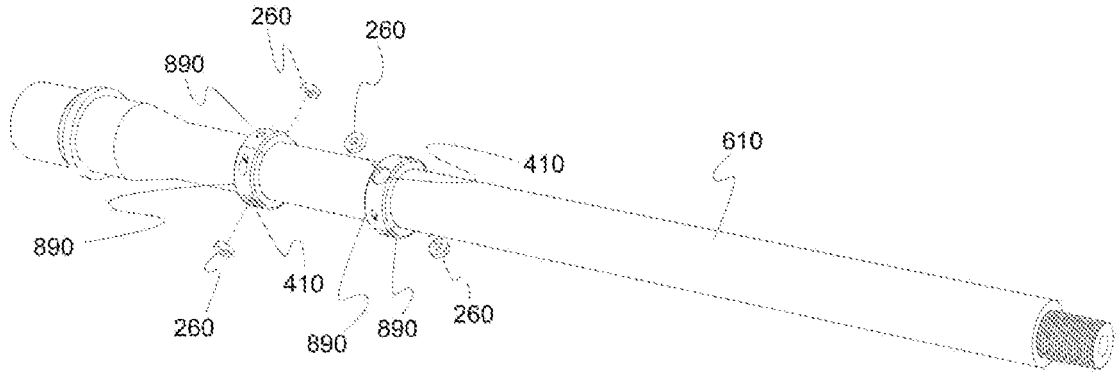
FIG. 54 is an illustration by way of example but not limited to this preferred embodiment showing; an alternative approach that creates open areas around the Barrel to allow the Internally Gimballed Integrated Precession Motor(s) room to freely pivot.

FIG. 54 is an illustration by way of example but not limited to this preferred embodiment showing; an alternative approach that creates open areas around the Barrel 610 to allow the Internally Gimballed Integrated Precession Motor(s) 200 room to freely pivot. In this exploded view of this embodiment, one or more Separate Raised Barrel Attachment(s) 890 are attached to the Barrel 610. Each of the Separate Raised Barrel Attachment(s) 890 has integrated Micro Bearing(s)/Bushing(s) Pockets 410 formed into it, allowing for the placement of Micro Bearing(s)/Bushing(s) 260.

Figure 55:
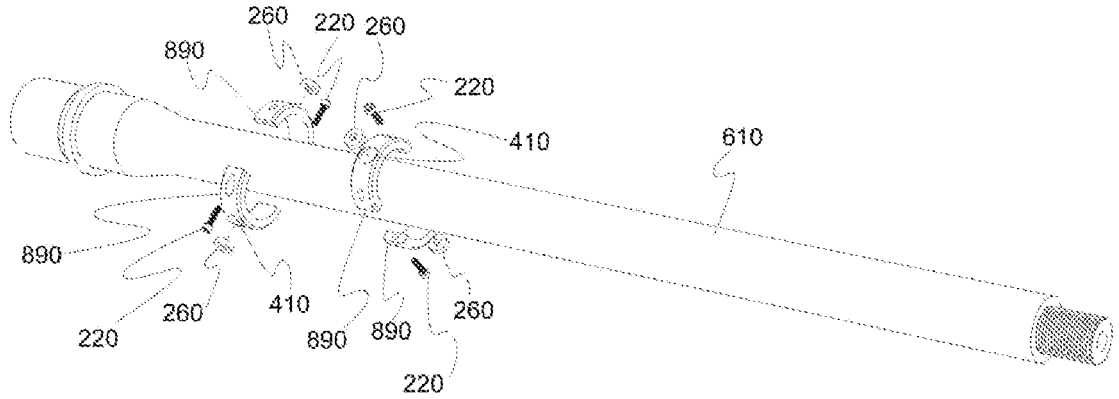
FIG. 55 is an illustration by way of example but not limited to this preferred embodiment showing; an alternative approach that creates open areas around the Barrel to allow the Internally Gimballed Integrated Precession Motor(s) room to freely pivot.

FIG. 55 is an illustration by way of example but not limited to this preferred embodiment showing; an alternative approach that creates open areas around the Barrel 610 to allow the Internally Gimballed Integrated Precession Motor(s) 200 room to freely pivot. In this exploded view of this embodiment, one or more Separate Raised Barrel Attachment(s) 890 are attached to the Barrel 610. Each of the Separate Raised Barrel Attachment(s) 890 has integrated Micro Bearing(s)/Bushing(s) Pockets 410 formed into it, allowing for the placement of Micro Bearing(s)/Bushing(s) 260. In this illustration, by way of example, but not limited to this preferred embodiment Screw(s) 220 are used to secure these Separate Raised Barrel Attachment(s) 890 to the Barrel 610.

Figure 56:
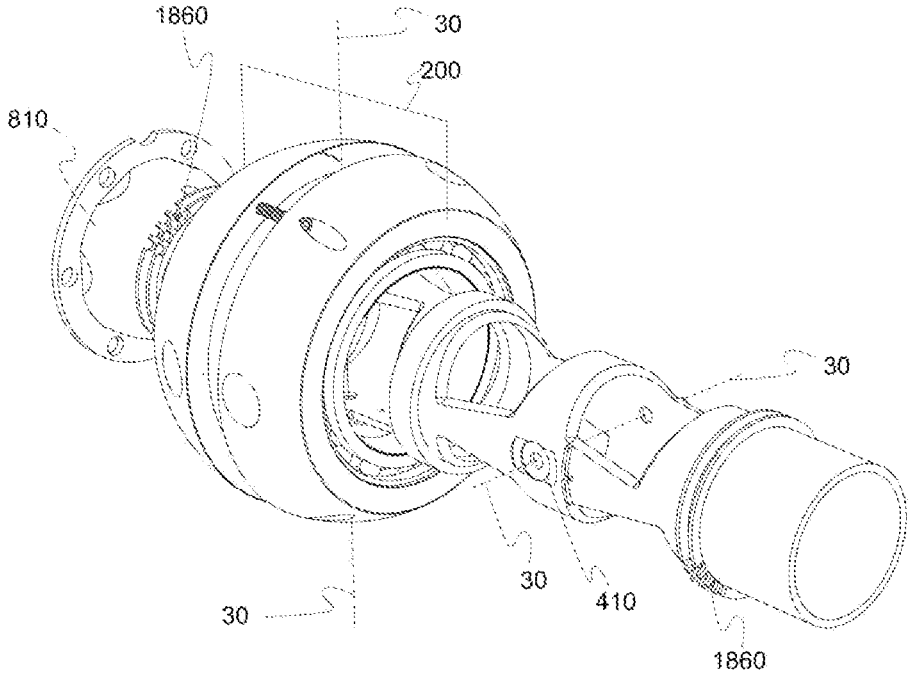
FIG. 56 is an illustration by way of example but not limited to this preferred embodiment showing; the Internally Gimballed Integrated Precession Motor(s) as mounted onto a Handguard Support Tube.

FIG. 56 is an illustration by way of example but not limited to this preferred embodiment showing; the Internally Gimballed Integrated Precession Motor(s) 200 as mounted onto a Handguard Support Tube 810. Included in this drawing are details showing the Micro Bearing(s)/Bushing(s) Pocket(s) 410 and their associated Gimbal Pivot Axis 30. This is the axis that the Internally Gimballed Integrated Precession Motor(s) 200 pivot on. Multiple Grooves for Wire Management 1860 are incorporated into the Handguard Support Tube 810.

Figure 57:
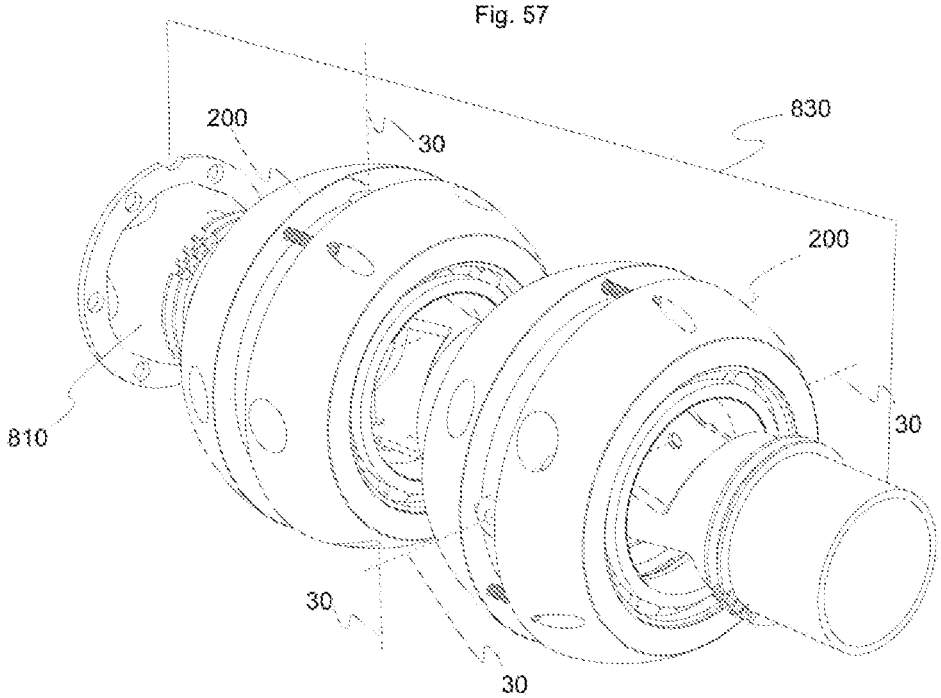
FIG. 57 is an illustration by way of example but not limited to this preferred embodiment showing; two Internally Gimballed Integrated Precession Motor(s) mounted onto a Handguard Support Tube with differing Gimbal Pivot Axis.

FIG. 57 is an illustration by way of example but not limited to this preferred embodiment showing; two Internally Gimballed Integrated Precession Motor(s) 200 mounted onto a Handguard Support Tube 810 with differing Gimbal Pivot Axis 30. By way of example, but not limited to this particular embodiment, both the Internally Gimballed Integrated Precession Motor(s) 200 share the same Center Line of Assembly 280, although this is not necessary. When one or more Internally Gimballed Integrated Precession Motor(s) 200 are assembled onto the Handguard Support Tube 810 this assembly is referred to as a Handguard Support Tube Sub-Assembly 830.

Figure 58:
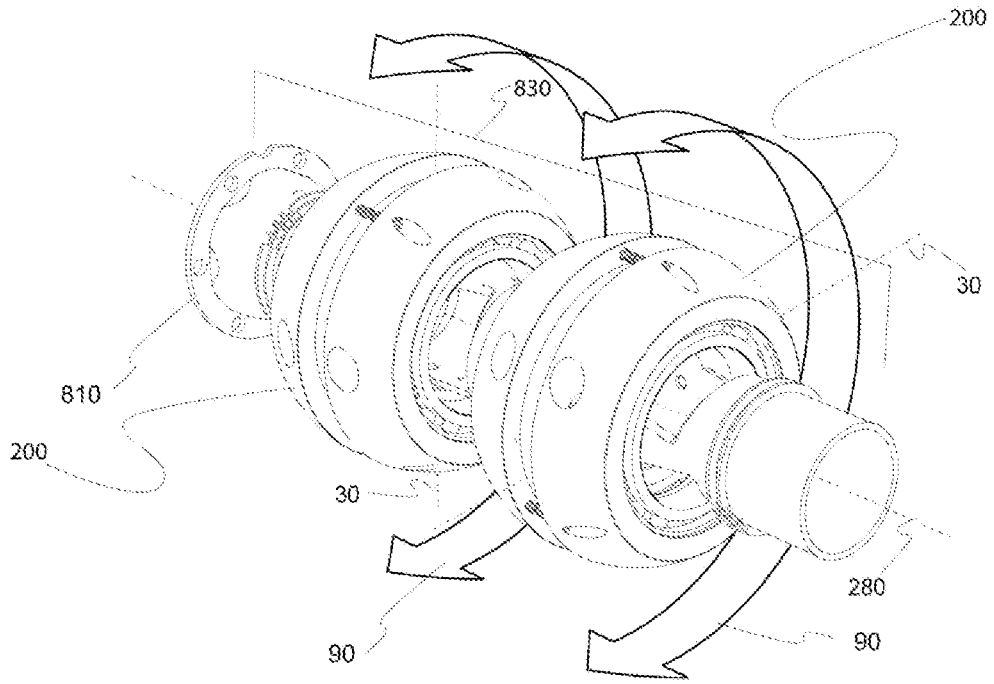
FIG. 58 is an illustration by way of example but not limited to this preferred embodiment showing; a Handguard Support Tube Sub-Assembly created from two Internally Gimballed Integrated Precession Motor(s) assembled onto a Handguard Support Tube.

FIG. 58 is an illustration by way of example but not limited to this preferred embodiment showing; a Handguard Support Tube Sub-Assembly 830 created from two Internally Gimballed Integrated Precession Motor(s) 200 assembled onto a Handguard Support Tube 810. This view shows the rotation of the individual Internally Gimballed Integrated Precession Motor(s) 200 when energized. Their rotation is shown by the Rotor Rotation Arrows 90. The direction of rotation may be either clockwise or counterclockwise. In this drawing these two Internally Gimballed Integrated Precession Motor(s) 200 are shown to have a different Gimbal Pivot Axis 30. The Internally Gimballed Integrated Precession Motor(s) 200 do not need to be secured to the same Handguard Support Tube 810, or share the same Center Line of Assembly 280 to function as a stabilizer. They could be mounted to different Handguard Support Tube 810 and have different alignments.

Figure 59:
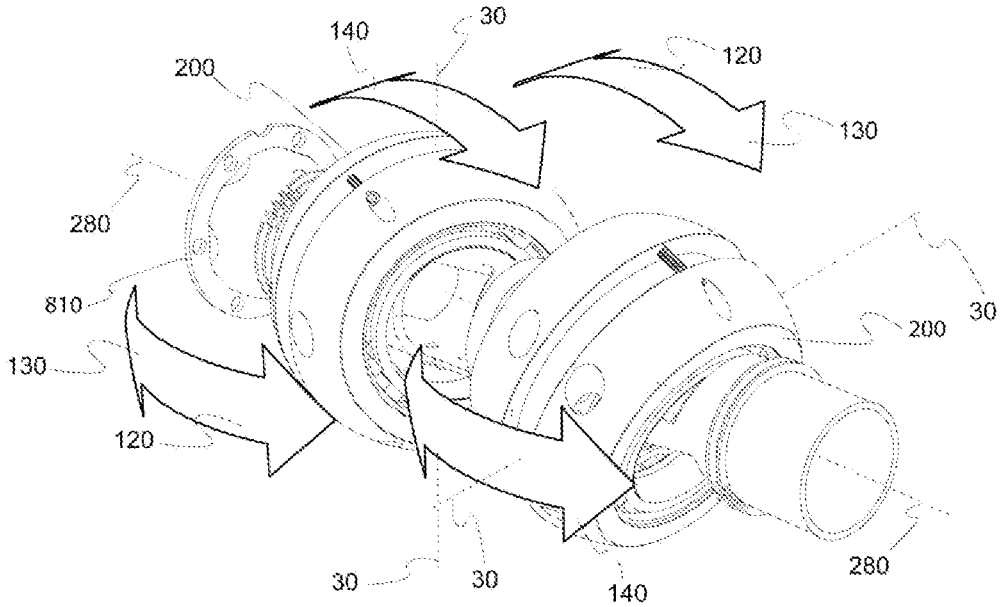
FIG. 59 is an illustration by way of example but not limited to this preferred embodiment showing; a Handguard Support Tube Sub-Assembly composed of two Internally Gimballed Integrated Precession Motor(s) assembled onto a Handguard Support Tube.

FIG. 59 is an illustration by way of example but not limited to this preferred embodiment showing; a Handguard Support Tube Sub-Assembly 830 composed of two Internally Gimballed Integrated Precession Motor(s) 200 assembled onto a Handguard Support Tube 810. This view shows the two Internally Gimballed Integrated Precession Motor(s) 200, pivot on the Gimbal Pivot Axis 30 when there is a Precession Response 120 due to changes in their orientation. The Internally Gimballed Integrated Precession Motor(s) 200 share the same rotational axis in this case when mounted on a Handguard Support Tube 810. In this case, the two Internally Gimballed Integrated Precession Motor(s) 200 share the same Center Line of Assembly 280. An Applied External Force 110 aligned with the Gimbal Rotation Arrows 130 initiates an immediate Precession Response 120 initiating a resistive push back shown by the Stabilization Rotation Arrows 140.

Figure 60:
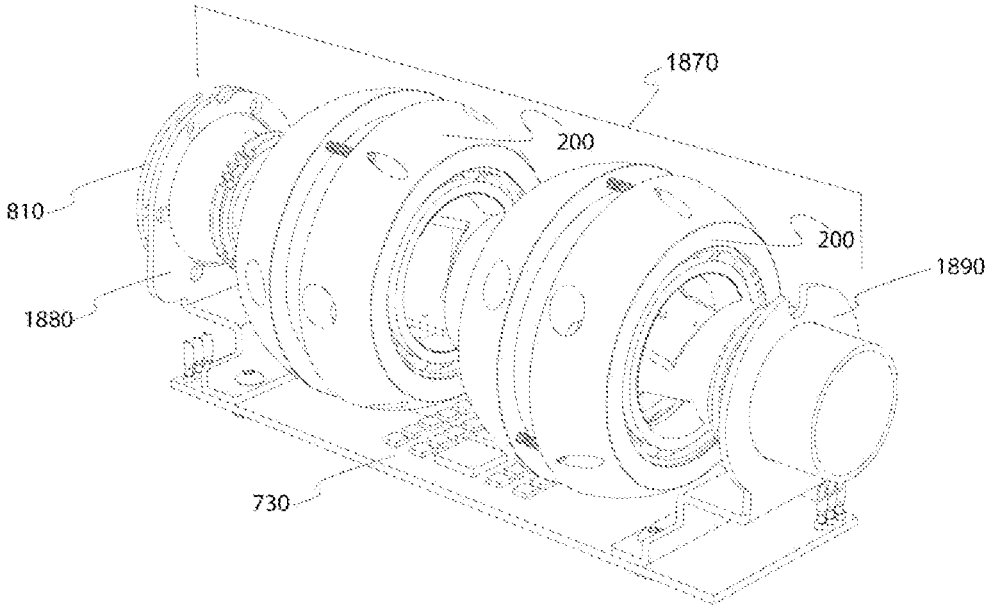
FIG. 60 is an illustration by way of example but not limited to this preferred embodiment showing; the Handguard Support Tube Sub-Assembly with Electronic Controller.

FIG. 60 is an illustration by way of example but not limited to this preferred embodiment showing; the Handguard Support Tube Sub-Assembly with Electronic Controller 1870. The assembly provides for a brushless DC Motor Control Circuit Board 730 which electronically controls the management of a single or multiple Internally Gimballed Integrated Precession Motor(s) 200. The Handguard Support Tube Sub-Assembly with Electronic Controller 1870 includes the Handguard Support Tube 810 and the Electronic Controller Rear Bracket 1880, and the Electronic Controller Front Bracket 1890. The configuration of this assembly may be varied in appearance, and for clarity the precise arrangement of wiring has been left out of this drawing.

Figure 61:
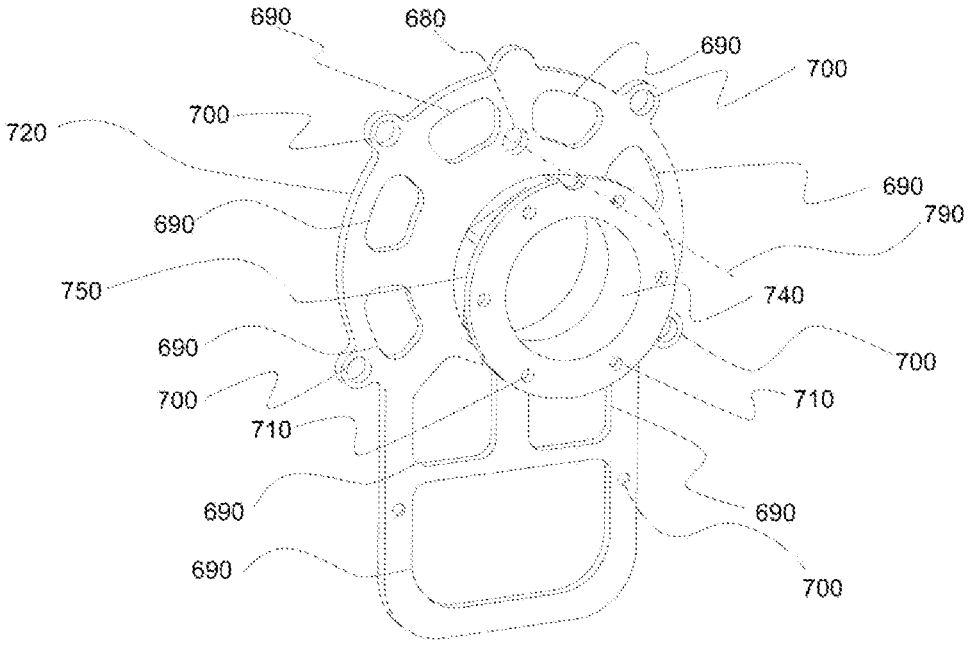
FIG. 61 is an illustration by way of example but not limited to this preferred embodiment showing; a Barrel Nut. This part is used to attach and align the Gas Tube Hole in the Barrel Nut with the Gas Tube Hole in the Firearm.

FIG. 61 is an illustration by way of example but not limited to this preferred embodiment showing; a Barrel Nut 720. This part is used to attach and align the Gas Tube Hole 680 in the Barrel Nut 720 with the Gas Tube Hole 680 in the Firearm 600. The Barrel Nut 720 is designed to mount to the Handguard Support Tube Sub-Assembly with Electronic Controller 1870 with the Mounting Hole(s) for Attaching to the Support Tube 710. This view which details the Barrel Nut 720, shows how it is secured with its Mounting Hole(s) for attaching to the Handguard A 700. Also shown in this view are the multiple Weight Reducing Pocket(s) 690 designed into this part. The Barrel Nut 720 had multiple Integrated Wrench Flat(s) 750 designed into the part to allow tightening of the Barrel Nut 720 with a common wrench like tool. The Barrel Nut 720 is designed to attach directly to the Firearm 600 with the incorporated in the Barrel Nut 720 and the corresponding Threaded Receiver for the Barrel Nut 760 shown on FIG. 45. To ensure the proper alignment of the Gas Tube Hole 680 in the Barrel Nut 720 and the Gas Tube Hole 680 in the Firearm 600 along the Alignment of the Barrel Nut and the Gas Tube Hole 790. The threaded receiver on the Firearm 600 attaches to the Threading 740 on the Barrel Nut 720. It may be necessary to use Shims 780 of differing thickness shown in FIG. 45 to ensure the proper indexing. This is a common method of indexing a Barrel 610 to a Firearm 600 which has been used for decades. Also included in this part are the Mounting Holes for attaching to the Handguard Support Tube A 700. The Handguard Support Tube 810 is not shown in this view, but is shown in FIG. 39-43.

Figure 62:
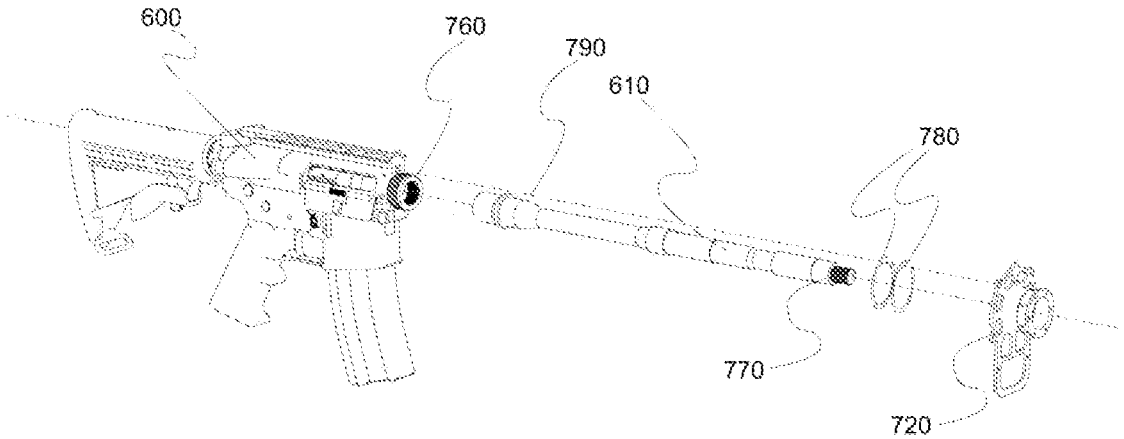
FIG. 62 is an illustration by way of example but not limited to this preferred embodiment showing; a Firearm with a Barrel being attached to it with the Barrel Nut.

FIG. 62 is an illustration by way of example but not limited to this preferred embodiment showing; a Firearm 600 with a Barrel 610 being attached to it with the Barrel Nut 720. For this particular Firearm 600 embodiment, the Barrel Nut 720 is screwed onto the Threaded Receiver for the Barrel Nut 760. In doing so, the Threading 740 can result in a misaligned orientation of the Barrel Nut 720 when fully tightened in place. To compensate for this unpredictability in alignment, the use of one or more Shim(s) 780 may be necessary. These are commonly used by manufacturers and gunsmiths to solve alignment problems. In this preferred embodiment, they are used to ensure the Alignment Line of the Barrel Nut and the Gas Tube Hole 790 is achieved. This is necessary for the proper Alignment of the Gas Tube 840, not shown in this illustration, but shown later in the assembly process in FIG. 47-48. Also shown in this picture is the Threading on the Barrel for the Flash Suppressor 770.

Figure 63:
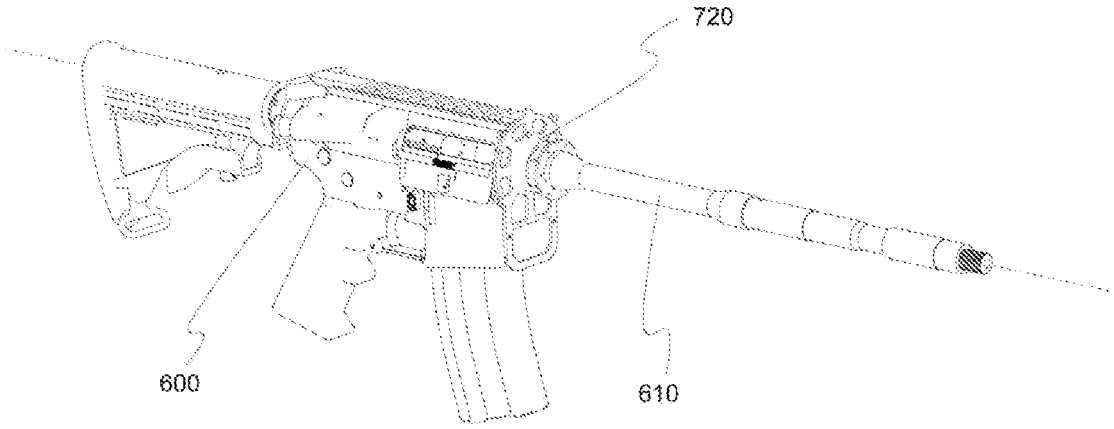
FIG. 63 is an illustration by way of example but not limited to this preferred embodiment showing; a Firearm with a Barrel fully attached to it with the Barrel Nut.

FIG. 63 is an illustration by way of example but not limited to this preferred embodiment showing; a Firearm 600 with a Barrel 610 fully attached to it with the Barrel Nut 720. Depending on the indexing and alignment of the Barrel Nut 720 with the Threaded Receiver for the Barrel Nut 760, Shim(s) 780 may or may not be needed to ensure proper alignment.

Figure 64:
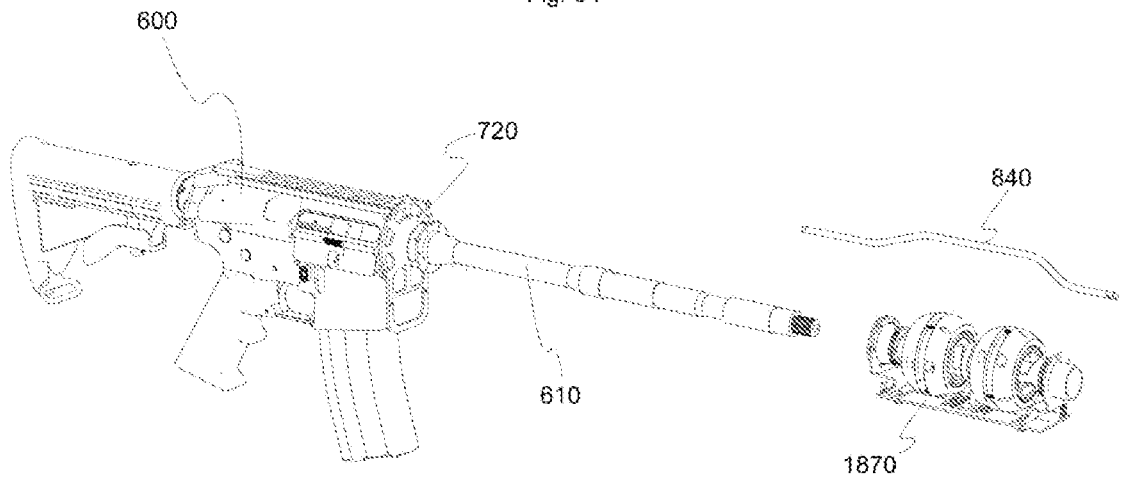
FIG. 64 is an illustration by way of example but not limited to this preferred embodiment showing; a Firearm with a Barrel fully attached to it with the Barrel Nut.

FIG. 64 is an illustration by way of example but not limited to this preferred embodiment showing; a Firearm 600 with a Barrel 610 fully attached to it with the Barrel Nut 720. The Handguard Support Tube Sub-Assembly with Electronic Controller 1870 is shown to be sliding down the Barrel 610 during assembly. The Gas Tube 840 needs to be assembled at the same time.

Figure 65:
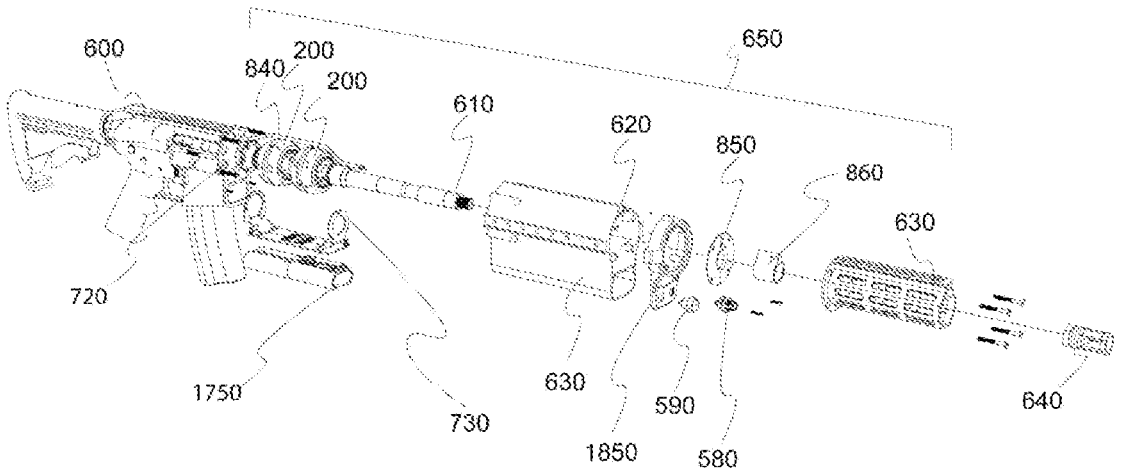
FIG. 65 is an illustration by way of example but not limited to this preferred embodiment showing; an exploded view of the Full Handguard Stabilizer Assembly as it is assembled onto the Firearm.

FIG. 65 is an illustration by way of example but not limited to this preferred embodiment showing; an exploded view of the Full Handguard Stabilizer Assembly 650 as it is assembled onto the Firearm 600. This drawing represents the next step from FIG. 45 in the assembly process. In this view, The Barrel Nut 720 is shown attaching Barrel 610 to the Threaded Receiver for the Barrel Nut 760. In this illustration there are two Internally Gimballed Integrated Precession Motor(s) 200, (although it could also have one or more), and the Support Tube 1260, the Handguard/Gas Tube Gasket 850 and the Gas Tube 840 are assembled as shown. The Motor Control Circuit Board 730 is assembled at this time as well. The Gas Tube 840 is inserted through the Barrel Nut 720 and into the Firearm 600. This will enable the gas requirement needed to cycle the Firearm 600. The other side of the Gas Tube 840 is attached to the Gas Block 860 which ports gas from a hole in the side of the Barrel 610. This is a standard function of the AR15, M16, M4 type weapon shown in this preferred embodiment. The Handguard A Assembly 620 encloses the Battery Pack 1750 and the Motor Control Circuit Board 730 which powers the Internally Gimballed Integrated Precession Motor(s) 200. The Handguard End Cap 1850 is attached directly to the Handguard A Assembly 620, covering the previous assembly and having the Charging Port 580 and Activation Button/Remote Activation Connector 590 attached to it. A Handguard/Gas Tube Gasket 850 is attached between Handguard A Assembly 620 and Handguard B Assembly 630 to prevent dirt and moisture from entering the assembly. Handguard B Assembly 630 wraps around the Barrel 610, and provides a handgrip surface. It also has a rail system incorporated into it to allow the easy attachment of Firearm 600 accessories. The Flash Suppressor 640 is attached to the Barrel 610 to complete the assembly. When complete this assembly forms the Full Handguard Stabilizer Assembly 650 shown assembled in FIG. 33. If this same assembly is done without using the Handguard B Assembly 630 on a AR15, M16, M4 type Firearm 600, and by substituting the Gas Block 860 with the Front Sight and Gas Tube Assembly 670 the resulting assembly would look like the assembled illustration shown in FIG. 32. This assembly would be called the Shortened Handguard Stabilizer Assembly 660.

Figure 66:
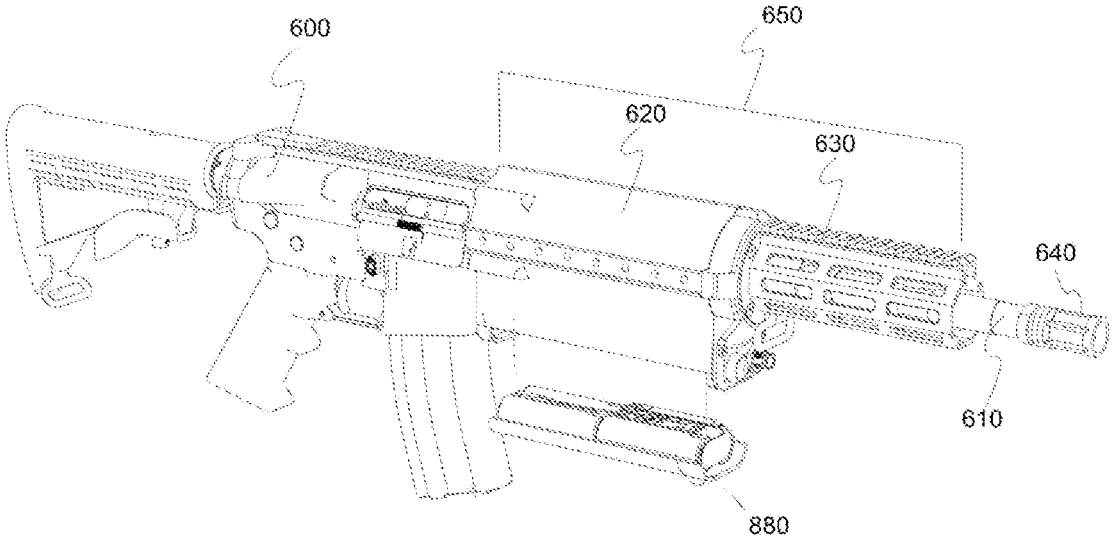
FIG. 66 is an illustration by way of example but not limited to this preferred embodiment showing; the Full Handguard Stabilizer Assembly including the Handguard A Assembly and the Handguard B Assembly assembled onto an AR15, M16, or M4 type Firearm.

FIG. 66 is an illustration by way of example but not limited to this preferred embodiment showing; the Full Handguard Stabilizer Assembly 650 including the Handguard A Assembly 620 and the Handguard B Assembly 630 assembled onto an AR15, M16, M4 type Firearm 600 with a modified Handguard A Assembly 620 that allows a Removable Battery Pack 880 to be incorporated into it.

Figure 67:
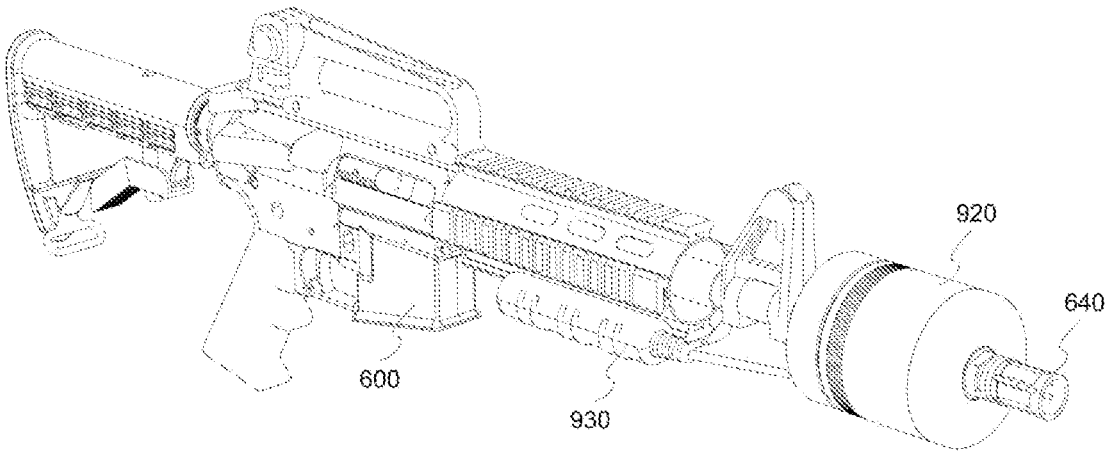
FIG. 67 is an illustration by way of example but not limited to this preferred embodiment showing; a Barrel Front Stabilizer 920 attached to the front of the barrel with a Battery Attached to the Handguard Rail System.

FIG. 67 is an illustration by way of example but not limited to this preferred embodiment showing; a Barrel Front Stabilizer 920 attached to the front of the barrel with a Battery Attached to the Handguard Rail System 930. This Barrel Front Stabilizer 920 is held in place on the Firearm 600 by using the Flash Suppressor 640.

Figure 68:
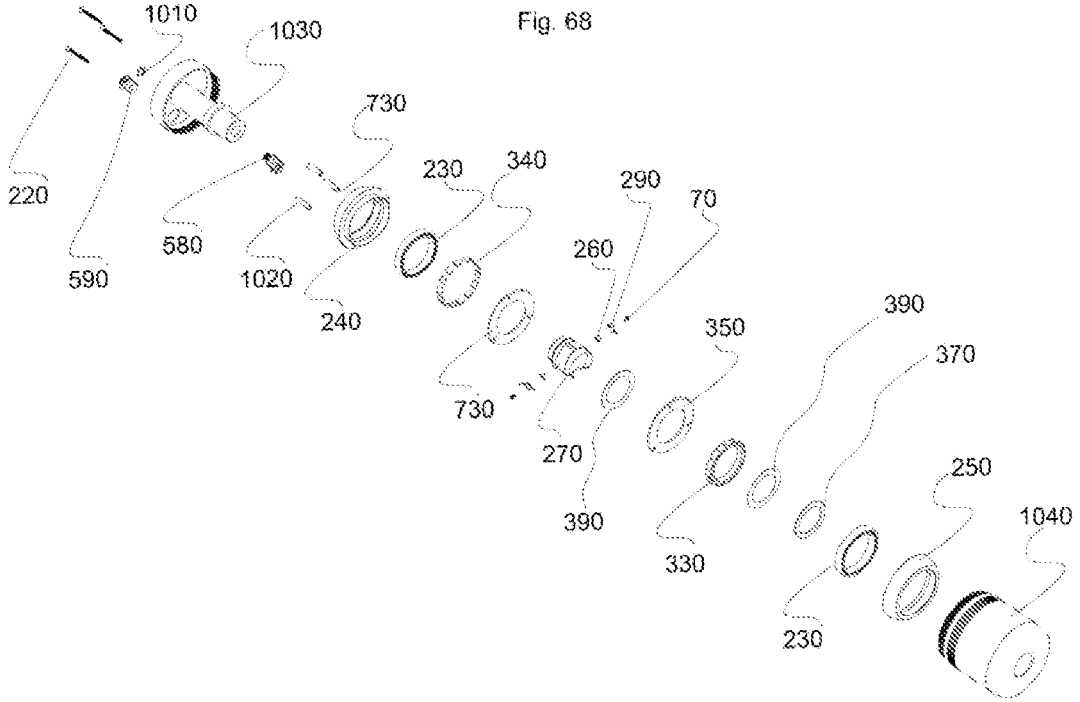
FIG. 68 is an illustration by way of example but not limited to this preferred embodiment showing; a fully exploded view of a Barrel Front Stabilizer attached to the Front of the Barrel.

FIG. 68 is an illustration by way of example but not limited to this preferred embodiment showing; a fully exploded view of a Barrel Front Stabilizer attached to the Front of the Barrel 920. This drawing shows the Screw(s) 220, the Nut(s) 1010, the Activation Button/Remote Activation Connection 590, the Stabilizer Housing for the Front of the Barrel Application 1030, the Charging Port 580, the Spacer(s) 1020, the Motor Control Circuit Board 730, the Pivot Tube Spring(s) 290, the Rotor Half A 240, the Micro Bearing(s)/Bushing(s) 260, the Gimbal Screw(s) 70, the Pivot Tube 270, the Stator Circuit Board 350, the Stator 330, the Magnet(s) 340, the Snap Spring(s) 370, the Dielectric Insulating Washer 390, the Rotor Half B 250, the Bearing(s) 230, and the Stabilizer Cover for the Front of the Barrel Application 1040 as assembled to create a Barrel Front Stabilizer attached to the Front of the Barrel 920.

Figure 69:
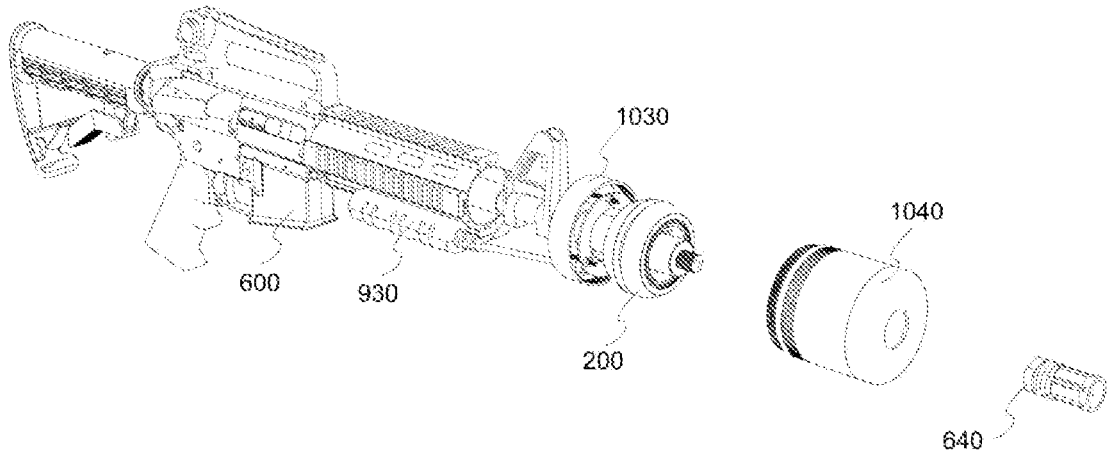
FIG. 69 is an illustration by way of example but not limited to this preferred embodiment showing; a partially exploded view of a Barrel Front Stabilizer attached to the Front of the Barrel.

FIG. 69 is an illustration by way of example but not limited to this preferred embodiment showing; a partially exploded view of a Barrel Front Stabilizer attached to the Front of the Barrel 920. In this drawing, the Barrel Front Stabilizer attached to the Front of the Barrel 920 is shown with the Stabilizer Cover for the Front of the Barrel Application 1040 removed from the Stabilizer Housing for the Front of the Barrel Application 1030. The Flash Suppressor 640 is designed to hold the assembly in place on the Firearm 600. In this illustration the Barrel Front Stabilizer attached to the Front of the Barrel 920 is shown to have only one Internally Gimballed Integrated Precession Motor(s) 200 in place, however it could have more depending on the desired size of the device. Also shown in this drawing is a Battery Attached to the Handguard Rail System 930, although there could be a battery built directly inside the device instead.

Figure 70:
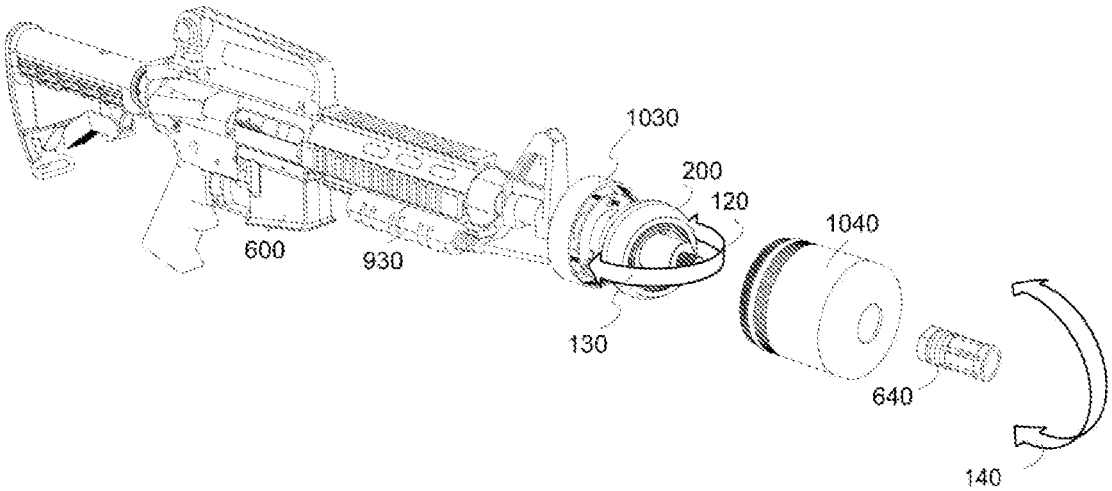
FIG. 70 is an illustration by way of example but not limited to this preferred embodiment showing; a partially exploded view of a Barrel Front Stabilizer attached to the Front of the Barrel.

FIG. 70 is an illustration by way of example but not limited to this preferred embodiment showing; a partially exploded view of a Barrel Front Stabilizer attached to the Front of the Barrel 920 showing the Gimbal Rotation Arrows 130 and the Stabilization Rotation Arrows 140 which will resist and push back against forces applied to it and the associated developed Precision Response 120. This demonstrates how this embodiment would resist changes in Firearm 600 elevation changes.

Figure 71:
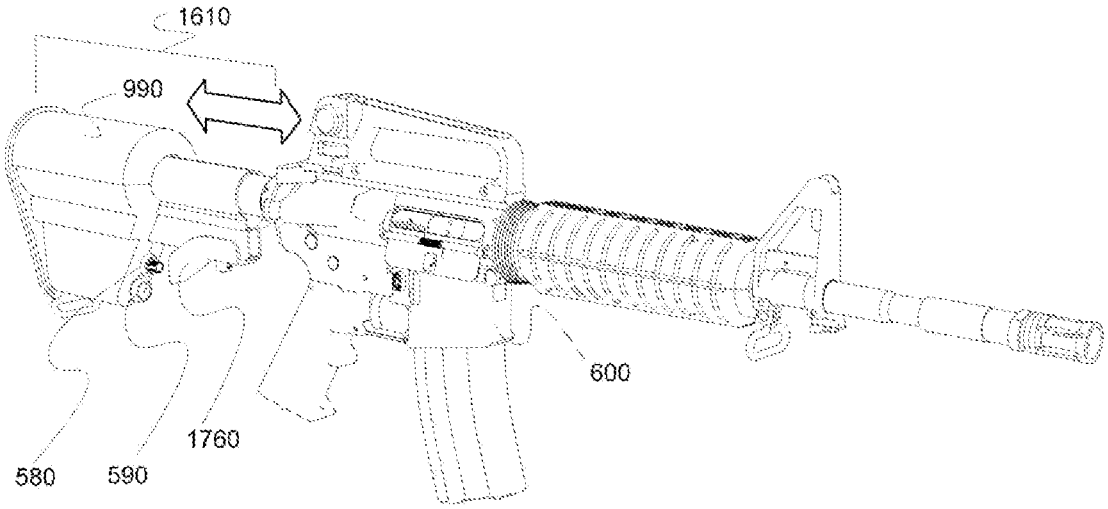
FIG. 71 is an illustration by way of example but not limited to this preferred embodiment showing; the Adjustable Buttstock Gimballed Precession Motor Stabilizer which incorporates one or more Internally Gimballed Integrated Precession Motor(s) in the Firearm Buttstock.

FIG. 71 is an illustration by way of example but not limited to this preferred embodiment showing; the Adjustable Buttstock Gimballed Precession Motor Stabilizer 1610 which incorporates one or more Internally Gimballed Integrated Precession Motor(s) 200 in the Firearm 600 Buttstock 990. The drawing shows the Activation Button/Remote Activation Connector 590 and Charging Port 580 for the Adjustable Buttstock Gimballed Precession Motor(s) Stabilizer 1610. The drawing also shows the Adjustment Paddle 1760 for adjusting the Buttstock 990 length.

FIG. 72 is an illustration by way of example but not limited to this preferred embodiment showing; the Fixed Buttstock Gimballed Precession Motor(s) Stabilizer 1620. This illustration shows the external view of this device including the; Charging Port 580, Activation Button/Remote Activation Connector 590, and Fixed Buttstock Screw Location 1060 mounted on a standard AR-15, M-4, M-16 type Firearm 600. This version of the device does not have an adjustable Buttstock 990 which simplifies its internal construction.

FIG. 73 is an illustration by way of example but not limited to this preferred embodiment showing; an exploded view of the Support Tube-Buffer Tube for the Fixed Buttstock 950. This tube replaces the traditional buffer tube, the buffer, and the traditional large spring which is utilized to cycle and adsorb recoil of this type of Firearm 600. This Support Tube-Buffer Tube for the Fixed Buttstock 950 utilizes a smaller diameter Buffer Tube Spring 1080. The Support Tube-Buffer Tube for the Fixed Buttstock 950 does not have an additional buffer tube. Instead, the Internally Gimballed Integrated Precession Motor(s) 200 mounts directly onto the Raised Portion(s) of the Support Tube/Buffer Tube 960. This is used in a Fixed Buttstock Gimballed Precession Motor(s) Stabilizer 1620.

The Buffer Tube Spring 1080 is designed to have a Buffer Tube Rod 1090 inside it to manage the "aligned" compression and decompression of the Buffer Tube Spring 1080 while both elements function within the Support Tube-Buffer Tube for the Fixed Buttstock 950.

The Buffer Tube Spring 1080 is a compression spring and may be made as a round wire, flat wire, machined wire, or as a wave spring also known as a crest to crest wave type spring in all different materials. In this illustration, it also shows a Buffer Tube Rod 1090. This goes inside the Buffer Tube Spring 1080 and the Buffer Tube Bumper 1100 which is designed to absorb excess recoil energy on recoil. The Buffer Tube Rod 1090 has a hollow section within which encloses the Buffer Tube Weight(s) 1120, the Buffer Tube Pad(s) 1130, and the Buffer Tube End Bumper 1140. The Buffer Tube Cup 1160 closes the end of the Buffer Tube Rod 1090. The Buffer Tube Weight(s) 1120 allow for smoother cycling and customization of the recoil function of the Firearm 600. These Buffer Tube Weight(s) 1120 may be made of a wide variety of materials by way of example but not limited to; aluminum, steel, brass, beryllium copper, tungsten, or any other material which allows changes in their relative mass. The Buffer Tube Weight(s) 1120 are separated with Buffer Tube Pad(s) 1130 to act as cushioning and shock absorbing devices.

FIG. 74 is an illustration by way of example but not limited to this preferred embodiment showing; an exploded view of the Buffer Tube for an Adjustable Buttstock 1070. These tubes replace the traditional buffer tube, buffer, and traditional large spring which is utilized to cycle and adsorb recoil of this type of Firearm 600. The Buffer Tube for an Adjustable Buttstock 1070 utilizes a smaller diameter Buffer Tube Spring 1080.

Figure 75:
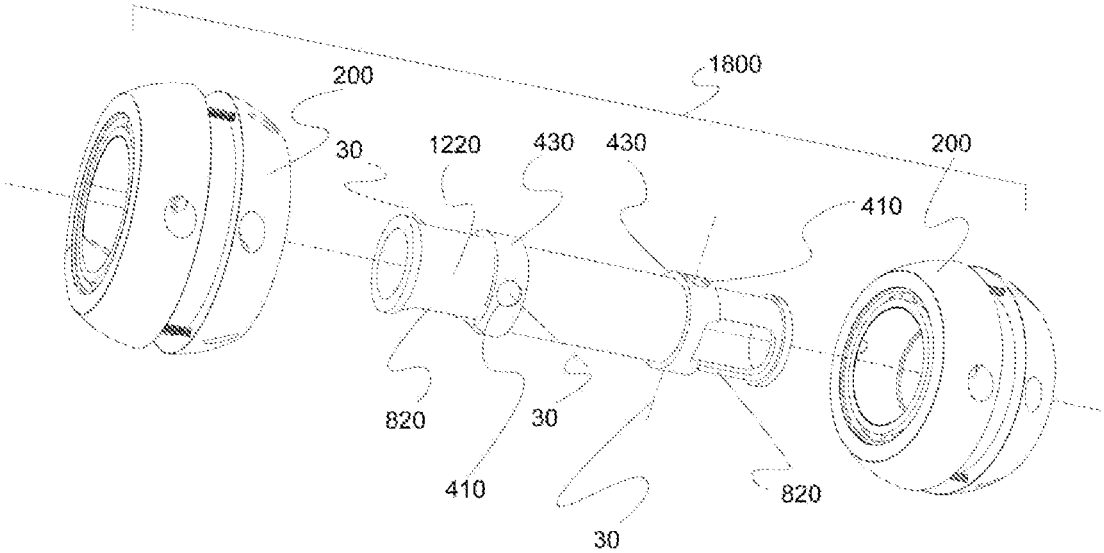
FIG. 75 is an illustration by way of example but not limited to this preferred embodiment showing; a Support Tube-Buffer Tube Assembly for the Adjustable Buttstock.

The Buffer Tube for an Adjustable Buttstock 1070 utilizes a separate Support Tube for the Adjustable Buttstock 1220 shown in FIG. 75 which is designed to slide up and down the Buffer Tube for an Adjustable Buttstock 1070. This permits the Adjustable Buttstock Gimballed Precession Motor Stabilizer 1610 (shown in FIG. 76) to be adjustable in length. This makes the Support Tube-Buffer Tube Assembly for the Adjustable Buttstock 1800 (shown in an exploded view in FIG. 76). The Buffer Tube Spring 1080 is designed to have a Buffer Tube Rod 1090 inside it to manage the "aligned" compression and decompression of the Buffer Tube Spring 1080 while both elements function within the Buffer Tube for the Adjustable Buttstock 1070.

The Buffer Tube Spring 1080 is a compression spring and may be made as a round wire, flat wire, machined wire, or as a wave spring also known as a crest to crest wave type spring in all different materials. In this illustration, it also shows a Buffer Tube Rod 1090. This goes inside the Buffer Tube Spring 1080 and the Buffer Tube Bumper 1100 which is designed to absorb excess recoil energy on recoil. The Buffer Tube Rod 1090 has a hollow section within which encloses the Buffer Tube Weight(s) 1120, the Buffer Tube Pad(s) 1130, and the Buffer Tube End Bumper 1140. The Buffer Tube Cup 1160 closes the end of the Buffer Tube Rod 1090. The Buffer Tube Weight(s) 1120 allow for smoother cycling and customization of the recoil function of the Firearm 600. These Buffer Tube Weight(s) 1120 may be made of a wide variety of materials by way of example but not limited to; aluminum, steel, brass, beryllium copper, tungsten, or any other material which allows changes in their relative mass. The Buffer Tube Weight(s) 1120 are separated with Buffer Tube Pad(s) 1130 to act as cushioning and shock absorbing devices.

FIG. 75 is an illustration by way of example but not limited to this preferred embodiment showing; a Support Tube-Buffer Tube Assembly for the Adjustable Buttstock 1800. This assembly is comprised of a Support Tube for the Adjustable Buttstock 1220 along with one or more of the Internally Gimballed Integrated Precession Motor(s) 200. In this illustration the Internally Gimballed Integrated Precession Motor(s) 200 pivot on their own respective Gimbal Pivot Axis 30. The relationship of each Gimbal Pivot Axis 30 is dependent on the desired stability performance. This illustration shows each Internally Gimballed Integrated Precession Motor(s) 200 aligned with a unique Gimbal Pivot Axis 30 and mounted on its respective Micro Bearing(s)/Bushing(s) 260 which are placed in the internal Micro Bearing(s)/Bushing(s) Pockets 410. The Micro Bearing(s)/Bushing(s) Pockets 410 are positioned on Raised Section(s) of the Support Tube 430 which allow the Internally Gimballed Integrated Precession Motor(s) 200 to freely pivot on their respective Gimbal Pivot Axis 30 and provide clearance for electrical wires needed to power each Internally Gimballed Integrated Precession Motor(s) 200. Additional Cutouts to Allow Maximum Motor Pivot 820 are included in the Support Tube for the Adjustable Buttstock 1220 to provide additional angular pivot and wire clearance.

Figure 76:
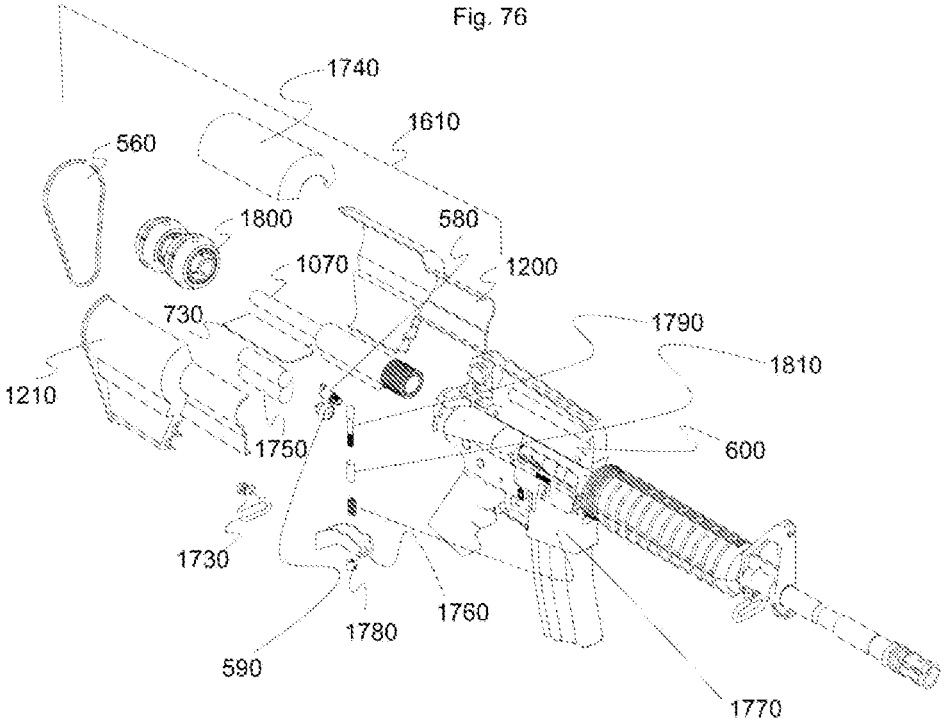
FIG. 76 is an illustration by way of example but not limited to this preferred embodiment showing; an exploded view of the Adjustable Buttstock Gimballed Precession Motor Stabilizer.

FIG. 76 is an illustration by way of example but not limited to this preferred embodiment showing; an exploded view of the Adjustable Buttstock Gimballed Precession Motor Stabilizer 1610.

This illustration shows the elements of this assembly including the; Buttstock Rear Pad 560, Buffer Tube for the Adjustable Buttstock 1070, Buttstock Right Housing 1210, Buttstock Left Housing 1200, the Cheek Rest 1740, the Support Tube for the Adjustable Buttstock 1220, the Motor Control Circuit Board 730, the Battery Pack 1750, the Charging Port 580, the Activation Button/Remote Activation Connector 590, the Buttstock Swivel 1730, the Adjustment Paddle Nut 1780, the Adjustment Paddle 1760, the Support Tube-Buffer Tube Assembly for the Adjustable Buttstock 1800, the Adjustment Paddle Nut 1780, the Paddle Spring 1770, the Adjustment Paddle Screw 1790, and the Adjustment Paddle Sleeve 1810 as assembled onto a standard Firearm 600.

Figure 77:
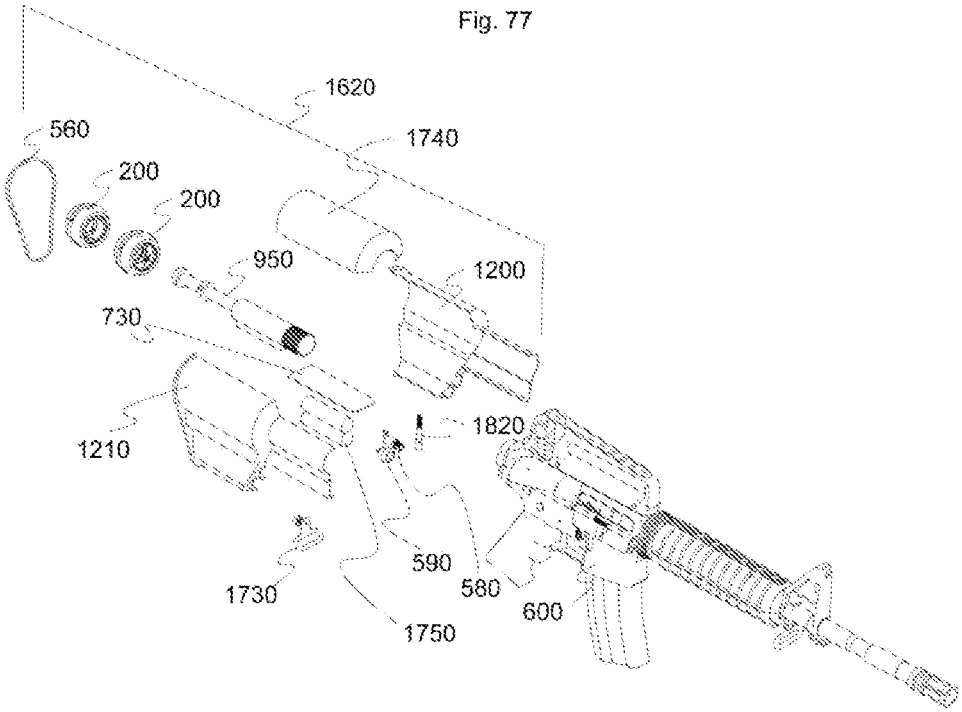
FIG. 77 is an illustration by way of example but not limited to this preferred embodiment showing; an exploded view of the Fixed Buttstock Gimballed Precession Motor Stabilizer.

FIG. 77 is an illustration by way of example but not limited to this preferred embodiment showing; an exploded view of the Fixed Buttstock Gimballed Precession Motor Stabilizer 1620. In this view the Internally Gimballed Integrated Precession Motor(s) 200 are assembled directly onto the Buffer Tube Assembly for the Fixed Buttstock 950. This illustration also shows the other elements of this assembly including the Buttstock Rear Pad 560, the Buttstock Right Housing 1210, the Buttstock Left Housing 1200, the Cheek Rest 1740, the, the Motor Control Circuit Board 730, the Battery Pack 1750, the Charging Port 580, the Activation Button/Remote Activation Connector 590, the Buttstock Swivel 1730, the Internally Gimballed Integrated Precession Motor(s) 200, and the Fixed Buttstock Screw 1820 as assembled onto a standard Firearm 600.

Figure 78:
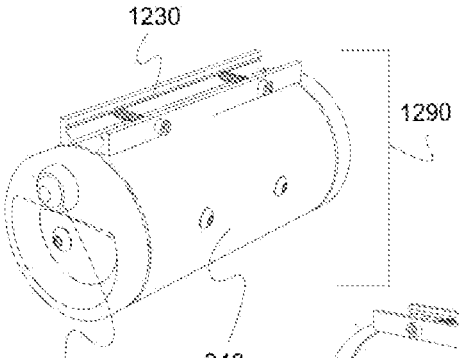
FIG. 78 is an illustration by way of example but not limited to this preferred embodiment showing; an Externally Attached Gimballed Precession Motor Stabilizer Device for attachment to a Firearm quad rail.

FIG. 78 is an illustration by way of example but not limited to this preferred embodiment showing; an Externally Attached Gimballed Precession Motor Stabilizer Device 1290 for attachment to a Firearm 600 quad rail (not shown in this view). This embodiment is called a Stabilizer Attached to the Rail System 940. The Rail Attachment Detail 1230 provides the method for attaching the device to the Firearm 600 quad rail. This housing can take many forms, but in this embodiment, it is a cylindrical housing with endcaps. Also shown in this view is a Button/Remote Activation Connector 870. In this case it has a pushbutton, although it could have a slide switch, toggle switch, remote switch, IR switch or any other method of activating the device The independent motor(s) and their spinning masses inside these enclosures are designed to freely rotate on their gimbal(s) to achieve the necessary Precession Response 120 to provide the desired stabilization in accordance with the present disclosure.

Figure 79:
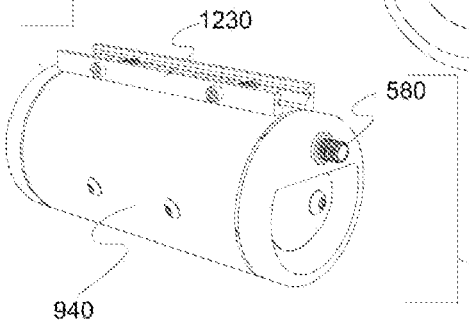
FIG. 79 is an illustration by way of example but not limited to this preferred embodiment showing; another image of the Externally Attached Gimballed Precession Motor Stabilizer Device for attachment to a Firearm quad rail.

FIG. 79 is an illustration by way of example but not limited to this preferred embodiment showing; another image of the Externally Attached Gimballed Precession Motor Stabilizer Device 1290 for attachment to a Firearm 600 quad rail (not shown in this view). This embodiment is called a Stabilizer Attached to the Rail System 940. The Rail Attachment Detail 1230 provides the method for attaching the device to the Firearm 600 quad rail. There are many different variations on how to mount this embodiment onto the Firearm 600 quad rail including screws, latches, clasps, etc. . . . This housing can take many forms, but in this embodiment, it is a cylindrical housing with endcaps. Also shown in this view is the Charging Port 580. This allows the charging of the internal battery, if present. The independent motor(s) and their spinning masses inside these enclosures are designed to freely rotate on their gimbal(s) to achieve the necessary Precession Response 120 to provide the desired stabilization in accordance with the present disclosure.

Figure 80:
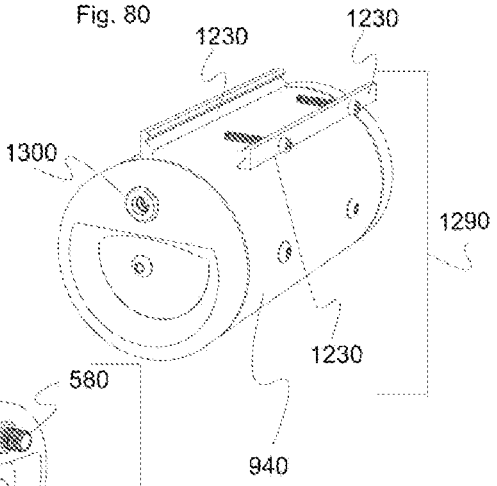
FIG. 80 is an illustration by way of example but not limited to this preferred embodiment showing; an Externally Attached Gimballed Precession Motor Stabilizer Device for attachment to a Firearm quad rail.

FIG. 80 is an illustration by way of example but not limited to this preferred embodiment showing; an Externally Attached Gimballed Precession Motor Stabilizer Device 1290 for attachment to a Firearm 600 quad rail (not shown in this view). This embodiment is called a Stabilizer Attached to the Rail System 940. The Rail Attachment Detail 1230 provides the method for attaching the device to the Firearm 600 quad rail. There are many different variations on how to mount this embodiment onto the Firearm 600 quad rail including screws, latches, clasps, etc. . . . This housing can take many forms, but in this embodiment, it is a cylindrical housing with endcaps. Also shown in this view is Remote Activation Connector 1300. This connector allows the activating of this device by an external wired pressure switch commonly used on Firearms 600. The independent motor(s) and their spinning masses inside these enclosures are designed to freely rotate on their gimbal(s) to achieve the necessary Precession Response 120 to provide the desired stabilization in accordance with the present disclosure.

Figure 81:
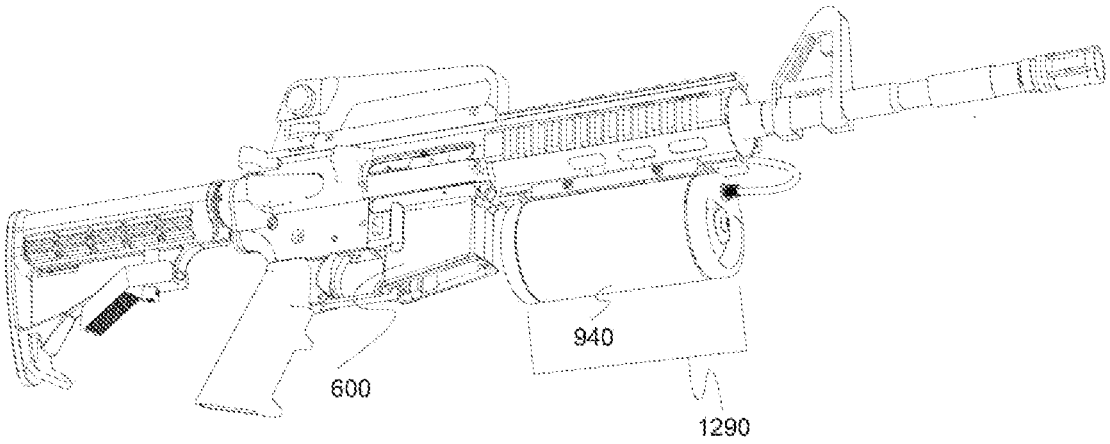
FIG. 81 is an illustration by way of example but not limited to this preferred embodiment showing; an Externally Attached Gimballed Precession Motor Stabilizer Device. Specifically, this is the Stabilizer Attached to the Rail System as attached below a Firearm to a quad rail.

FIG. 81 is an illustration by way of example but not limited to this preferred embodiment showing; an Externally Attached Gimballed Precession Motor Stabilizer Device 1290. Specifically, this is the Stabilizer Attached to the Rail System 940 as attached below a Firearm 600 to a quad rail as mentioned in FIGS. 78, 78, and 80.

The independent motor(s) and their spinning masses inside these enclosures are designed to freely rotate on their gimbal(s) to achieve the necessary Precession Response 120 to provide the desired stabilization in accordance with the present disclosure.

Figure 82:
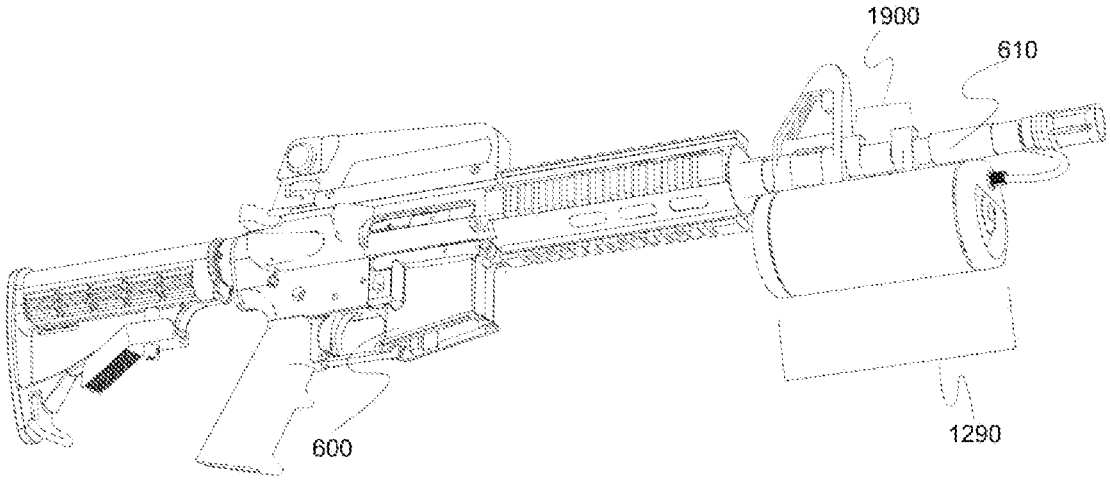
FIG. 82 is an illustration by way of example but not limited to this preferred embodiment showing; an Externally Attached Gimballed Precession Motor Stabilizer Device. Specifically, this is the device mounted to the Barrel attached below a Firearm to the NATO Contour Barrel using a Barrel Mounting Bracket.

FIG. 82 is an illustration by way of example but not limited to this preferred embodiment showing; an Externally Attached Gimballed Precession Motor Stabilizer Device 1290. Specifically, this is the device mounted to the Barrel 610 attached below a Firearm 600 to the NATO Contour Barrel 610 using a Barrel Mounting Bracket 1900.

The independent motor(s) and their spinning masses inside these enclosures are designed to freely rotate on their gimbal(s) to achieve the necessary Precession Response 120 to provide the desired stabilization in accordance with the present disclosure.

Figure 83:
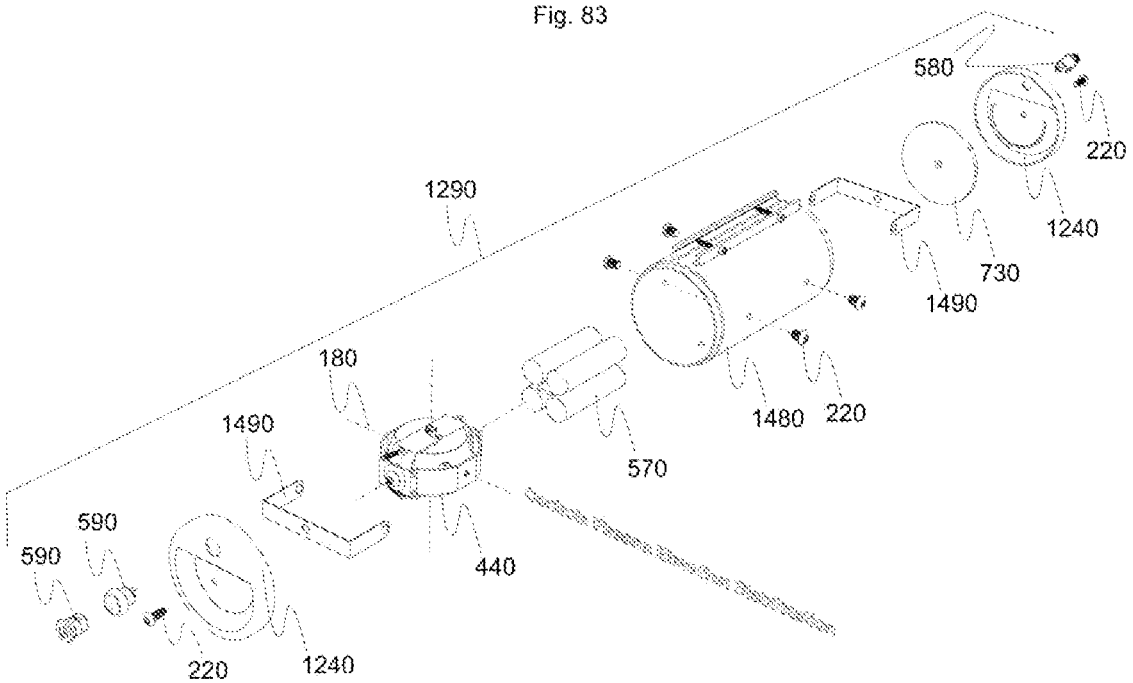
FIG. 83 is an illustration by way of example but not limited to this preferred embodiment showing; an exploded view of an Externally Attached Gimballed Precession Motor Stabilizer Device utilizing a single or more Externally Gimballed Integrated Precession Motor(s).

FIG. 83 is an illustration by way of example but not limited to this preferred embodiment showing; an exploded view of an Externally Attached Gimballed Precession Motor Stabilizer Device 1290 utilizing a single or more Externally Gimballed Integrated Precession Motor(s) 440. In this example but not limited to; the Batteries 570 are included inside the Stabilizer Housing 1480 rather than utilizing an external Battery Pack 1750, and there is only one Externally Gimballed Integrated Precession Motor(s) 440 shown, although it could have more. In this example, the illustration shows an Externally Gimballed Integrated Precession Motor(s) 440, although it could also have any version of a Gimballed Precession Motor(s) 1590. The internal workings of the assembly are held in place by Screw(s) 220 and internally placed End Bracket(s) 1490. In this configuration, the Externally Gimballed Integrated Precession Motor(s) 440 is aligned to control Elevation Stabilization of Firearm Axis 180. The Endcap 1240 is placed on both ends. On one end is the Activation Button/Remote Activation Connection 590, and on the other Endcap 1240 is the Charging Port 580. The activation method can be button, slide switch, toggle switch, remote switch, IR switch or any other method of activating the device. A Motor Control Circuit Board 730 is included in the assembly to manage the electronic operations of the motor. The independent motor(s) and their spinning masses inside these enclosures are designed to freely rotate on their gimbal(s) to achieve the necessary Precession Response 120 to provide the desired stabilization in accordance with the present disclosure.

Figure 84:
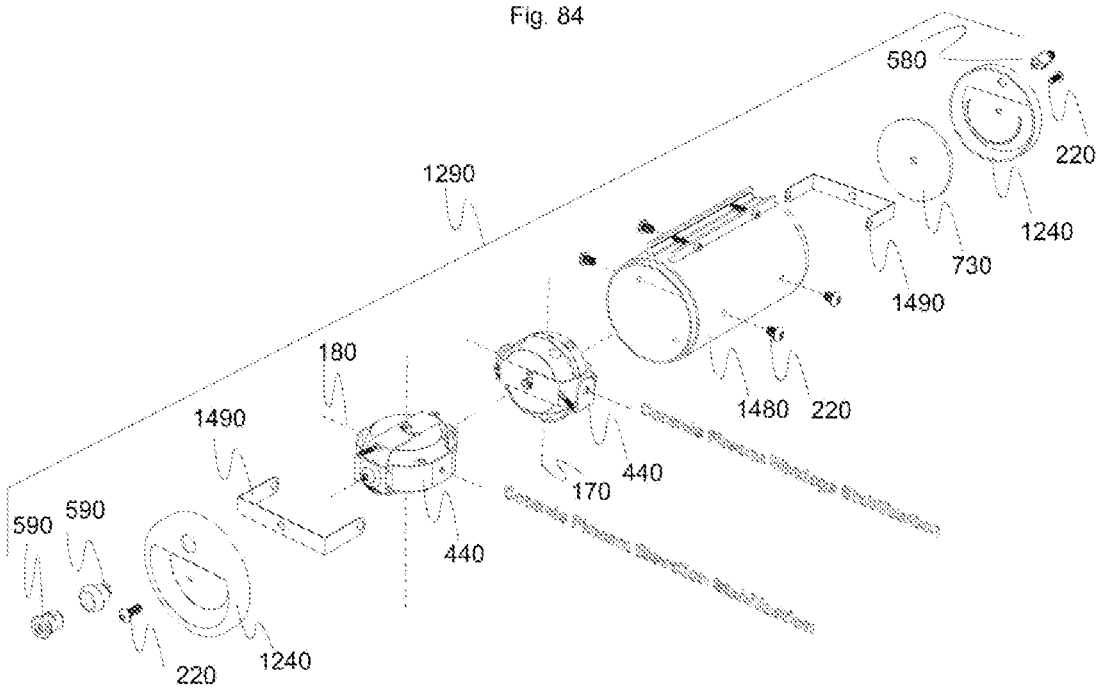
FIG. 84 is an illustration by way of example but not limited to this preferred embodiment showing; an exploded view of an Externally Attached Gimballed Precession Motor Stabilizer Device utilizing a single or more Externally Gimballed Integrated Precession Motor(s).

FIG. 84 is an illustration by way of example but not limited to this preferred embodiment showing; an exploded view of an Externally Attached Gimballed Precession Motor Stabilizer Device 1290 utilizing a single or more Externally Gimballed Integrated Precession Motor(s) 440. In this example but not limited to; there are two Gimballed Precession Motor(s) 1590 shown within the Stabilizer Housing 1480, although it could have more or less. In this example, the illustration shows an Externally Gimballed Integrated Precession Motor(s) 440, although it could also have any version of a Gimballed Precession Motor(s) 1590. In this configuration the two Externally Gimballed Integrated Precession Motor(s) 440 are aligned to control Elevation Stabilization of Firearm Axis 180 and the Windage Stabilization of Firearm Axis 170. The Endcap 1240 is placed on both ends by using the End Bracket(s) 1490. One the one end is the Activation Button/Remote Activation Connection 590, and on the other Endcap 1240 is the Charging Port 580. The activation method can be a button, slide switch, toggle switch, remote switch, IR switch or any other method of activating the device. A Motor Control Circuit Board 730 is included in the assembly to manage the electronic operations of the motor. The independent motor(s) and their spinning masses inside these enclosures are designed to freely rotate on their gimbal(s) to achieve the necessary Precession Response 120 to provide the desired stabilization in accordance with the present disclosure.

Figure 85:
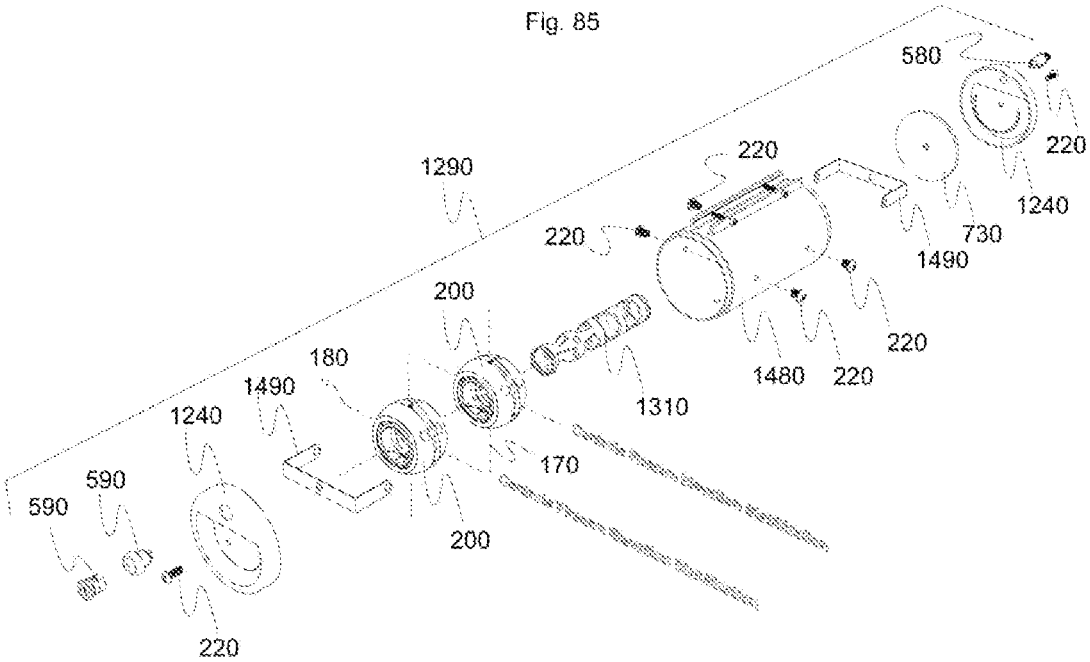
FIG. 85 is an illustration by way of example but not limited to this preferred embodiment showing; an exploded view of an Externally Attached Gimballed Precession Motor Stabilizer Device utilizing a single or more Internally Gimballed Integrated Precession Motor(s).

FIG. 85 is an illustration by way of example but not limited to this preferred embodiment showing; an exploded view of an Externally Attached Gimballed Precession Motor Stabilizer Device 1290 utilizing a single or more Internally Gimballed Integrated Precession Motor(s) 200. In this example two Internally Gimballed Integrated Precession Motor(s) 200 are shown, although it could have more or less. In this example, the illustration shows two Internally Gimballed Integrated Precession Motor(s) 200, although it could have any version of a Gimballed Precession Motor(s) 1590. In this case, the motors are attached to a Support Tube for Internally Gimballed Integrated Precession Motor 1310 and utilize a very small footprint. The two Internally Gimballed Integrated Precession Motor(s) 200 are aligned to control Elevation Stabilization of Firearm Axis 180 and the Windage Stabilization of Firearm Axis 170. The Endcap 1240 is placed on both ends by using the End Bracket(s) 1490. On one end is the Activation Button/Remote Activation Connection 590. On the other Endcap 1240 is the Charging Port 580. The activation method can be a button, slide switch, toggle switch, remote switch, IR switch or any other method of activating the device. A Motor Control Circuit Board 730 is included in the assembly to manage the motor. The independent motor(s) and their spinning masses inside these enclosures are designed to freely rotate on their gimbal(s) to achieve the necessary Precession Response 120 to provide the desired stabilization in accordance with the present disclosure.

Figure 86:
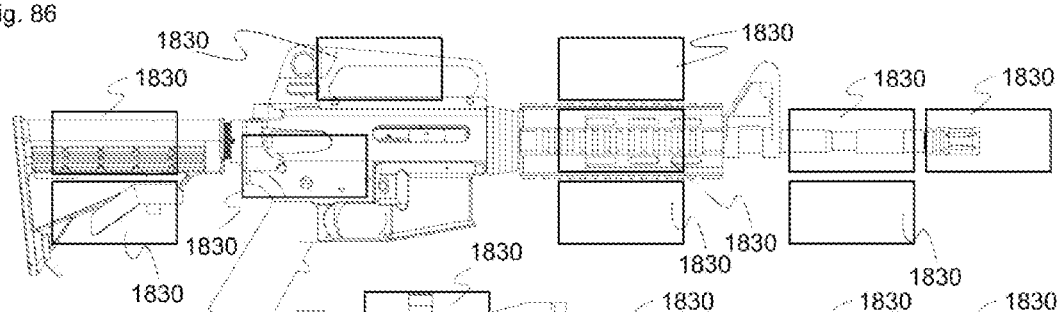
FIG. 86 is an illustration by way of example but not limited to this preferred embodiment showing; the different places you can place one or more Gimballed Precession Motor(s) stabilizers on a modern firearm such as a M4, M16, or an AK74 type rifle.

FIG. 86 is an illustration by way of example but not limited to this preferred embodiment showing; the different places you can place one or more Gimballed Precession Motor(s) 1590 stabilizers on a modern firearm such as a M4, M16, or a AK74 type rifle. Possible Placement Positions 1830 are identified with the boxes.

Figure 87:
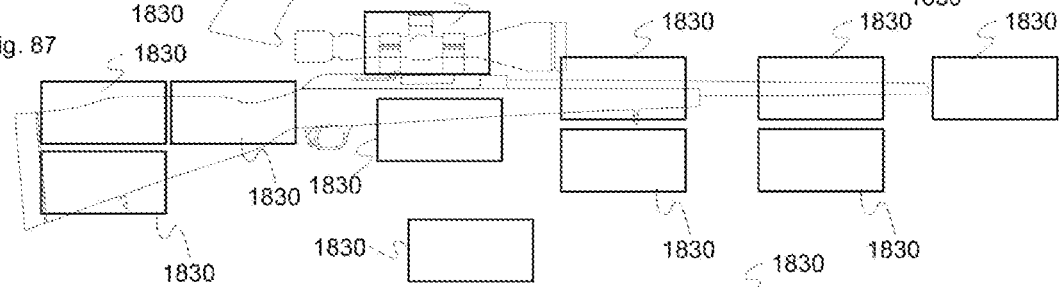
FIG. 87 is an illustration by way of example but not limited to this preferred embodiment showing; the different places you can place one or more Gimballed Precession Motor(s) stabilizers on a traditional type of firearm such as a rifle or shotgun.

FIG. 87 is an illustration by way of example but not limited to this preferred embodiment showing; the different places you can place one or more Gimballed Precession Motor(s) 1590 stabilizers on a traditional type of firearm such as a rifle or shotgun. Possible Placement Positions 1830 are identified with the boxes.

Figure 88:
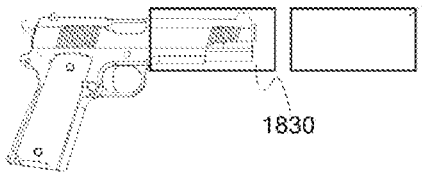
FIG. 88 is an illustration by way of example but not limited to this preferred embodiment showing; the different places you can place one or more Gimballed Precession Motor(s) stabilizers on a Handgun.

FIG. 88 is an illustration by way of example but not limited to this preferred embodiment showing; the different places you can place one or more Gimballed Precession Motor(s) 1590 stabilizers on a Handgun. Possible Placement Positions 1830 are identified with the boxes.

In the foregoing description, it should be appreciated that the gimbals restrict the rotating masses to pivoting movement about the gimbal axis. That is, the rotating masses are not free to pivot about multiple axes.

Also, the term weapon body is used to encompass any part of a weapon that is not the barrel. For example, a weapon body can include a stock, a handgrip, a receiver, a rail, etc.

The invention claimed is:

1. A gimballed precession stabilization system for an associated weapon comprising:

a first gimballed precession motor having a first mass rotatable about a first spin axis, the first mass supported by a first gimbal structure configured to permit precession of the first mass about a first gimbal axis, the first gimbal structure configured so that when mounted to the associated weapon, the first gimballed precession motor stabilizes the weapon by generating a first force during precession of the first mass to counteract an external force applied to the associated weapon in a first direction.

2. The gimballed precession stabilization system as set forth in claim 1, further comprising:

a second gimballed precession motor having a second mass rotatable about a second spin axis, the second mass supported by a second gimbal structure configured to permit precession of the second mass about a second gimbal axis extending at a non-zero angle relative to the first spin axis and the first gimble axis, the second gimbal structure configured so that when mounted to the associated weapon, the second gimballed precession motor stabilizes the weapon by generating a second force during precession of the second mass to counteract an external force applied to the associated weapon in a second direction.

3. The gimballed precession stabilization system of claim 2, wherein the first and second spin axes are parallel to a line of sight or firing axis of the associated weapon.

4. The gimballed precession stabilization system of claim 3, wherein the first and second gimbal axes are perpendicular to each other and perpendicular to the first and second spin axes, and wherein the first and second forces generated by the first and second gimballed precession motors act on the associated weapon in perpendicular directions.

5. The gimballed precession stabilization system of claim 4, wherein each of the first and second masses comprise annular bodies.

6. The gimballed precession stabilization system of claim 5, wherein the annular bodies are rotors of the first and second gimballed precession motors.

7. The gimballed precession stabilization system of claim 2, furthering comprising at least one biasing member for biasing the second mass about the second gimbal axis to a central position.

8. The gimballed precession stabilization system of claim 7, wherein the at least one biasing member applies a torque to the second mass about the second gimbal axis to resist precession of the second mass.

9. The gimballed precession stabilization system of claim 1, furthering comprising at least one biasing member for biasing the first mass about the first gimbal axis to a central position.

10. The gimballed precession stabilization system of claim 9, wherein the at least one biasing member applies a torque to the first mass about the first gimbal axis to resist precession of the first mass.

11. The gimballed precession stabilization system of claim 1, wherein the system has a central passageway and is configured for mounting coaxially with a barrel of the associated weapon.

12. A weapon comprising:

a weapon body;

a barrel supported by the weapon body; and a gimballed precession stabilization system for stabilizing the weapon, the gimballed precession stabilization system including:

a mass rotatable about a spin axis;

a motor configured to rotate the mass about the spin axis;

a gimbal structure supporting the mass and configured to permit precession of the mass about a gimbal axis;

whereby the stabilizer stabilizes the weapon in at least one of a windage or elevation direction by generating a force during precession of the mass to counteract an external force applied to the weapon in at least one of the windage or elevation direction;

wherein the gimballed precession stabilization system is integrated into at least one of the weapon body or the barrel of the weapon.

13. The weapon of claim 12, wherein the gimballed precession stabilization system includes a support tube having a central passageway and mounted coaxially with the barrel such that the barrel extends through the central passageway, the rotating mass surrounding at least a portion of the support tube, and the gimbal structure being supported by the support tube such that the rotating mass is internally gimbaled by the gimble structure.

14. The weapon of claim 13, wherein the gimbal structure supports the mass for rotation about the spin axis, and wherein the spin axis is parallel to a line of sight or firing axis of the associated weapon and the gimbal axis is perpendicular to the spin axis.

15. The weapon of claim 14, wherein the mass comprises an annular body.

16. The weapon of claim 15, wherein the mass is a rotor of an electric motor.

17. The weapon of claim 12, furthering comprising at least one biasing member for biasing the mass about the gimbal axis to a central position.

18. The weapon of claim 17, wherein the at least one biasing member applies a torque to the mass about the gimbal axis to resist precession.

19. The weapon of claim 12, wherein the weapon body includes at least one of a stock or handgrip or rail system, or foregrip or other component.

20. A method of stabilizing a weapon comprising:

providing the weapon with a gimballed precession stabilization system, the gimballed precession stabilization system including:

a first mass rotatable about a first spin axis;

a first motor configured to rotate the first mass about the first spin axis;

a first gimbal structure supporting the first mass and configured to permit precession of the first mass about a first gimbal axis;

and causing the first motor to rotate the first mass about the first spin axis;

whereby the gimballed precession stabilization system stabilizes the weapon in at least one of a windage or elevation direction by generating a force during precession of the first mass to counteract an external force applied to the weapon in at least one of the windage or elevation direction.

21. The method of claim 20, wherein the gimballed precession stabilization system further includes:

a second mass rotatable about a second spin axis;

a second motor configured to rotate the second mass about the second spin axis;

a second gimbal structure supporting the second mass and configured to permit precession of the second mass about a second gimbal axis extending at a non-zero angle relative to the first spin axis and the first gimble axis;

the method further comprising causing the second motor to rotate the second mass about the second spin axis;

whereby the gimballed precession stabilization system stabilizes the weapon in at least one of a windage or elevation direction by generating a force during precession of the second mass to counteract an external force applied to the weapon in at least one of the windage or elevation direction.

* * * * *